US012449173B2

(12) United States Patent
Kim et al.

(10) Patent No.: US 12,449,173 B2
(45) Date of Patent: Oct. 21, 2025

(54) REFRIGERATOR AND METHOD OF CONTROLLING THE SAME

(71) Applicant: SAMSUNG ELECTRONICS CO., LTD., Suwon-si (KR)

(72) Inventors: Ganghyun Kim, Suwon-si (KR); Sookang Kim, Suwon-si (KR); Kyungtae Ko, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 132 days.

(21) Appl. No.: 18/369,419

(22) Filed: Sep. 18, 2023

(65) Prior Publication Data

US 2024/0167746 A1 May 23, 2024

Related U.S. Application Data

(63) Continuation of application No. PCT/KR2023/011856, filed on Aug. 10, 2023.

(30) Foreign Application Priority Data

Nov. 21, 2022 (KR) ..... 10-2022-0156773

(51) Int. Cl.
*F25C 1/10* (2006.01)

(52) U.S. Cl.
CPC ..... *F25C 1/10* (2013.01)

(58) Field of Classification Search
CPC .... F25C 1/10; F25C 5/18; F25C 1/243; F25C 2305/0221; F25C 2400/12; F25C 1/25;
(Continued)

(56) References Cited

U.S. PATENT DOCUMENTS 8,353,179 B2 1/2013 Kim et al.
10,107,546 B2 10/2018 Lee et al.
(Continued)

FOREIGN PATENT DOCUMENTS

AU 773871 B2 6/2004
EP 2 772 708 B1 11/2019
(Continued)

OTHER PUBLICATIONS

International Search Report dated Nov. 24, 2023 for International Application No. PCT/KR2023/011856.
(Continued)

*Primary Examiner* — Kun Kai Ma
(74) *Attorney, Agent, or Firm* — STAAS & HALSEY LLP

(57) ABSTRACT

A refrigerator including a body; a water supply device including a water supply pipe at least partially inserted into the body, and a water supply valve to open and close the water supply pipe; an ice making device including an ice making tray defining an ice making space, the ice making tray being movable so that water from the water supply pipe is accommodatable in the ice making space when the ice making tray is positioned to make ice, and a driving device to move the ice making tray; and a control unit configured to, based on a user input to execute a function of removing foreign substances contained in water from the water supply pipe, control the driving device to move the ice making tray so water is prevented from being accommodated in the ice making space, and control the water supply valve to open the water supply pipe.

20 Claims, 27 Drawing Sheets

(58) Field of Classification Search
CPC ..... F25C 5/22; F25C 2700/04; F25D 23/12; F25D 29/00; F25D 29/005; F25D 2323/121; F25D 2400/361; F25D 2700/00
See application file for complete search history.

(56) References Cited

U.S. PATENT DOCUMENTS

| | | | |
|---|---|---|---|
| 10,119,752 | B2 | 11/2018 | Jeong et al. |
| 12,188,705 | B2 | 1/2025 | Lee et al. |

FOREIGN PATENT DOCUMENTS

| | | | | |
|---|---|---|---|---|
| JP | 2002364959 | A | * | 12/2002 |
| JP | 2007071469 | A | * | 3/2007 |
| JP | 2010-65961 | | | 3/2010 |
| JP | 2010-96410 | A | | 4/2010 |
| KR | 10-0381185 | B1 | | 4/2003 |
| KR | 10-0533275 | B1 | | 12/2005 |
| KR | 10-0790031 | B1 | | 1/2008 |
| KR | 10-2010-0087119 | | | 8/2010 |
| KR | 10-2010-0092686 | A | | 8/2010 |
| KR | 10-2013-0016551 | A | | 2/2013 |
| KR | 10-2014-0040395 | | | 4/2014 |
| KR | 10-2014-0089210 | | | 7/2014 |
| KR | 10-1519198 | B1 | | 5/2015 |
| KR | 10-1527227 | | | 6/2015 |
| KR | 10-1626981 | B1 | | 6/2016 |
| KR | 10-2017-0071218 | | | 6/2017 |
| KR | 10-2018-0020767 | | | 2/2018 |
| KR | 10-2021-005789 | | | 1/2021 |
| KR | 10-2321636 | B1 | | 11/2021 |
| KR | 10-2022-0015679 | | | 2/2022 |

OTHER PUBLICATIONS

Written Opinion of the International Searching Authority dated Nov. 24, 2023 for International Application No. PCT/KR2023/011856.
Extended European Search Report dated Aug. 7, 2025 for European Application No. 23894721.2.

* cited by examiner

REFRIGERATOR AND METHOD OF CONTROLLING THE SAME

CROSS-REFERENCE TO RELATED APPLICATIONS

This application is a continuation application, under 35 U.S.C. § 111(a), of International Application No. PCT/KR2023/011856, filed on Aug. 10, 2023, which claims priority under 35 U.S.C. § 119 to Korean Patent Application No. 10-2022-0156773, filed on Nov. 21, 2022, in the Korean Intellectual Property Office, the disclosures of which are incorporated by reference herein in their entireties.

BACKGROUND

1. Field

The disclosure relates to a refrigerator and a method of controlling the same, and more specifically, to a refrigerator including an ice making device and a method of controlling the refrigerator.

2. Description of the Related Art

A refrigerator is an appliance that includes a body having a storage compartment and a cold air supply system configured to supply cold air to the storage compartment and stores food in a fresh state. The storage compartment includes a refrigerator compartment maintained at a temperature of about 0 to 5° C. to store food refrigerated and a freezer compartment maintained at a temperature of about −30 to 0° C. to store food frozen. Generally, the storage compartment has an open front surface to allow food to be put in and taken out, and the open front surface of the storage compartment is opened and closed by a door.

The refrigerator repeats a cooling cycle in which a refrigerant is compressed, condensed, expanded, and evaporated using a compressor, a condenser, an expander, and an evaporator. Here, both the freezer compartment and the refrigerator compartment may be cooled by a single evaporator provided at the freezer compartment side, or an evaporator may be provided in each of the freezer compartment and the refrigerator compartment for the freezer compartment and the refrigerator compartment to be independently cooled.

A refrigerator may be equipped with an ice making device that makes ice. The ice making device may include an ice making tray for making ice and an ice bucket for storing ice discharged from the ice making tray.

The refrigerator may include a water supply device for supplying water to the ice making tray to make ice. The water supply device may supply water toward the ice making tray such that ice may be made in the ice making device.

However, there may be cases in which the water supply device needs to supply water not only for making ice in the ice making tray.

SUMMARY

Aspects of embodiments of the disclosure will be set forth in part in the description which follows and, in part, will be apparent from the description, or may be learned by practice of the presented embodiments.

According to an embodiment of the disclosure, a refrigerator includes a body; a water supply device including a water supply pipe at least partially inserted into the body, and a water supply valve configured to open and close the water supply pipe; an ice making device including an ice making tray defining an ice making space, the ice making tray being movable so that water discharged from the water supply pipe is accommodatable in the ice making space when the ice making tray is positioned to make ice, and a driving device configured to move the ice making tray; a user interface device configured to receive a user input; and a control unit configured to, based on a received user input to execute a function of removing foreign substances contained in water discharged from the water supply pipe, control the driving device to move the ice making tray to a position in which water discharged from the water supply pipe is prevented from being accommodated in the ice making space, and control the water supply valve to open the water supply pipe so that water is discharged from the water supply pipe.

According to an embodiment of the disclosure, the refrigerator may further include an ice bucket below the ice making tray. The control unit may be configured to control the driving device to move the ice making tray such that the water discharged from the water supply pipe is moved directly toward the ice bucket.

According to an embodiment of the disclosure, the ice making tray may be movable between a first state in which the water discharged from the water supply pipe is accommodated in the ice making space, and a second state in which the water discharged from the water supply pipe is prevented from being accommodated in the ice making space. The control unit may be configured to control the driving device such that the ice making tray is positioned in the second state based on the received user input.

According to an embodiment of the disclosure, the ice making tray may include a fixed tray, and a movable tray configured to be moved toward the fixed tray and away from the fixed tray by the driving device. The control unit may be configured to control the driving device to move the movable tray such that the water discharged from the water supply pipe is discharged between the fixed tray and the movable tray.

According to an embodiment of the disclosure, the ice making tray may be rotatable about a rotation axis by the driving device. The control unit may be configured to control the driving device to rotate the ice making tray to prevent the water discharged from the water supply pipe from being accommodated in the ice making space of the ice making tray.

According to an embodiment of the disclosure, the control unit may be configured, in order to prevent the water discharged from the water supply pipe from being accommodated in the ice making space of the ice making tray, to control the driving device such that the ice making tray is rotated to a position in which the water discharged from the water supply pipe is prevented from being accommodated in the ice making space, and control the water supply valve to open the water supply pipe so that the water is discharged from the water supply pipe.

According to an embodiment of the disclosure, the control unit may be configured, in order to allow water to overflow out of the ice making tray based on the user input being received, to control the water supply valve such that water is discharged from the water supply pipe while the ice making tray is prevented from rotating.

According to an embodiment of the disclosure, the ice bucket may be detachably mounted on the body. The control unit may be configured to control the water supply valve to close the water supply pipe after opening the water supply pipe for a predetermined time to perform a preliminary water dispensing process to check whether the ice bucket is mounted on the body.

According to an embodiment of the disclosure, the refrigerator may further include a mounting sensor configured to output a signal in response to the ice bucket being mounted on the body. The control unit may be configured to, based on the signal output from the mounting sensor in response to the ice bucket being mounted on the body, control the water supply valve to skip a preliminary water dispensing process and proceed with a main water dispensing process.

According to an embodiment of the disclosure, the refrigerator may further include a flow sensor configured to output a signal related to an amount of water flowing inside the water supply pipe. The control unit may be configured to control the user interface device to display a water dispensing amount based on the signal output from the flow sensor.

According to an embodiment of the disclosure, the control unit may be configured to control the user interface device to display a water dispensing amount on the user interface device based on a time during which water has flowed in the water supply pipe.

According to an embodiment of the disclosure, the control unit may be configured to control the water supply valve to close the water supply pipe when the water dispensing amount based on the signal output from the flow sensor is greater than a predetermined water dispensing amount for discharging the foreign substances.

According to an embodiment of the disclosure, the user interface device may be configured to receive a user input to stop supply of water. The control unit may be configured to control the water supply valve to close the water supply pipe based on the user input to stop the supply of water being received by the user interface device.

According to an embodiment of the disclosure, the refrigerator may further include a weight sensor configured to output a signal related to an amount of water accommodated in the ice bucket. The control unit may be configured to, in order to prevent water from overflowing out of the ice bucket, identify whether an amount of water supplied to the ice bucket is more than a preset amount based on the signal output from the weight sensor, and control the water supply valve to close the water supply pipe based on the amount of water supplied to the ice bucket being more than the preset amount.

According to an embodiment of the disclosure, the control unit may be configured to, based on an amount of water discharged from the water supply pipe exceeding a preset value, control the driving device to move the ice making tray such that the ice making tray is positioned in the first state in which the water discharged from the water supply pipe is accommodated in the ice making space to make ice.

According to an embodiment of the disclosure, provided is a method of controlling a refrigerator including a body, a water supply device including a water supply pipe at least partially inserted into the body and a water supply valve configured to open and close the water supply pipe, an ice making device including an ice making tray defining an ice making space, the ice making tray being movable so that water discharged from the water supply pipe is accommodatable in the ice making space when the ice making tray is positioned to make ice, and a driving device configured to move the ice making tray, and a user interface device configured to receive a user input, the method including receiving a user input to execute a function of removing foreign substances contained in water discharged from the water supply pipe, and, based on the received user input, controlling the driving device to move the ice making tray to a position in which water discharged from the water supply pipe is prevented from being accommodated in the ice making space, and controlling the water supply valve to open the water supply pipe to that water is discharged from the water supply pipe.

According to an embodiment of the disclosure, the method may further include displaying a notification window on the user interface device that inquires whether to execute the function of removing foreign substances contained in water discharged from the water supply pipe before controlling the driving device to move the ice making tray and controlling the water supply valve to open the water supply pipe.

According to an embodiment of the disclosure, the method may further include controlling the water supply valve to close the water supply pipe after opening the water supply pipe for a predetermined time, to perform a preliminary water dispensing process to check whether a detachable ice bucket is mounted on the body.

According to an embodiment of the disclosure, the method may further include controlling the user interface device to display a water dispensing amount based on a signal output from a flow sensor.

According to an embodiment of the disclosure, a refrigerator includes a body; a water supply device including a water supply pipe at least partially inserted into the body, and a water supply valve configured to open and close the water supply pipe; an ice making device including an ice making tray defining an ice making space, the ice making tray configured to be movable between a first state in which water discharged from the water supply pipe is accommodatable in the ice making space, and a second state in which water discharged from the water supply pipe is prevented from being accommodated in the ice making space, and a driving device configured to move the ice making tray; a user interface device configured to receive a user input; and a control unit configured to, based on a received user input to execute a function of removing foreign substances contained in water discharged from the water supply pipe, control the driving device to position the ice making tray in the first state, and control the water supply valve to open the water supply pipe so that water is discharged from the water supply pipe so as to flow into the ice making space and overflow out of the ice making space.

BRIEF DESCRIPTION OF THE DRAWINGS

These and/or other embodiments of the disclosure will become apparent and more readily appreciated from the following description of embodiments, taken in conjunction with the accompanying drawings of which.

DETAILED DESCRIPTION

The various embodiments of the disclosure and terminology used herein are not intended to limit the technical features of the disclosure to the specific embodiments, but rather should be understood to cover all modifications, equivalents, and alternatives falling within the concept and scope of the disclosure.

In the description of the drawings, like numbers refer to like elements throughout the description of the drawings.

The singular forms preceded by "a," "an," and "the" corresponding to an item are intended to include the plural forms as well unless the context clearly indicates otherwise.

In the disclosure, a phrase such as "A or B," "at least one of A and B," "at least one of A or B," "A, B or C," "at least one of A, B and C," and "at least one of A, B, or C" may include any one of the items listed together in the corresponding phrase of the phrases, or any possible combination thereof.

The term "and/or" includes combinations of one or all of a plurality of associated listed items.

As used herein, such terms as "1st" and "2nd," or "first" and "second" may be used to simply distinguish a corresponding component from another, and does not limit the components in other aspect (for example, importance or order).

When one (e.g., a first) element is referred to as being "coupled" or "connected" to another (e.g., a second) element with or without the term "functionally" or "communicatively," it means that the one element is connected to the other element directly, wirelessly, or via a third element.

It will be understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

It is to be understood that if a certain component is referred to as being "coupled with," "coupled to," "supported on" or "in contact with" another component, it means that the component may be coupled with the other component directly or indirectly via a third component.

In the description of an embodiment, it will be understood that, when an element is referred to as being "on/under" another element, it may be directly on/under the other element, or one or more elements may also be present.

Terms such as "up-down direction," "under," and "forward-backward direction" used in the following description are defined based on the drawings, and the shape and position of each element are not limited by the terms.

Figure 1:
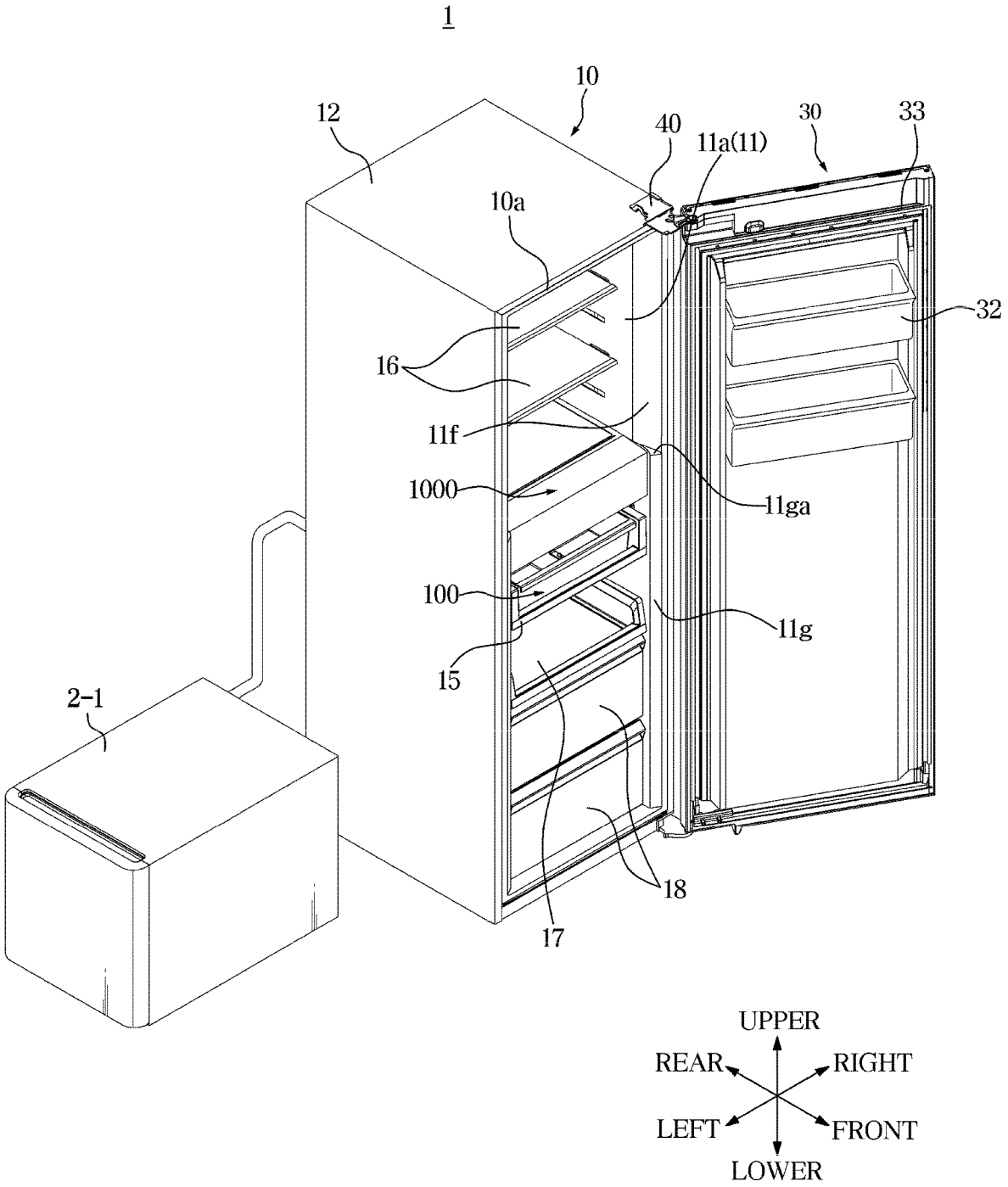
FIG. 1 is a perspective view illustrating a refrigerator and a filter device according to an embodiment of the disclosure.

Specifically, as shown in FIG. 1, the direction in which the storage compartment 20 is opened is defined as the frontward, and based on which and the rear, left and right sides, and top and bottom sides are defined.

Embodiments of the disclosure may provide a refrigerator capable of, when water supplied from a water supply device contains a foreign substance, preventing the water from being accommodated in an ice making tray, and a method of controlling the same.

Embodiments of the disclosure may provide a refrigerator in which upon replacement of a filter, which is connected to a water supply device, foreign substances initially formed in the filter are rapidly discharged to the outside of an ice making device without being produced as ice, and a method of controlling the same.

Embodiments of the disclosure may provide a refrigerator capable of changing the position of an ice making tray such that water discharged from a water supply device is smoothly discharged, and a method of controlling the same.

Embodiments of the disclosure may provide a refrigerator capable of preventing water discharged from a water supply device from flowing into a storage compartment other than an ice bucket, and a method of controlling the same.

Embodiments of the disclosure may provide a refrigerator capable of checking a water dispensing amount to check whether water containing foreign substances has been discharged from a water supply device, and a method of controlling the same.

Hereinafter, embodiments according to the disclosure will be described in detail with reference to the accompanying drawings.

Figure 2:
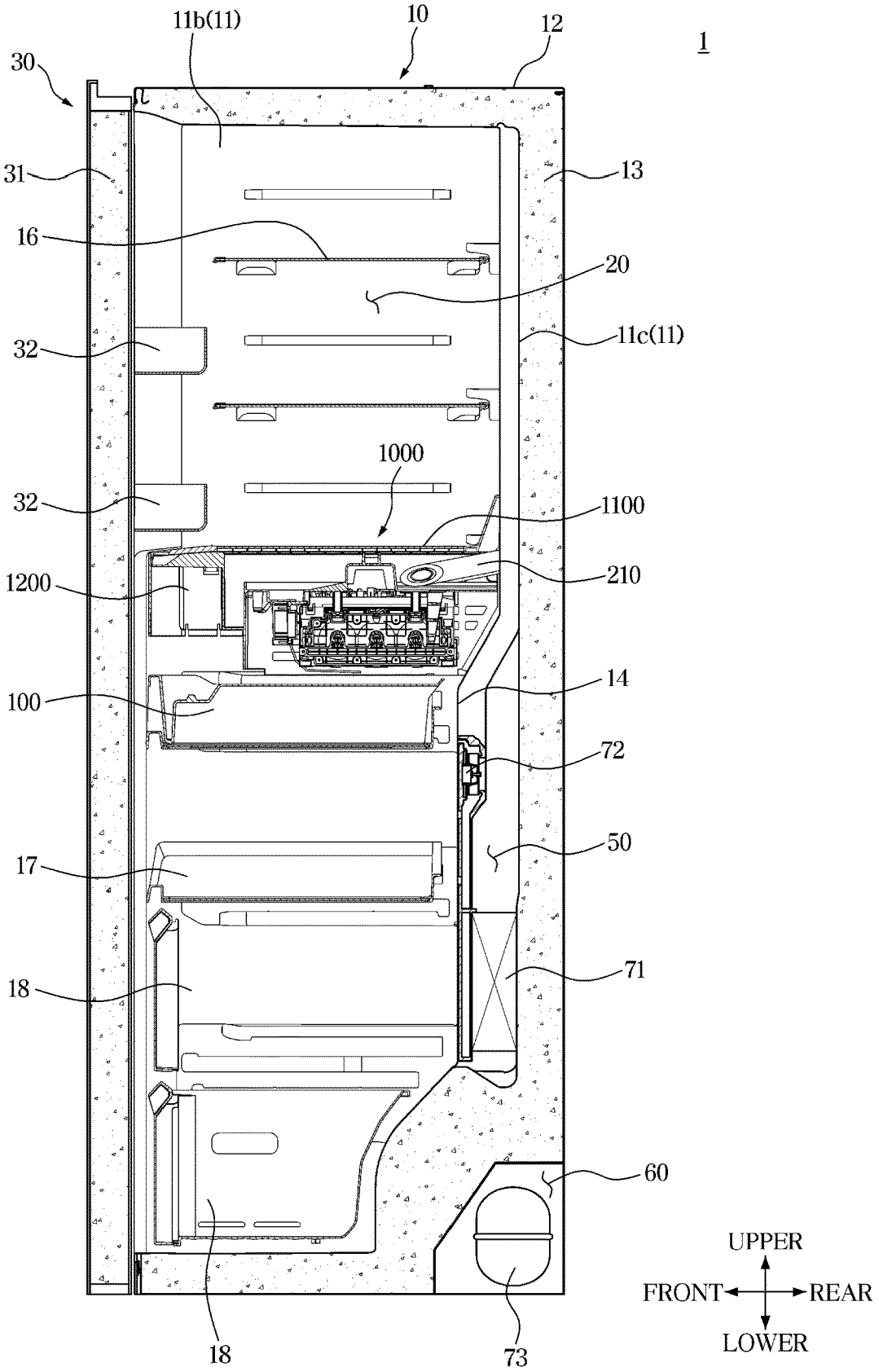
FIG. 2 is a cross-sectional view of the refrigerator shown in FIG. 1.

FIG. 1 is a perspective view illustrating a refrigerator 1 and a filter device 2-1 according to an embodiment of the disclosure. FIG. 2 is a cross-sectional view of the refrigerator 1 shown in FIG. 1.

Referring to FIGS. 1 and 2, a refrigerator 1 according to an embodiment of the disclosure is illustrated.

The refrigerator 1 may include a body 10, a storage compartment 20 provided inside the body 10, a door 30 configured to open and close the storage compartment 20, and a cold air supply device configured to supply cold air to the storage compartment 20.

The body 10 may have a front surface formed to be open to allow a user to put food in the storage compartment 20 or take food out of the storage compartment 20. That is, the body 10 may include an opening 10*a* formed in the front surface of the body 10. The opening 10*a* of the body 10 may be opened and closed by the door 30. The opening 10*a* of the body 10 may be referred to as an opening 10*a* of an outer case 12, an opening 10*a* of an inner case 11, or the like, which will be described below.

The body 10 may include the inner case 11 configured to form the storage compartment 20, the outer case 12 configured to form an exterior of the refrigerator 1, and a body insulator 13 provided between the inner case 11 and the outer case 12.

The outer case 12 may be formed to have a substantially box-like shape having an open front surface. The outer case 12 may form upper and lower surfaces, left and right side surfaces, and a rear surface of the refrigerator 1.

The outer case 12 may be configured to include a metal material. For example, the outer case 12 may be manufactured by processing a steel sheet material.

The inner case 11 may have an open front surface. The inner case 11 may have the storage compartment 20 provided therein and may be provided inside the outer case 12. An inner wall of the inner case 11 may form an inner wall of the storage compartment 20.

The inner wall of the inner case 11 may include a first inner wall 11*a*, a second inner wall 11*b* opposing the first inner wall 11*a*, a rear wall 11*c* provided between the first inner wall 11*a* and the second inner wall 11*b*, an upper wall, and a lower wall. For example, the first inner wall 11*a* may refer to the inner wall of the inner case 11 that is provided at the right side when the refrigerator 1 is viewed from the front. The second inner wall 11*b* may refer to the inner wall of the inner case 11 that opposes the first inner wall 11*a* and is provided at the left side when the refrigerator 1 is viewed from the front.

However, the positions of the first inner wall 11*a* and the second inner wall 11*b* are not limited thereto, and conversely, the inner wall of the inner case 11 that is provided at the left side when the refrigerator 1 is viewed from the front may be referred to as the first inner wall, and the inner wall of the inner case 11 that is provided at the right side when the refrigerator 1 is viewed from the front may be referred to as the second inner wall.

The inner case 11 may be configured to include a plastic material. For example, the inner case 11 may be manufactured by a vacuum forming process. For example, the inner case 11 may be manufactured by an injection molding process.

The body insulator 13 may be provided such that the outer case 12 and the inner case 11 are insulated from each other. The body insulator 13 may couple the inner case 11 and the outer case 12 to each other by being formed between the inner case 11 and the outer case 12. The body insulator 13 may prevent a heat exchange from occurring between the inside of the storage compartment 20 and the outside of the body 10 to improve efficiency of cooling the inside of the storage compartment 20.

Urethane foam insulation, expanded polystyrene insulation (EPS), a vacuum insulation panel, and the like may be used as the body insulator 13. However, the disclosure is not limited thereto, and the body insulator 13 may be configured to include various other materials.

The storage compartment 20 may be formed inside the body 10. For example, the storage compartment 20 may include a freezer compartment maintained at a temperature of about −30 to 0° C. to freeze and store food.

A shelf 16 on which food may be placed, a movable shelf 17 which may be inserted into and withdrawn from the inner case 11 and on which food may be placed, and a drawer 18 which may be inserted into and withdrawn from the inner case 11 and in which food may be stored may be provided in the storage compartment 20.

The inner case 11 may include an inclined wall 11*f*. The inclined wall 11*f* may be disposed at a front of the body 10 adjacent to the door 30. The inclined wall 11*f* may be, from one side adjacent to the door 30 toward the other side facing the rear wall 11*c*, inclined toward the inside of the storage compartment 20 in a left-right direction. The other side of the inclined wall 11*f* may be a portion in which the inclined wall 11*f* meets the first inner wall 11*a* or the second inner wall 11*b*. The inclined wall 11*f* may be disposed along at least a portion of the opening 10*a*.

An inclined protruding wall 11*g* may be disposed under the inclined wall 11*f*. The inclined protruding wall 11*g* may be formed to protrude further toward the inside of the storage compartment 20 in the left-right direction than the inclined wall 11*f*. Also, the inclined protruding wall 11*g* may be formed to protrude further toward the front than the inclined wall 11*f*. The inclined protruding wall 11*g* may include a protruding upper surface 11*ga*. The protruding upper surface 11*ga* may be disposed adjacent to a front inclined portion 1130. The inclined protruding wall 11*g* may be disposed along at least a portion of the opening 10*a*.

When a user views the inside of the storage compartment 20 through the opening 10*a* of the body 10, the inclined wall 11*f* and the inclined protruding wall 11*g* may provide an improved aesthetic sense that makes the volume of the storage compartment 20 look wider to the user.

An ice making cover 1100 of an ice making device 1000 may have the front inclined portion 1130 (see FIG. 5) formed to correspond to the inclined shape of the inclined protruding wall 11*g*. Since the front inclined portion 1130 is inclined upward toward the rear, the inclined shape of the front inclined portion 1130 may form a harmonious aesthetic sense with the inclined protruding wall 11*g*. The ice making cover 1100 will be described below.

The refrigerator 1 may include a cold air supply device provided to generate cold air using a cooling cycle and supply the generated cold air to the storage compartment 20.

The cold air supply device may generate cold air using evaporative latent heat of a refrigerant in the cooling cycle. The cold air supply device may be configured to include a compressor 73, a condenser, an expansion valve, an evaporator 71, a blower fan 72, and the like.

A cooling chamber 50 and a mechanical chamber 60 that allow the cold air supply device to be disposed may be provided in the body 10. For example, configurations such as the evaporator 71 configured to generate cold air and the blower fan 72 provided to allow the cold air generated by the evaporator 71 to flow may be provided in the cooling chamber 50. Configurations such as the compressor 73 and the condenser may be provided in the mechanical chamber 60.

The cooling chamber 50 may be disposed behind the storage compartment 20. The mechanical chamber 60 may be disposed behind the storage compartment 20.

Components of the refrigerator 1 that constitute the cold air supply device may have a relatively large weight. Accordingly, the cooling chamber 50 and the mechanical chamber 60 may be provided at a lower portion of the body 10. However, the disclosure is not limited thereto, and the cooling chamber 50 and the mechanical chamber 60 may be disposed in various other ways, and the components constituting the cold air supply device may be disposed in various ways to correspond to the positions of the cooling chamber 50 and the mechanical chamber 60.

Since cold air is generated by the evaporator 71 in the cooling chamber 50, the cooling chamber 50 may maintain a relatively low-temperature state. On the other hand, since heat is generated by the compressor 73, the condenser, and the like in the mechanical chamber 60, the mechanical chamber 60 may maintain a relatively high-temperature state. Accordingly, the cooling chamber 50 and the mechanical chamber 60 may be formed in separate spaces and insulated from each other. For example, the body insulator 13 may be formed between the cooling chamber 50 and the mechanical chamber 60.

The evaporator 71 provided in the cooling chamber 50 may evaporate a refrigerant to generate cold air, and the cold air generated by the evaporator 71 may flow due to the blower fan 72. The cold air flowing due to the blower fan 72 may flow from the cooling chamber 50 to the storage compartment 20. The cooling chamber 50 may be provided to communicate with the storage compartment 20.

For example, cold air generated by the evaporator 71 may flow toward a top of the cooling chamber 50 due to the blower fan 72. The cold air flowing due to the blower fan 72 may flow toward a top of the body 10 along a cold air supply duct 14. The cold air may be discharged forward from the cold air supply duct 14 and eventually be introduced into the storage compartment 20. On the other hand, for example, cold air generated by the evaporator 71 may flow to a lower portion of the body 10 due to the blower fan 72 and be introduced into the storage compartment 20.

The refrigerator 1 according to one embodiment of the disclosure may be an indirect-cooling refrigerator. Hereinafter, for convenience of description, description will be given assuming that the refrigerator 1 according to one embodiment of the disclosure is an indirect-cooling refrigerator, but the concept of the disclosure is not limited thereto and may also apply to a direct-cooling refrigerator.

The evaporator 71, the blower fan 72, and the like disposed in the cooling chamber 50 may be referred to as cold air supply devices in that the evaporator 71 generates cold air and the blower fan 72 supplies the cold air to the storage compartment 20.

The body 10 may include the cold air supply duct 14. The cold air supply duct 14 may form a cold air flow path along which cold air generated by the cold air supply device flows from the cooling chamber 50 to the storage compartment 20. The storage compartment 20 may be provided to communicate with the cold air supply duct 14.

The cold air supply duct 14 may be formed inside the inner case 11. The cold air supply duct 14 may be formed at a rear portion of the inner case 11. More specifically, the cold air supply duct 14 may be provided behind the storage compartment 20.

The door 30 may be provided to open and close the storage compartment 20. The door 30 may be rotatably coupled to the body 10. More specifically, the door 30 may be rotatably coupled to the body 10 by a hinge 40 connected to each of the door 30 and the body 10. The door 30 may be rotatably coupled to the outer case 12.

An outer surface of the door 30 may form a portion of the exterior of the refrigerator 1. While the door 30 is at a closing position, the outer surface of the door 30 may form a front surface of the door 30.

An inner surface of the door 30 may be formed at a side opposite to the outer surface of the door 30. While the door 30 is at the closing position, the inner surface of the door 30 may form a rear surface of the door 30. While the door 30 is at the closing position, the inner surface of the door 30 may be provided to face the inside of the body 10. While the door 30 is at the closing position, the inner surface of the door 30 may be provided to cover the front of the storage compartment 20.

A foaming space may be formed between the outer surface of the door 30 and the inner surface of the door 30, and a door insulator 31 may be foamed in the foaming space. The door insulator 31 may prevent a heat exchange from occurring between the outer surface and the inner surface of the door 30. The door insulator 31 may improve insulation performance between the inside of the storage compartment 20 and the outside of the door 30.

Urethane foam insulation, expanded polystyrene insulation (EPS), a vacuum insulation panel, and the like may be used as the door insulator 31. However, the disclosure is not limited thereto, and the door insulator 31 may be configured to include various other materials.

For example, the door insulator 31 may be configured with an insulator formed of the same material as the body insulator 13. On the other hand, for example, the door insulator 31 may be configured with an insulator formed of a different material from the body insulator 13.

A door gasket 33 provided to seal a gap between the door 30 and the body 10 and prevent leakage of cold air from the storage compartment 20 may be provided on the inner surface of the door 30. The door gasket 33 may be provided along the periphery of the inner surface of the door 30. The door gasket 33 may be disposed to be parallel to the opening 10*a* of the body 10 while the door 30 is closed. The door gasket 33 may be configured to include an elastic material such as rubber.

A door shelf 32 on which food may be stored may be provided on the inner surface of the door 30.

The refrigerator 1 may include the ice making device 1000 configured to form ice using cold air of the storage compartment 20. The ice making device 1000 may include ice making units 1300 and 1400 (see FIG. 5 and so on) configured to form ice and an ice making case 1200 (see FIG. 2 and so on) configured to support the ice making units 1300 and 1400.

The ice making device 1000 may be provided in the storage compartment 20. The ice making device 1000 may be mounted in the inner case 11. Specifically, the inner case 11 may include holders provided on the inner walls 11*a* and 11*b* of the inner case 11, and the ice making device 1000 may be supported by the holders (see FIG. 5 and so on). For example, the holders may be formed to have shapes that protrude from the inner walls 11*a* and 11*b* of the inner case 11. For example, the holders may be formed to have shapes that are concavely recessed in the inner walls 11*a* and 11*b* of the inner case 11.

The refrigerator 1 may further include a water supply device 200. The water supply device 200 may be a device configured to supply water to the refrigerator 1.

The water supply device 200 may further include a water supply pipe 210 provided to receive water from an external water supply source (not shown). The water supply pipe 210 may be provided to supply the water received from the external water supply source to the ice making device 1000. The ice making device 1000 may form ice using the water received through the water supply pipe 210.

The water supply pipe 210 may be formed to have the shape of a pipe having a water supply flow path, along which water flows, formed therein.

The water supply pipe 210 may be provided in a quantity corresponding to the number of the ice making units 1300 and 1400. For example, the ice making units 1300 and 1400 may include a first ice making unit 1300 and a second ice making unit 1400 (see FIG. 5 and so on), and the water supply pipe 210 may be provided as a plurality of water supply pipes 210 to supply water to each of the first ice making unit 1300 and the second ice making unit 1400.

The water supply pipe 210 may be disposed to pass through the body 10. The water supply pipe 210 may be disposed to pass through the outer case 12 and the inner case 11. More specifically, the water supply pipe 210 may pass through rear surfaces of the outer case 12 and the inner case 11. The water supply pipe 210 may pass through the rear surfaces of the outer case 12 and the inner case 11 in a forward-backward direction. Here, the rear surface of the inner case 11 may indicate the above-mentioned rear wall 11*c* of the inner case 11.

As will be described below, when the ice making units 1300 and 1400 include the first ice making unit 1300 and the second ice making unit 1400, the water supply pipe 210 may also include a water supply pipe 210*a* and a water supply pipe 210*b*. The first water supply pipe 210*a* may be configured to supply water to the first ice-making unit 1300, and the second water supply pipe 210*b* may be configured to supply water to the second ice-making unit 1400.

The water supply device 200 may include a water supply valve 220. The water supply valve 220 may be configured to open or close the water supply pipe 210.

The water supply valve 220 may be located in the water supply pipe 210. The water supply valve 220 may block the water supply flow path of the water supply pipe 210, thereby preventing water from flowing further into the water supply pipe 210.

The water supply valve 220 may include, for example, an AC valve. The water supply valve 220 may be operated manually or by an electrical signal.

The refrigerator 1 may include an ice bucket 100 provided to accommodate ice formed by the ice making device 1000. The ice bucket 100 may be provided in the storage compartment 20.

The ice bucket 100 may be mounted in the inner case 11. The ice bucket 100 may be supported by the first inner wall 11*a* and the second inner wall 11*b* of the inner case 11.

The ice bucket 100 may be disposed under the ice making device 1000. The ice bucket 100 may be provided to accommodate ice moving downward after being discharged from the ice making units 1300 and 1400.

A bucket shelf 15 configured to support the ice bucket 100 may be provided in the storage compartment 20. The ice bucket 100 may be seated on the bucket shelf 15. The bucket shelf 15 may be supported by the first inner wall 11*a* and the second inner wall 11*b*.

Specific features of the ice making device 1000 and the ice bucket 100 will be described below.

The configuration of the refrigerator 1 described above with reference to FIGS. 1 and 2 is only an example for describing a refrigerator according to the concept of the disclosure, and the concept of the disclosure is not limited thereto. The refrigerator according to the concept of the disclosure may be provided to include various configurations for performing a function of supplying cold air to a storage compartment for storing food.

The refrigerator 1 including the body 10 configured to have the single storage compartment 20 formed therein and the single door 30 configured to open and close the storage compartment 20 has been described above as an example of the disclosure for convenience of description, but the concept of the disclosure is not limited thereto, and the configuration of the disclosure may be applied to various other types of refrigerators. A refrigerator according to one embodiment of the disclosure may be a side-by-side (SBS) refrigerator in which a refrigerator compartment and a freezer compartment are arranged side by side (see FIG. 21). Alternatively, a refrigerator according to one embodiment of the disclosure may be a bottom mounted freezer (BMF) refrigerator in which a refrigerator compartment is formed at an upper side and a freezer compartment is formed at a lower side. A refrigerator according to one embodiment of the disclosure may be a top mounted freezer (TMF) refrigerator in which a freezer compartment is formed at an upper side and a refrigerator compartment is formed at a lower side.

As shown in FIG. 1, the refrigerator 1 according to an embodiment of the disclosure may be connected to a filter device 2-1. The filter device 2-1 may be connected to a water supply source. Water supplied from the water supply source may be filtered in the filter device 2-1 and impurities may be removed. Water with impurities removed may be supplied to the refrigerator 1. The supplied water may make ice or cold water in the refrigerator 1 and be supplied to the user.

However, it is not limited thereto, and the filter device may be one component of the refrigerator 1. In this case, the filter device may be located on the inside of the outer case 12.

Alternatively, the filter device may be located on the inside of the refrigerator 1.

However, for convenience of description, the disclosure is described assuming that the filter device 2-1 is a separate component from the refrigerator 1, and is located on the outside of the refrigerator.

Figure 3:
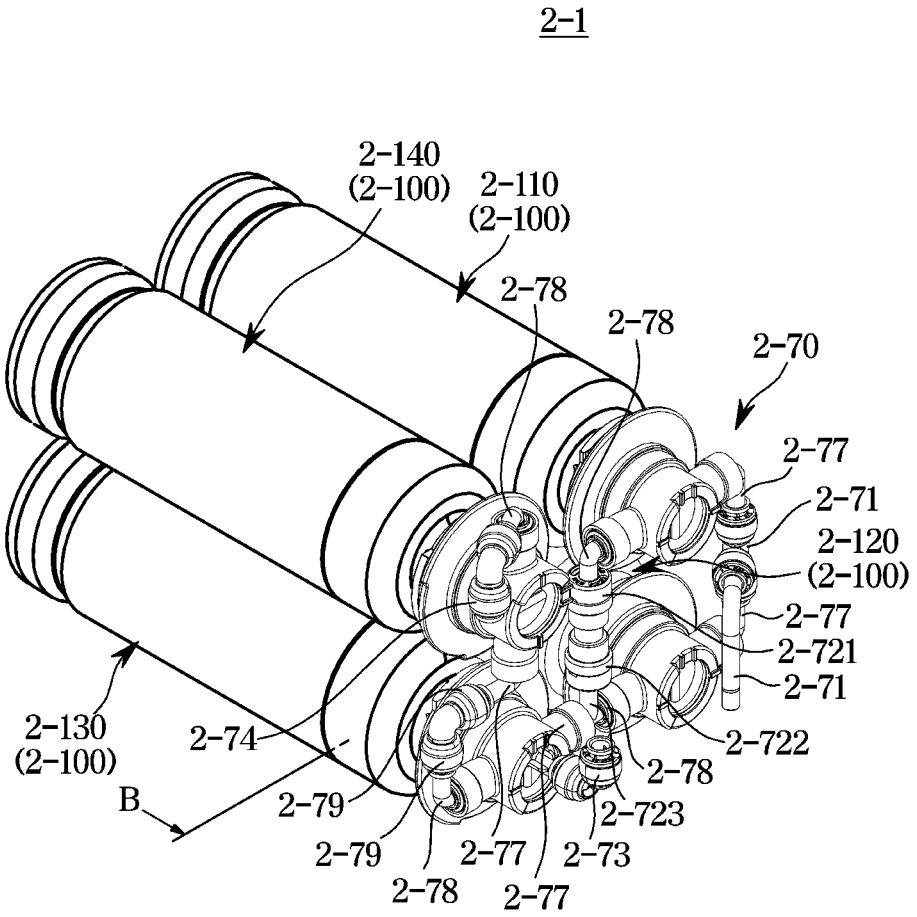
FIG. 3 is a perspective view illustrating a filter of the filter device shown in FIG. 1 and related parts thereof according to an embodiment of the disclosure.
Figure 4:
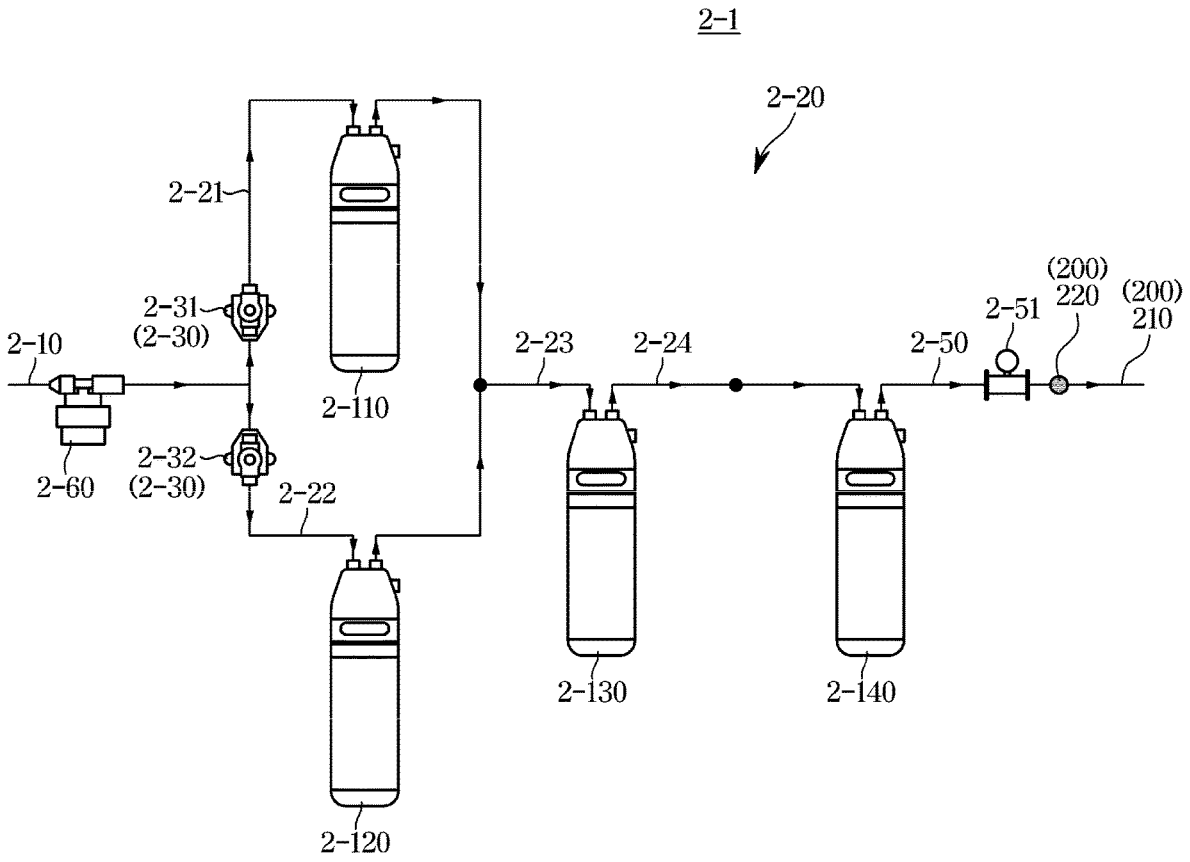
FIG. 4 is a conceptual diagram illustrating a flow path of the filter device shown in FIG. 1.

FIG. 3 is a perspective view illustrating a filter 2-100 of the filter device 2-1 shown in FIG. 1 and components related thereto. FIG. 4 is a conceptual diagram illustrating a flow path of the filter device 2-1 shown in FIG. 1.

Referring to FIGS. 3 and 4, a filter 2-100 according to an embodiment of the disclosure will be described.

The filter device 2-1 may include a plurality of filters 2-100. The plurality of filters 2-100 may include a first filter 2-110, a second filter 2-120, a third filter 2-130, and a fourth filter 2-140. Some of the components may be omitted.

The filter device 2-1 may include a water purifying flow path 2-20 connected to a raw water flow path 2-10 such that raw water may be purified. The filter device may include a plurality of pre-treatment filters disposed on the water purifying flow path 2-20 to filter raw water. The plurality of pre-treatment filters may include a first filter 2-110 and a second filter 2-120.

The pre-treatment filter may include a pre-carbon filter, a precipitate filter, a high turbidity filter, and a composite filter in which a precipitate filter and a pre-carbon filter are combined. By using a composite filter, the pre-treatment filter may remove large foreign substances while removing chlorine, organic compounds, odors and colors through adsorption. When a plurality of same types of filters are used, replacement cycles of the filters may become the same, and thus filter replacement may be facilitated. In addition, the pre-treatment filter may include a 2-granular activated carbon (GAC) filter, a block carbon filter, and a filter processed by high heat treatment of coconut. Some of the above components may be omitted.

In the drawing, the pre-treatment filters are shown as two pre-treatment filters, but it is not limited thereto and the pre-treatment filters may include three or more pre-treatment filters.

In various embodiments, the filter may be one or a combination of the various filters described above. In addition, filters according to embodiments of the disclosure are not limited to the above-described filters, and may include new filters according to technological development.

The first filter 2-110 and the second filter 2-120 may be arranged in parallel. Purified water discharged from the first filter 2-110 and the second filter 2-120 may flow to the third filter 2-130 and the fourth filter 2-140 connected in series.

By using a plurality of pre-treatment filters in parallel, the effect of increasing the water discharge pressure may be obtained. When homogeneous filters are used, the water treatment capacity is reduced by half, resulting in an extended lifespan of filters. Accordingly, inconvenience caused by filter replacement may be minimized, and user convenience may be achieved.

The third filter 2-130 is a water purifying filter and may include a water-permeable membrane filter. The fourth filter 2-140 is a post-treatment filter and may include a post-carbon filter. Some of the above components may be omitted.

Specifically, the third filter 2-130 may include one of an ultrafiltration membrane, a nanofiltration membrane, and a reverse osmosis membrane.

More specifically, the ultrafiltration membrane may include micropores having a pore diameter greater than or equal to 0.005 micrometers and less than or equal to 0.5 micrometers, the nanofiltration membrane may include micropores having a pore diameter greater than or equal to 0.001 micrometers and less than or equal to 0.005 micrometers, and the reverse osmosis membrane may include micropores having a pore diameter greater than or equal to 0.0001 micrometers and less than or less than 0.001 micrometers.

The fourth filter 2-140 may improve the taste of water by adsorbing fine substances and removing gas components and odors. The fourth filter 2-140 may include a GAC filter, a Block carbon filter, a silver carbon filter, a 2-deionization (DI) resin filter, and a 2-taste chlorine reduction (TCR) filter). Some of the above components may be omitted.

The third filter 2-130 and the fourth filter 2-140 may include a composite filter in which a membrane filter and a post-treatment filter are combined.

In various embodiments, the filter may be one or a combination of the various filters described above. In addition, filters according to embodiments of the disclosure are not limited to the above-described filters, and may include new filters according to technological development.

The water purification flow path 2-20 may branch from the raw water flow path 2-10 in plural. That is, the water purification flow path may be a plurality of branch flow paths. The water purification flow path 2-20 may include a first water purification flow path 2-21, a second water purification flow path 2-22, a third water purification flow path 2-23, and a fourth water purification flow path 2-24. Some of the above components may be omitted.

The first water purification flow path 2-21 may be connected to the raw water flow path 2-10 and formed on an upstream side of the first filter 2-110. The second water purification flow path 2-22 may be connected to the raw water flow path 2-10 and formed on an upstream side of the second filter 2-120. The third water purification flow path 2-23 may be formed from a connection point of a downstream side of the first filter 2-110 and a downstream side of the second filter 2-120 to an upstream of the third filter 2-130. The fourth water purification flow path 2-24 may be connected to the third filter 2-130 and may be formed up to a connection point of the water purification flow path 2-20.

The water purification flow path 2-20 may include a plurality of inlet valves 2-30 that open and close the flow path such that raw water is allowed to flow or prevented from flowing into the water purification flow path 2-20. The plurality of inflow valves 2-30 may be installed upstream of the plurality of pre-treatment filters in the direction in which water flows, to control opening and closing of the water purification flow path. Some of the above components may be omitted.

The plurality of inlet valves 2-31 and 2-32 may include a first inlet valve 2-31 and a second inlet valve 2-32. The first inlet valve 2-31 may be installed upstream of the first filter 2-110 to control opening and closing of the first water purification flow path 2-21. The second inlet valve 2-32 may be installed upstream of the second filter 2-120 to control opening and closing of the second water purification flow path 2-22. Some of the above components may be omitted.

A water dispensing flow path 2-50 may be provided to allow purified water passed through the post-treatment filter to be supplied to the user. Some of the above components may be omitted.

A pressure reducing valve 2-60 for reducing the water pressure of raw water may be provided in the raw water flow path 2-10.

The water dispensing flow path 2-50 may further include a flow meter 2-51 for measuring the amount of purified water. The amount of purified water of the filter device may be measured through the flow rate measured by the flow meter 2-51. With such a configuration, an appropriate replacement time for each filter may be identified.

The filter device 2-1 may include an outer casing accommodating the plurality of filters 2-100. In addition, the filter device 2-1 may include a door bracket rotatably coupled to the outer casing.

The filter device 2-1 may include a pipe portion 2-70. The pipe portion 2-70 may include a water inlet flow path 2-77 and a water outlet flow path 2-78.

Figure 5:
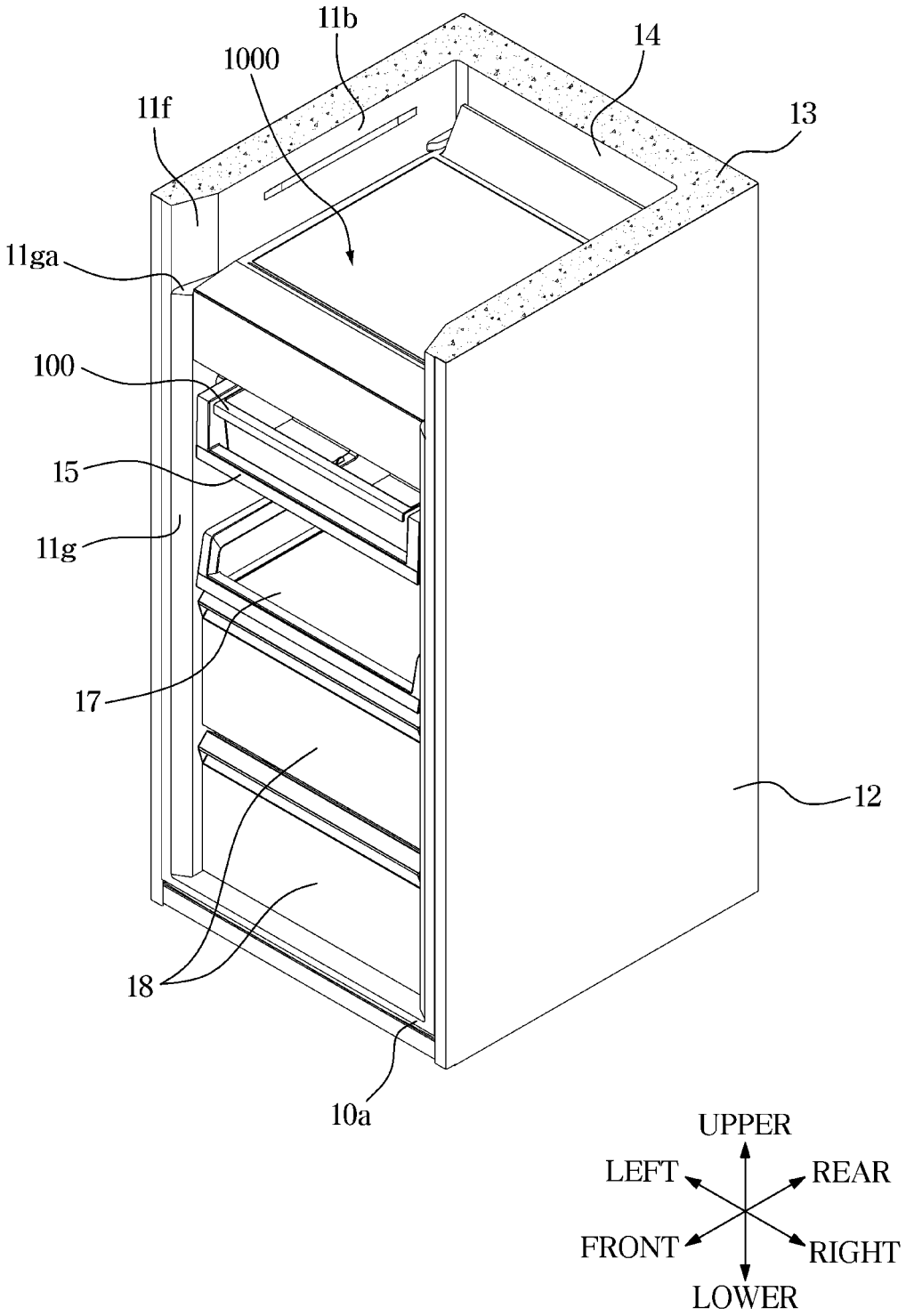
FIG. 5 is a cross-sectional view illustrating the refrigerator shown in FIG. 1.
Figure 6:
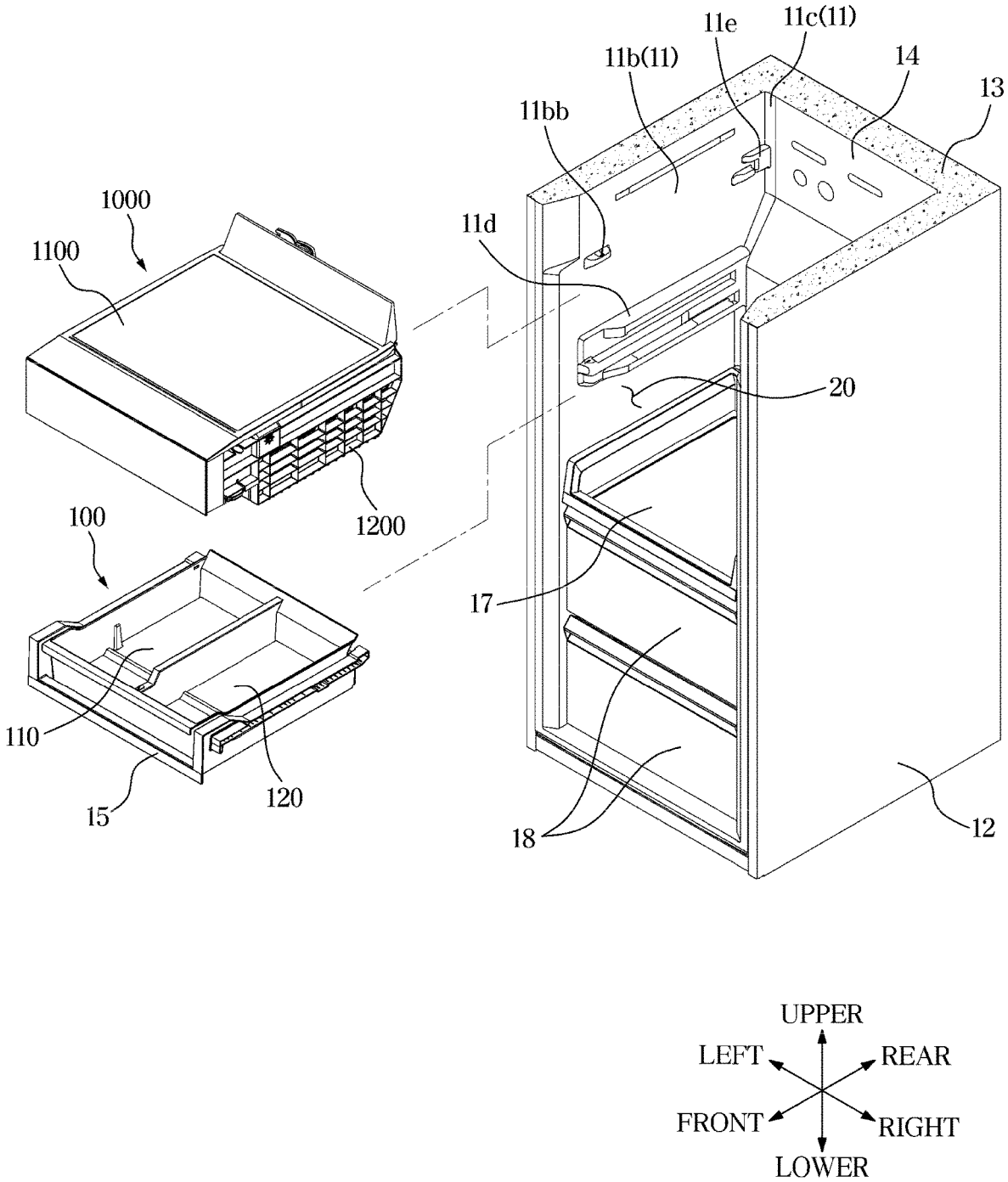
FIG. 6 is an exploded view illustrating an ice making device and related parts thereof, separated from a body of the refrigerator shown in FIG. 5, according to an embodiment of the disclosure.
Figure 7:
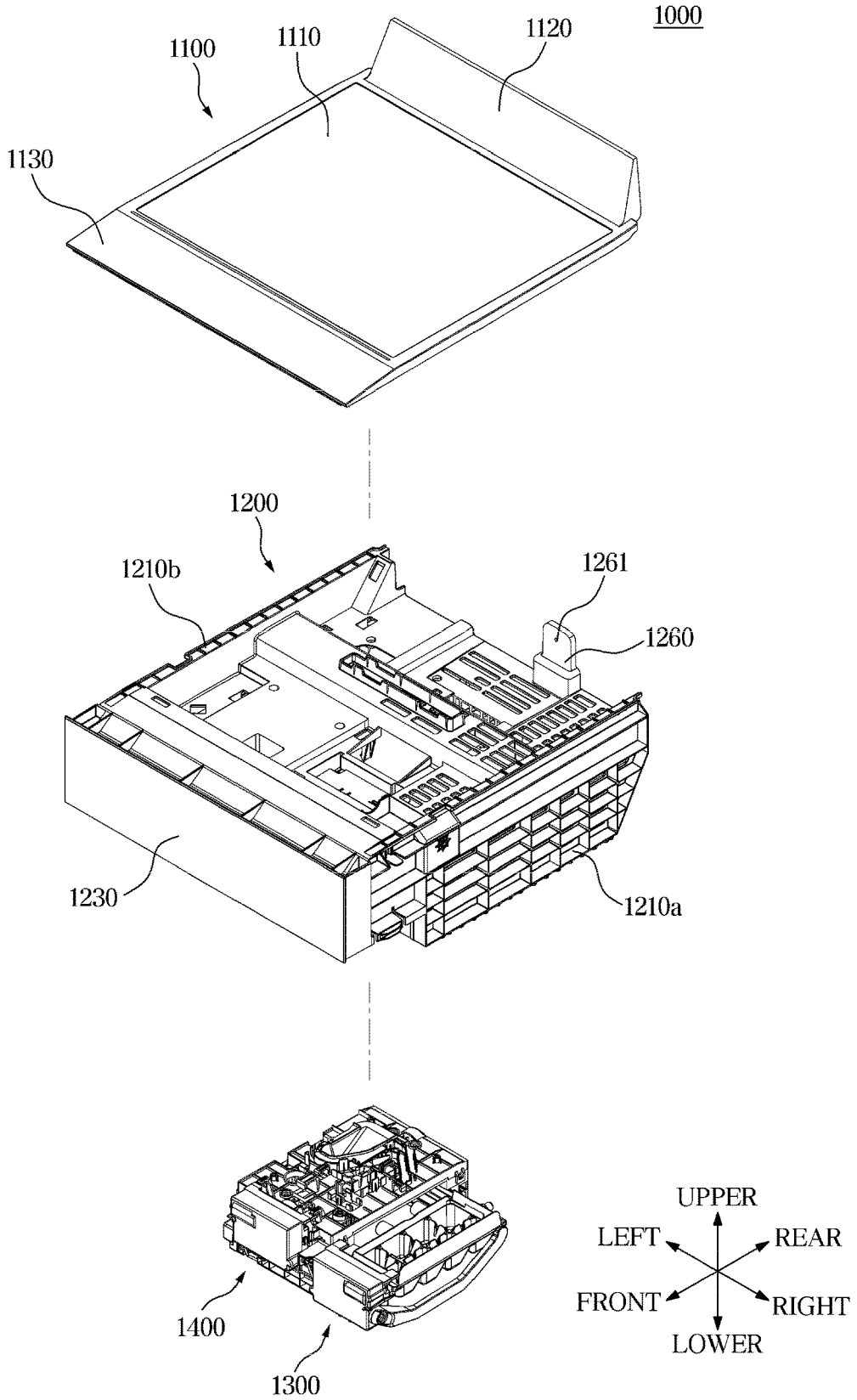
FIG. 7 is an exploded view illustrating the ice making device of the refrigerator shown in FIG. 6 according to an embodiment of the disclosure.
Figure 8:
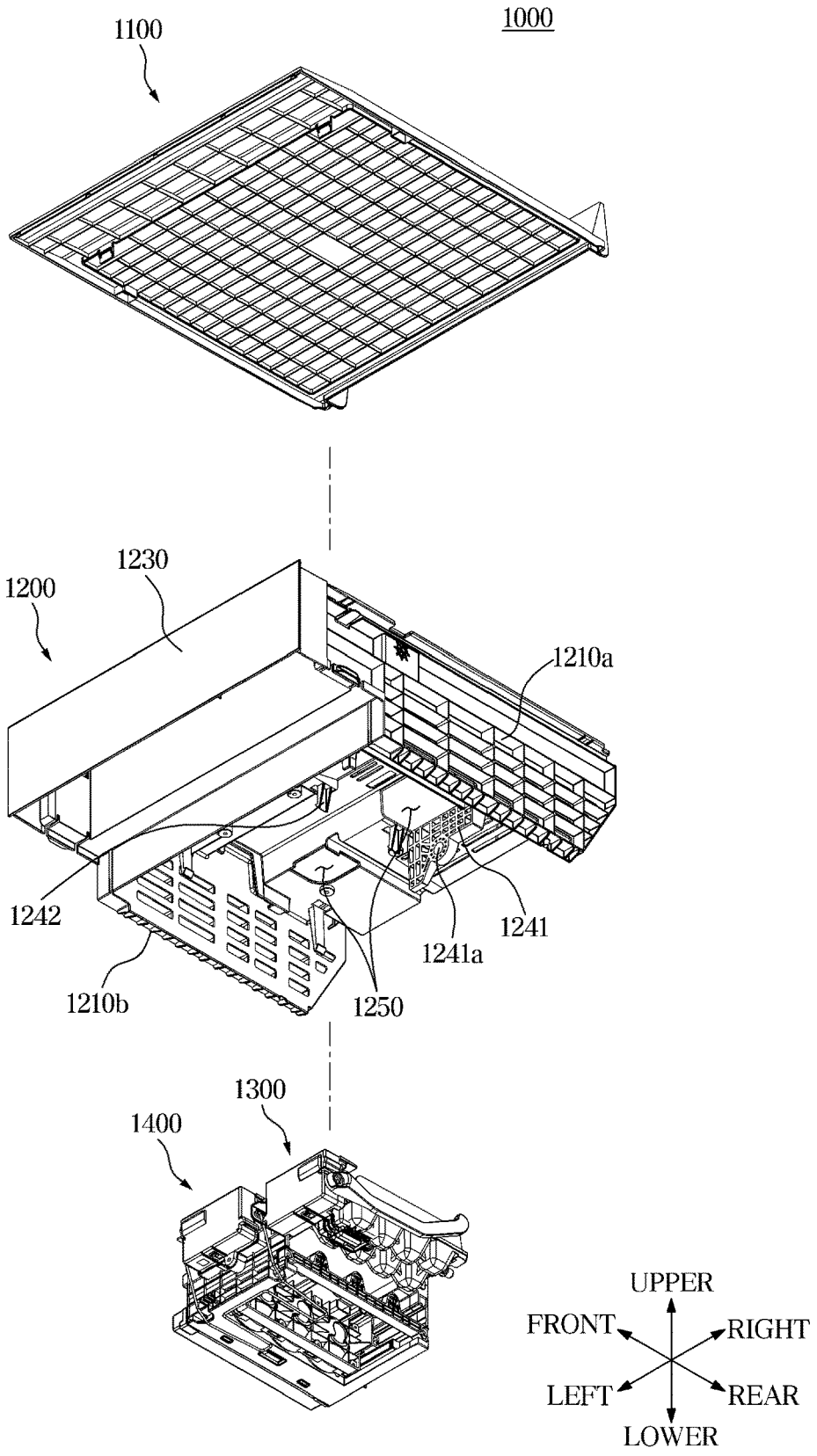
FIG. 8 is an exploded view of the ice making device of the refrigerator shown in FIG. 7 when viewed at a different angle.

FIG. 5 is a cross-sectional view illustrating the refrigerator 1 shown in FIG. 1. FIG. 6 is an exploded view illustrating the ice making device 1000 and related parts thereof separated from the body 10 of the refrigerator 1 shown in FIG. 5. FIG. 7 is an exploded view illustrating the ice making device 1000 of the refrigerator 1 shown in FIG. 6. FIG. 8 is an exploded view of the ice making device 1000 of the refrigerator 1 shown in FIG. 7 when viewed at a different angle.

Referring to FIGS. 5 to 8, the ice making device 1000 according to an embodiment of the disclosure and related parts thereof are described.

The ice making device 1000 of the refrigerator 1 may be provided in the storage compartment 20. The ice making device 1000 may be mounted in the inner case 11.

The ice making device 1000 may be supported by the first inner wall 11*a* and the second inner wall 11*b* of the inner case 11. The ice making device 1000 may be disposed between the first inner wall 11*a* and the second inner wall 11*b*.

The first inner wall 11*a* may be the inner wall of the inner case 11 that is provided at the right side when the refrigerator 1 is viewed from the front, and the second inner wall 11*b* may be the inner wall of the inner case 11 that opposes the first inner wall 11*a* and is provided at the left side when the refrigerator 1 is viewed from the front. That is, the ice making device 1000 may be mounted in the inner case 11 to be supported by each of the left-side inner wall and the right-side inner wall of the inner case 11. The first inner wall 11*a* and the second inner wall 11*b* that support the ice making device 1000 may be formed to face each other in the left-right direction of the refrigerator 1.

However, the disclosure is not limited thereto, and for example, in a case in which a refrigerator according to one embodiment of the disclosure is a SBS refrigerator in which a refrigerator compartment and a freezer compartment are arranged side by side, a vertical partition configured to isolate the refrigerator compartment and the freezer compartment from each other may be provided between the refrigerator compartment and the freezer compartment. In this case, the first inner wall may be any one of the left-side inner wall and the right-side inner wall of the inner case, and the second inner wall may be a sidewall of the vertical partition that opposes the first inner wall.

Hereinafter, for convenience of description, description will be made in relation to the first inner wall 11*a* and the second inner wall 11*b*.

The ice making device 1000 may include the ice making units 1300 and 1400 configured to form ice and the ice making case 1200 configured to support the ice making units 1300 and 1400.

The ice making case 1200 may be mounted in the inner case 11. The ice making case 1200 may be supported by the inner case 11. The ice making case 1200 may be supported by the inner walls 11*a* and 11*b* of the inner case 11.

Specifically, the ice making case 1200 may include ice making case walls 1210*a* and 1210*b* supported by the inner walls 11*a* and 11*b* of the inner case 11. The ice making case walls 1210*a* and 1210*b* may be outer walls of the ice making case 1200 that face the inner walls 11*a* and 11*b* of the inner case 11.

The ice making case walls 1210*a* and 1210*b* may include a first ice making case wall 1210*a* supported by the first inner wall 11*a* and a second ice making case wall 1210*b* supported by the second inner wall 11*b*. The first ice making case wall 1210*a* may be an outer wall of the ice making case 1200 that faces the first inner wall 11*a*. The first ice making case wall 1210*a* may be a right-side outer wall of the ice making case 1200 that is provided at the right side when viewed from the front. The second ice making case wall 1210*b* may be an outer wall of the ice making case 1200 that faces the second inner wall 11*b*. The second ice making case wall 1210*b* may be a left-side outer wall of the ice making case 1200 that opposes the first ice making case wall 1210*a* and is provided at the left side when viewed from the front.

The first ice making case wall 1210*a* may be disposed to be substantially parallel to the first inner wall 11*a*. The second ice making case wall 1210*b* may be disposed to be substantially parallel to the second inner wall 11*b*.

The first ice making case wall 1210*a* and the second ice making case wall 1210*b* may be formed parallel to each other. The first ice making case wall 1210*a* and the second ice making case wall 1210*b* may be formed to have shapes that substantially correspond to each other.

The inner case 11 may include the holders formed on the inner walls 11*a* and 11*b* of the inner case 11. The ice making case 1200 may be supported by the holders.

The holders may be formed to have various shapes that may support the ice making case walls 1210*a* and 1210*b*.

For example, the holders may be formed to have shapes that protrude from the inner walls 11*a* and 11*b* of the inner case 11. The holders may be formed to protrude to support the ice making case walls 1210*a* and 1210*b*. The holders may be formed to protrude toward the inside of the storage compartment 20. The holders may be inserted into concave portions formed in the ice making case walls 1210*a* and 1210*b* and support the ice making case walls 1210*a* and 1210*b*. Alternatively, the holders may support lower sides of the ice making case walls 1210*a* and 1210*b*.

For example, the holders may be formed to have shapes that are concavely recessed in the inner walls 11*a* and 11*b* of the inner case 11. Unlike in FIGS. 5 to 8, portions (not illustrated) protruding toward the inner walls 11*a* and 11*b* of the inner case 11 may be provided on the ice making case walls 1210*a* and 1210*b*, and as the protruding portions of the ice making case walls 1210*a* and 1210*b* are inserted into the holders, the ice making case walls 1210*a* and 1210*b* may be supported by the holders.

Hereinafter, description will be given based on the embodiment in which the holders are formed to protrude to support the ice making case walls 1210*a* and 1210*b*. However, the concept of the disclosure is not limited thereto, and, for example, as described above, the holders supporting the ice making case walls 1210*a* and 1210*b* may be formed to have shapes that are concavely recessed in the inner walls 11*a* and 11*b* of inner case 11.

The holders may extend in a direction parallel to the forward-backward direction of the inner case 11. The holders may extend in a direction parallel to the forward-backward direction of the inner walls 11*a* and 11*b* of the inner case 11. Accordingly, the ice making case walls 1210*a* and 1210*b* may be stably supported in the up-down direction of the inner case 11 by the holders.

For example, the ice making case 1200 may be mounted by sliding from a front of the inner case 11 toward a rear thereof along the holders extending in the direction parallel to the forward-backward direction of the inner case 11. In other words, the ice making case 1200 may be mounted in the inner case 11 by sliding from the front of the inner case 11 toward the rear thereof. When being mounted in the inner case 11, the ice making case 1200 may be inserted from the front of the inner case 11 toward the rear thereof.

When the ice making case 1200 is being mounted in the inner case 11, a mounting position in the inner case 11, a mounting direction in the inner case 11, and the like may be guided by the holders.

However, the disclosure is not limited thereto, and the ice making case 1200 may be mounted in the inner case 11 in various other ways. For example, the ice making case 1200 may be mounted by sliding in the up-down direction relative to the inner case 11. Even in this case, the holders may still extend in the direction parallel to the forward-backward direction of the inner case 11.

The holders may be provided to support upper portions of the ice making case walls 1210*a* and 1210*b*. For example, the ice making case walls 1210*a* and 1210*b* may be supported by the holders as the upper portions of the ice making case walls 1210*a* and 1210*b* are seated on upper surfaces of the holders. Accordingly, the ice making case 1200 may be stably supported by the holders. However, the disclosure is not limited thereto, and the ice making case walls 1210*a* and 1210*b* may be supported by the holders in various other ways.

The holders may be provided at positions adjacent to the front of the inner case 11. That is, the holders may be disposed more adjacent to the opening 10*a* of the inner case 11 than to the rear wall 11*c* of the inner case 11. Accordingly, the holders may support at least a front portion of the ice making case 1200. Also, since the holders are provided at the positions adjacent to the front of the inner case 11, when the ice making case 1200 is being mounted in the inner case 11 by being inserted from the front of the inner case 11 toward the rear thereof, the ice making case 1200 may be more easily guided by the holders.

However, the disclosure is not limited thereto, and the holders may be provided at various other positions. For example, the holders may be provided at positions adjacent to the rear wall 11*c* of the inner case 11. For example, the holders may be provided at positions almost equally distant from each of the opening 10*a* and the rear wall 11*c* of the inner case 11.

A rear holder 11*e* provided to support a rear of the ice making case 1200 may be further provided in the inner case 11. The ice making case walls 1210*a* and 1210*b* may be supported by the rear holder 11*e* as well as the holders. For example, the rear holder 11*e* may be provided on the inner walls 11*a* and 11*b* of the inner case 11. For example, the rear holder 11*e* may be provided on the rear wall 11*c* of the inner case 11. However, the disclosure is not limited thereto, and the rear holder 11*e* may not be provided in the inner case 11.

The holders may include a first holder provided on the first inner wall 11*a* and configured to support the first ice making case wall 1210*a* and a second holder provided on the second inner wall 11*b* and configured to support the second ice making case wall 1210*b*.

The first holder and the second holder may be provided to oppose each other. The first holder and the second holder may be provided at positions corresponding to each other. The first holder and the second holder may be formed to have shapes that correspond to each other.

The first holder may have a shape that protrudes toward the storage compartment 20. The first holder may have a shape that protrudes from the first inner wall 11*a* toward the first ice making case wall 1210*a*.

The second holder may have a shape that protrudes toward the storage compartment 20. The second holder may have a shape that protrudes from the second inner wall 11*b* toward the second ice making case wall 1210*b*.

When the first holder is disposed more adjacent to the opening 10*a* of the inner case 11 than to the rear wall 11*c* of the inner case 11, the rear holder 11*e* may be disposed behind the first holder 11*aa*. The first holder and the rear holder 11*e* may support the first ice making case wall 1210*a*.

When the second holder is disposed more adjacent to the opening 10*a* of the inner case 11 than to the rear wall 11*c* of the inner case 11, the rear holder 11*e* may be disposed behind the second holder 11*bb*. The second holder and the rear holder 11*e* may support the second ice making case wall 1210*b*.

The rear holder 11*e* may be provided as a plurality of rear holders 11*e* to support each of the first ice making case wall 1210*a* and the second ice making case wall 1210*b*.

However, the disclosure is not limited thereto, and for example, the first holder may extend from the front of the inner case 11 toward the rear thereof in order to be integrally formed with the rear holder 11*e*. The first holder may be formed to provide support between a front portion and a rear portion of the first ice making case wall 1210*a* as a whole. For example, the second holder may extend from the front of the inner case 11 toward the rear thereof in order to be integrally formed with the rear holder 11*e*. The second holder may be formed to provide support between a front portion and a rear portion of the second ice making case wall 1210*b* as a whole.

The ice making case 1200 may be fixed to a rear portion of the inner case 11. The ice making case 1200 may include a rear fixing portion 1260 formed to be fixed to the rear portion of the inner case 11.

For example, the rear fixing portion 1260 may be formed to face the cold air supply duct 14 disposed at a rear of the storage compartment 20. The rear fixing portion 1260 may be, by being fixed to the cold air supply duct 14, fixed to the rear portion of the inner case 11.

For example, the rear fixing portion 1260 may be formed to face the rear wall 11*c* of the inner case 11. The rear fixing portion 1260 may be, by being fixed to the rear wall 11*c* of the inner case 11, fixed to the rear portion of the inner case 11.

For example, the rear fixing portion 1260 may include a screw hole 1261, and a screw (not illustrated) may pass through the screw hole 1261 in the forward-backward direction. The rear fixing portion 1260 may be fixed to the cold air supply duct 14 or the rear wall 11*c* of the inner case 11 by screw coupling.

By the rear fixing portion 1260, the ice making case 1200 may be more firmly mounted in the inner case 11. The configuration of the rear fixing portion 1260 described above is only one example of a configuration allowing the ice making case 1200 to be fixed to the inner case 11, and the ice making case 1200 may include various other configurations to be fixed to the inner case 11.

The ice making case 1200 may form an exterior of the ice making device 1000. The ice making case 1200 may include a front portion 1230 configured to form a front surface of the ice making case 1200, and the front portion 1230 may form the exterior of the front of the ice making device 1000. The front portion 1230 may be formed between the first ice making case wall 1210*a* and the second ice making case wall

1210*b*. The front portion 1230 may connect the first ice making case wall 1210*a* and the second ice making case wall 1210*b*.

The ice making case 1200 may be formed to have a substantially box-like shape. The ice making case 1200 may be formed to have the shape of a box having at least one open surface. For example, the ice making case 1200 may have a shape open in a direction toward the ice bucket 100, that is, downward. For example, the ice making case 1200 may have a shape open rearward. However, the disclosure is not limited thereto, and the ice making case 1200 may be formed to have various other shapes.

The ice making case 1200 may include a water supply through-portion 1250 through which the water supply pipe 210 passes. The water supply pipe 210 may supply water to the ice making units 1300 and 1400.

The water supply through-portion 1250 may be formed at an upper portion of the ice making case 1200, but the position of the water supply through-portion 1250 is not limited thereto.

The water supply through-portion 1250 may be provided in a quantity corresponding to the number of water supply pipes 210, but the disclosure is not limited thereto. For example, a plurality of water supply pipes 210 may pass through a single water supply through-portion 1250.

The ice making device 1000 may include the ice making cover 1100. The ice making cover 1100 may be provided to cover a top of the ice making case 1200. The ice making cover 1100 may be coupled to the upper portion of the ice making case 1200.

For example, the ice making cover 1100 may be detachably mounted on the ice making case 1200. For example, the ice making cover 1100 may be integrally formed with the ice making case 1200.

The ice making cover 1100 may form the exterior of the ice making device 1000. The ice making cover 1100 may form an upper surface of the ice making device 1000.

The ice making cover 1100 may cover at least a portion of the water supply pipe 210. More specifically, the ice making cover 1100 may cover at least a portion of the water supply pipe 210 that is disposed inside the storage compartment 20. The ice making cover 1100 may cover the water supply through-portion 1250.

The ice making cover 1100 may be disposed above the ice making units 1300 and 1400. The ice making cover 1100 may cover a top of the ice making units 1300 and 1400.

The ice making cover 1100 may include a shelf portion 1110 provided to support an article provided thereon and cover the ice making case 1200.

The ice making cover 1100 may include the front inclined portion 1130 configured to extend forward from the shelf portion 1110 and a rear inclined portion 1120 configured to extend rearward from the shelf portion 1110.

The rear inclined portion 1120 may be a portion coming in contact with the cold air supply duct 14 (see FIG. 2). The rear inclined portion 1120 may have a shape inclined upward toward the rear. In this way, while being supported by the cold air supply duct 14, the rear inclined portion 1120 may be provided to cover the water supply device 200 passing through the cold air supply duct 14 and having a shape inclined downward toward the front.

The front inclined portion 1130 may extend forward from the shelf portion 1110. The front inclined portion 1130 may have a shape inclined downward toward the front. The front inclined portion 1130 may be disposed adjacent to the inclined wall 11*f* (see FIG. 1). The ice making units 1300 and 1400 provided in the ice making device 1000 may be provided to form ice of various shapes.

For example, the ice making device 1000 may include the first ice making unit 1300 configured to form a first type of ice. The first ice making unit 1300 may be supported by a first ice making unit support portion 1241 of the ice making case 1200.

For example, the ice making device 1000 may include the second ice making unit 1400 configured to form a second type of ice. The second ice making unit 1400 may be supported by a second ice making unit support portion 1242 of the ice making case 1200.

The first ice making unit support portion 1241 may be provided to support at least an upper portion of the first ice making unit 1300. The second ice making unit support portion 1242 may be provided to support at least an upper portion of the second ice making unit 1400.

The first ice making unit support portion 1241 may be disposed under the ice making cover 1100. A top of the first ice making unit support portion 1241 may be covered by the ice making cover 1100. The second ice making unit support portion 1242 may be disposed under the ice making cover 1100. A top of the second ice making unit support portion 1242 may be covered by the ice making cover 1100.

The first ice making unit support portion 1241 and the second ice making unit support portion 1242 may be disposed between the first ice making case wall 1210*a* and the second ice making case wall 1210*b*. The first ice making unit support portion 1241 and the second ice making unit support portion 1242 may be covered in the left-right direction by the first ice making case wall 1210*a* and the second ice making case wall 1210*b*.

The first ice making unit support portion 1241 and the second ice making unit support portion 1242 may be disposed behind the front portion 1230. The front of the first ice making unit support portion 1241 and the second ice making unit support portion 1242 may be covered by the front portion 1230.

The first ice making unit 1300 and the second ice making unit 1400 may be disposed parallel to each other. Likewise, the first ice making unit support portion 1241 and the second ice making unit support portion 1242 may be disposed parallel to each other.

For example, the first ice making unit 1300 and the second ice making unit 1400 may be disposed parallel to each other in the left-right direction of the refrigerator 1, and the first ice making unit support portion 1241 and the second ice making unit support portion 1242 may be disposed parallel to each other in the left-right direction of the refrigerator 1.

For example, the first ice making unit support portion 1241 may include a hook structure, and the first ice making unit 1300 may be supported by the first ice making unit support portion 1241 by hook coupling. However, the disclosure is not limited thereto, and the first ice making unit support portion 1241 may include various other structures to fix the first ice making unit 1300.

For example, the second ice making unit support portion 1242 may include a hook structure, and the second ice making unit 1400 may be supported by the second ice making unit support portion 1242 by hook coupling. However, the disclosure is not limited thereto, and the second ice making unit support portion 1242 may include various other structures to fix the second ice making unit 1400.

A configuration provided such that the ice making units 1300 and 1400 are supported by the ice making case 1200 is not limited to that described above, and the ice making units 1300 and 1400 may be supported using various other methods.

The first type of ice formed by the first ice making unit 1300 and the second type of ice formed by the second ice making unit 1400 may be types of ice distinguished from each other in terms of the shape, size, and the like of ice.

For example, the first type of ice may be ice having a substantially cubic shape. For example, the second type of ice may be ice having a substantially spherical shape. Alternatively, for example, the first type of ice and the second type of ice may be formed to have similar shapes but different sizes.

However, different from the above description, the ice making device 1000 may be provided to form only one type of ice.

The configurations and operations of the first ice making unit 1300 and the second ice making unit 1400 will be described in detail below.

The ice bucket 100 may be provided in the storage compartment 20. The ice bucket 100 may be mounted in the inner case 11. Specifically, the ice bucket 100 may be supported by the first inner wall 11*a* and the second inner wall 11*b* of the inner case 11.

The ice bucket 100 may be disposed under the ice making device 1000. The ice bucket 100 may be provided to accommodate ice moving downward after being discharged from the ice making units 1300 and 1400.

For example, the ice bucket 100 may include a first accommodating portion 110 configured to accommodate the first type of ice formed by the first ice making unit 1300 and a second accommodating portion 120 configured to accommodate the second type of ice formed by the second ice making unit 1400. The first accommodating portion 110 may be disposed under the first ice making unit 1300. The second accommodating portion 120 may be disposed under the second ice making unit 1400.

The ice bucket 100 may be seated on the bucket shelf 15. The bucket shelf 15 may be supported by a bucket mounting portion 11*d* provided on the inner walls 11*a* and 11*b* of the inner case 11. The bucket mounting portion 11*d* may be formed to extend in the forward-backward direction of the inner case 11.

For example, the ice bucket 100 may be provided to be inserted into or withdrawn from the storage compartment 20. That is, the ice bucket 100 may be mounted to be slidable relative to the inner case 11. For example, the bucket shelf 15 may be provided to be slidable along the bucket mounting portion 11*d*. The bucket shelf 15 may be inserted into or withdrawn from the storage compartment 20 along the bucket mounting portion 11*d*, and the ice bucket 100 seated on the bucket shelf 15 may be inserted into or withdrawn from the storage compartment 20 together with the bucket shelf 15.

Figure 9:
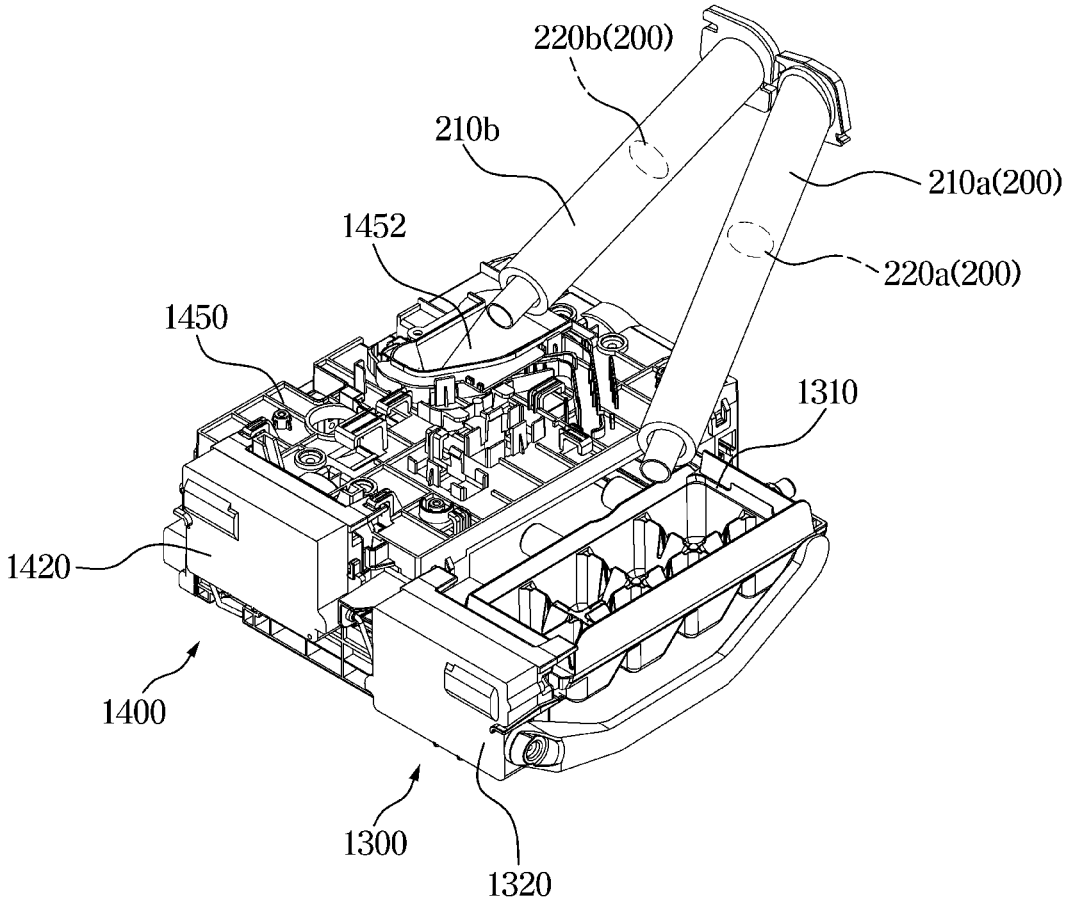
FIG. 9 is a perspective view illustrating the ice making device of the refrigerator shown in FIG. 7 and related parts thereof according to an embodiment of the disclosure.

FIG. 9 is a perspective view illustrating the ice making device 1000 of the refrigerator 1 shown in FIG. 7 and related parts thereof.

A configuration in which water is filled in ice making trays 1310 and 1410 according to an embodiment of the disclosure will be described with reference to FIG. 9.

The refrigerator 1 may include a water supply device 200. The water supply device 200 may be a device that supplies water to the ice making device 1000.

The water supply device 200 may discharge water from an upper side of the ice making device 1000. Water discharged from the water supply device 200 may be moved toward the ice making device 1000 by gravity.

The water supply device 200 may include a water supply pipe 210. The water supply pipe 210 may be configured to define a flow path of the water supply pipe 210 in which water may flow.

The water supply pipe 210 may extend forward from the rear wall (FIG. 2) of the refrigerator 1. While the water supply pipe 210 extends forward, the water supply pipe 20 may be inclined downward. With such a configuration, water located inside the water supply pipe 210 may be moved by gravity while moving forward.

The water supply pipe 210 may be coupled to the rear wall of the refrigerator 1. An end portion of the water supply pipe 210 located on the rear wall side of the refrigerator 1 may communicate with the water dispensing flow path (FIG. 4). Accordingly, the water passed through the filter 2-100 (FIG. 4) may be moved to the water supply pipe 210 and then toward the ice making device 1000.

Water passed through the filter 2-100 may be moved toward the ice making device 1000 by water pressure of a water supply source or may be moved toward the ice making device 1000 through a separate pump (not shown).

The water supply device 200 may include a water supply valve 220. The water supply valve 220 may be configured to open and close the flow path of the water supply pipe 210.

At least a portion of the water supply valve 220 may be located on the flow path of the water supply pipe 210.

The water supply valve 220 may open or close the flow path of the water supply pipe 210 such that water flowing through the water supply pipe 210 is allowed to be discharged to the outside of the water supply pipe 210 or prevented from being discharged to the outside of the water supply pipe 210.

The water supply valve 220 may be opened or closed electronically. The water supply valve 220 may include a solenoid (not shown). The water supply valve 220 may include a closing member (not shown) movable by a solenoid (not shown). However, it is not limited thereto, and the water supply valve 220 may be manually opened or closed.

The water supply valve 220 may include a first water supply valve 220*a* and a second water supply valve 220*b*.

The solenoid may be electrically connected to a control unit 2000 (FIG. 16) to be described below. The control unit 2000 may allow a current to flow through the solenoid or control the direction of a current, thereby controlling whether the closing member closes the flow path of the water supply pipe 210. In other words, the control unit 2000 may control the water supply valve 220.

The water supply pipe 210 may include a first water supply pipe 210*a* and a second water supply pipe 210*b*. The first water supply pipe 210*a* may discharge water toward the first ice-making tray 1310. The second water supply pipe 210*b* may discharge water toward the second ice-making tray 1410.

The first water supply pipe 210*a* may extend toward the first ice making tray 1310. The second water supply pipe 210*b* may extend toward the second ice making tray 1410. With such a configuration, water discharged from the water supply pipe 210 may be prevented from splashing to the outside of the ice making trays 1310 and 1410.

In other words, water discharged from the water supply pipe 210 may move toward the ice making trays 1310 and 1410.

Figure 10:
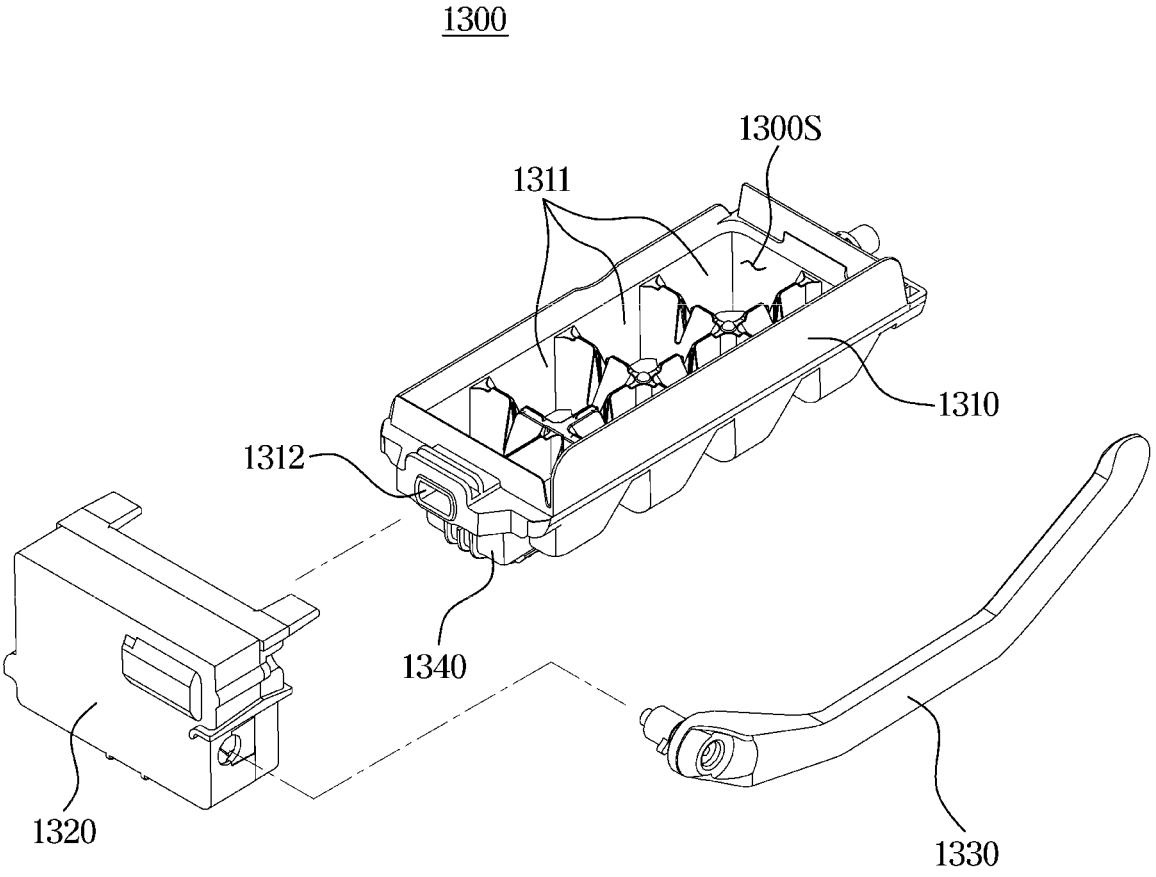
FIG. 10 is an exploded view illustrating a first ice making unit of the refrigerator shown in FIG. 9.
Figure 11:
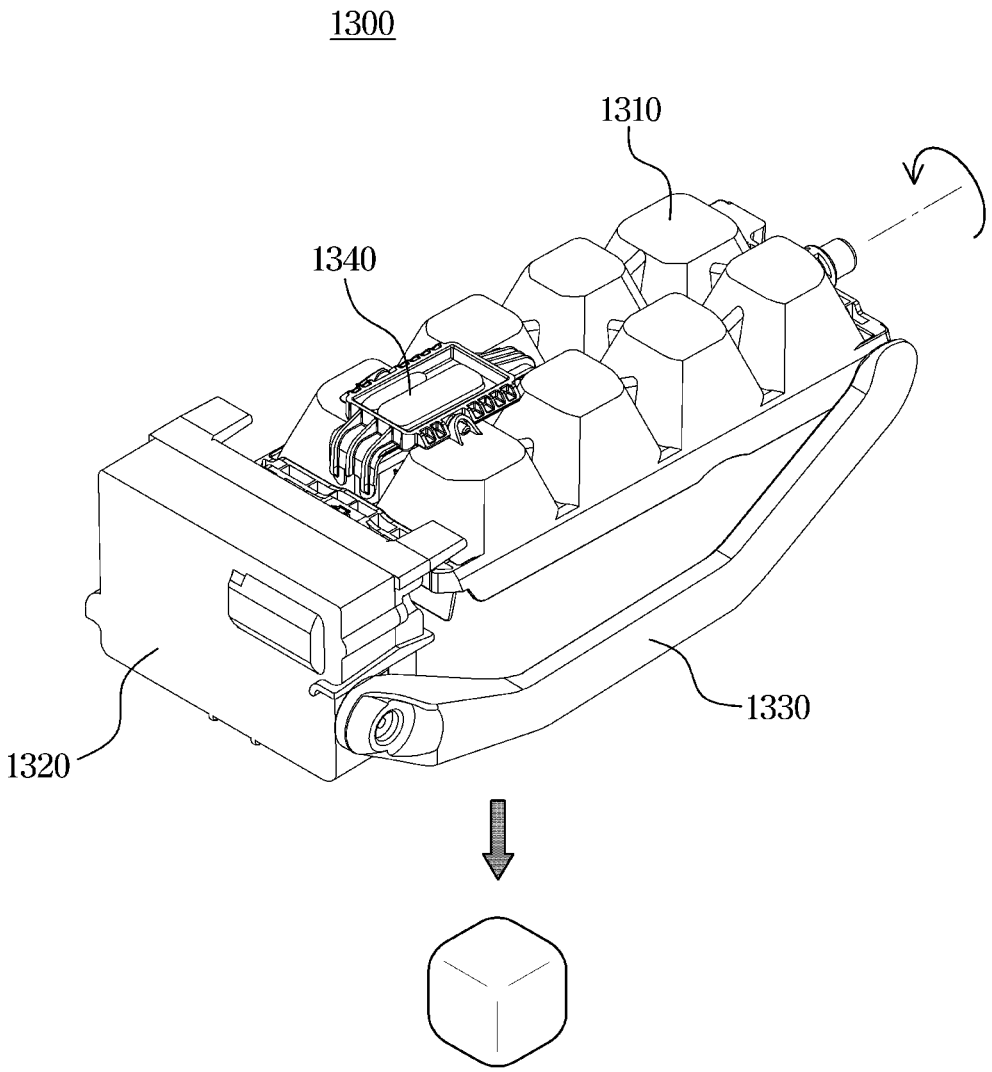
FIG. 11 is a perspective view illustrating a state in which a first ice making tray of the first ice making unit of FIG. 10 is moved.

FIG. 10 is an exploded view illustrating the first ice making unit 1300 of the refrigerator 1 shown in FIG. 9. FIG. 11 is a perspective view illustrating a state in which the first ice making tray 1310 of the first ice making unit 1300 of FIG. 10 is moved.

The first ice making unit 1300 according to an embodiment of the disclosure will be described with reference to FIGS. 10 and 11.

The first ice making unit 1300 may be configured to produce a first type of ice. For example, the first type of ice may be ice having a substantially cube shape.

The first ice making unit 1300 may include a first ice making tray 1310 in which ice is formed. The first ice making tray 1310 may be provided to receive water from the water supply pipe 210. The first ice making tray 1310 may be provided to be supported by the first ice making unit support portion 1241.

The first ice making tray 1310 may include at least one first ice making cell 1311 configured to store water received from the water supply pipe 210. The water stored in the first ice making cell 1311 may be converted into ice by cold air of the storage compartment 20. In a case in which the first ice making cell 1311 is provided as a plurality of first ice making cells 1311 as illustrated in FIG. 7, the plurality of first ice making cells 1311 may be divided from each other by a partition.

The first ice making tray 1310 and the first ice making cell 1311 may have a shape with one side open. While water is being supplied to the first ice making tray 1310 or water is being frozen therein, the one open side of the first ice making tray 1310 and the first ice making cell 1311 may face substantially the top of the refrigerator 1. While the ice formed in the first ice making tray 1310 is moving to the ice bucket 100, the one open side of the first ice making tray 1310 and the first ice making cell 1311 may face substantially the bottom of the refrigerator 1.

The first ice-making cell 1311 may define a first ice-making space 1300S. A second ice-making cell to be described below may define a second ice-making space 1400S.

In other words, the ice making trays 1310 and 1410 may define the ice making spaces 1300S and 1400S. The ice-making spaces 1300S and 1400S may be spaces in which water is accommodated. When water is accommodated in the ice-making spaces 1300S and 1400S and the cold air supply device operates, ice may be formed corresponding to the shapes of the ice-making spaces 1300S and 1400S.

The ice-making spaces 1300S and 1400S may include a first ice-making space 1300S and a second ice-making space 1400S.

The first ice making unit 1300 may include a first driving device 1320 provided such that the ice formed in the first ice making tray 1310 moves to the first accommodating portion 110 of the ice bucket 100. For example, the first driving device 1320 may be provided such that the first ice making tray 1310 rotates about an axis of rotation in the horizontal direction of the refrigerator 1 and the ice in the first ice making tray 1310 moves to the first accommodating portion 110.

The first driving device 1320 may be coupled to the first ice making tray 1310. The first driving device 1320 may be coupled to one side of the first ice making tray 1310 in the direction of the axis of rotation thereof. A first driving coupling portion 1312 may be provided at one side of the first ice making tray 1310 that faces the first driving device 1320. The first driving coupling portion 1312 may be provided on the axis of rotation of the first ice making tray 1310. The first driving device 1320 may be coupled to the first driving coupling portion 1312.

The first driving device 1320 may include a motor (not illustrated), a power transmission member (not illustrated), and the like. The motor of the first driving device 1320 may generate power, and the power transmission member may receive power from the motor and transmit the power to the first ice making tray 1310. The power transmission member of the first driving device 1320 may be connected to the first driving coupling portion 1312. The power transmission member of the first driving device 1320 may include at least one gear (not illustrated), for example.

The first ice making tray 1310 may be connected to a rotation axis support portion 1241*a* provided at the first ice making unit support portion 1241. The rotation axis support portion 1241*a* may be provided on the axis of rotation of the first ice making tray 1310. The rotation axis support portion 1241*a* may be disposed at a position opposite to the first driving coupling portion 1312 with respect to the first ice making tray 1310. The rotation axis support portion 1241*a* may rotatably support the first ice making tray 1310.

By the above configuration, the first ice making tray 1310 may receive power from the first driving portion 1320 and may rotate about the axis of rotation in the horizontal direction of the refrigerator 1. According to rotation of the first ice making tray 1310, ice formed in the first ice making tray 1310 may be discharged from the first ice making cell 1311 and move to the first accommodating portion 110 of the ice bucket 100.

The first ice making unit 1300 may include an ice-full detection lever 1330. The ice-full detection lever 1330 may be provided to detect whether ice is full in the first accommodating portion 110 of the ice bucket 100 that is disposed under the ice making device 1000.

The ice-full detection lever 1330 may be coupled to the first driving portion 1320. Specifically, the ice-full detection lever 1330 may be coupled to a side portion of the first driving portion 1320. The ice-full detection lever 1330 may be coupled to be rotatable relative to the first driving portion 1320.

When it is determined by the ice-full detection lever 1330 that ice is full in the first accommodating portion 110, the control unit (not illustrated) controls to prevent any further water supply to the ice making device 1000. In this way, it is possible to prevent more than necessary ice from being collected in the ice bucket 100.

The first ice making unit 1300 may further include a sensor module 1340. The sensor module 1340 may include a sensor, a case configured to accommodate the sensor, an insulator, and the like. The sensor module 1340 may be mounted under the first ice making tray 1310. The sensor of the sensor module 1340 may be a temperature sensor provided to detect temperature of the first ice making tray 1310.

When it is detected by the sensor module 1340 that the temperature of the first ice making tray 1310 is a predetermined temperature or lower, the control unit (not shown) may determine that ice formation is completed in the first ice making tray 1310. Based on the determination that ice formation is completed in the first ice making tray 1310, the control unit (not shown) may control driving of the first driving portion 1320 such that the first ice making tray 1310 rotates. In this way, ice formed in the first ice making tray 1310 may be collected in the first accommodating portion 110 of the ice bucket 100 that is disposed under the first ice making tray 1310.

The first ice-making cell 1311 of the first ice-making tray 1310 may define a first ice-making space 1300S provided to accommodate water or ice therein.

The first ice making tray 1310 may rotate with reference to an axis passing through the first driving coupling portion 1312. The first ice making tray 1310 may have a first state in which water discharged from the water supply device 200 may be accommodated. The first ice making tray 1310 may have a second state in which ice frozen from water discharged by the water supply device 200 may be discharged.

The first ice-making tray 1310 in the first state may be in a position rotated 90 degrees with respect to the first ice-making tray 1310 in the second state. However, it is not limited thereto, and the first ice-making tray 1310 in the second state may form a predetermined angle with the first ice-making tray 1310 in the first state. Furthermore, the first ice-making tray 1310 in the second state may be in a position twisted relative to the first ice-making tray 1310 in the first state. In response to the first ice-making tray 1310 switching from the first state to the second state, an end portion adjacent to the first driving coupling portion 1312 of the first ice-making tray 1310 may rotate at an angle different from an angle rotated by an end portion distant from the first driving coupling portion 1312 of the first ice-making tray 1310.

As will be described below in related drawings, the first ice making tray 1310 in the second state is positioned such that ice is easily moved to the ice bucket 100, and thus even when water is discharged from the water supply device 200 (FIG. 9), the water may not flow into the first ice making tray 1310 or may easily flow out of the first ice making tray 1310.

Figure 12:
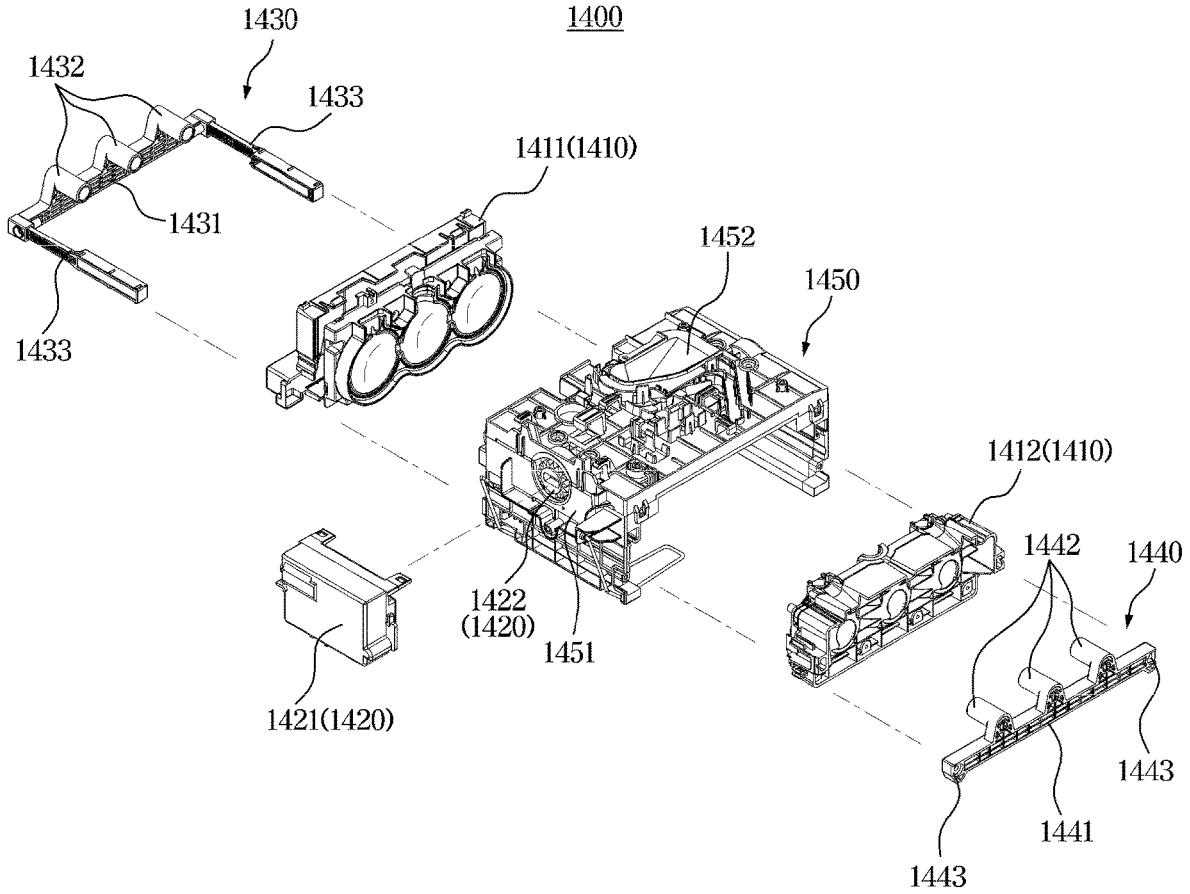
FIG. 12 is an exploded view illustrating a second ice making unit of the refrigerator shown in FIG. 9.
Figure 13:
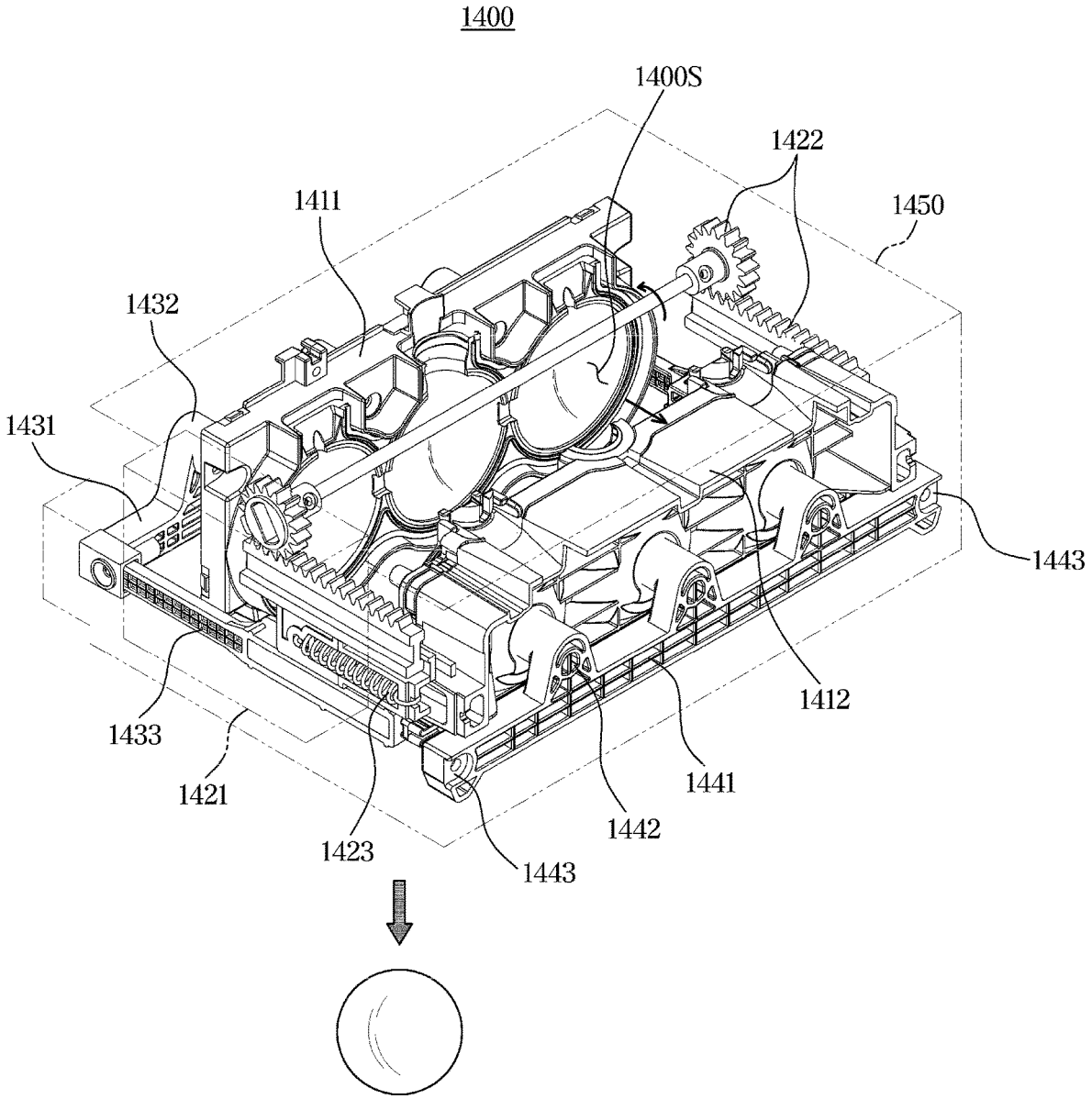
FIG. 13 is a perspective view illustrating a state in which the second ice making unit shown in FIG. 12 makes ice.

FIG. 12 is an exploded view illustrating the second ice making unit 1400 of the refrigerator 1 shown in FIG. 9. FIG. 13 is a perspective view illustrating a state in which the second ice making unit 1400 shown in FIG. 12 forms ice.

Referring to FIGS. 12 and 13, the second ice making unit 1400 according to an embodiment of the disclosure will be described.

The second ice making unit 1400 may be configured to produce a second type of ice having an approximately spherical shape.

The second ice making unit 1400 may include a second ice making tray 1410 in which ice is formed.

The second ice making tray 1410 may include at least one second ice making cell configured to store water received from the water supply pipe 210 (see FIG. 2). The water stored in the second ice making cell may be converted into ice by cold air of the storage compartment 20. The second ice making cell may be provided inside the second ice making tray 1410. The second ice making cell may be configured to include an elastic material. The second ice making cell may be provided to be elastically deformable.

The second ice-making cell may define a second ice-making space 1400S. In the second ice-making space 1400S, water may be accommodated and ice may be formed.

The second ice making unit 1400 may include a cover frame 1450 configured to cover an outer side of the second ice making tray 1410. The cover frame 1450 may be supported by the second ice making unit support portion 1242. The second ice making tray 1410 may be supported by the cover frame 1450.

The cover frame 1450 may include a water collector 1452 configured to receive water from the water supply pipe 210. The water collector 1452 may be provided to collect water supplied from the water supply pipe 210 and supply the water to the second ice making tray 1410.

The second ice making tray 1410 may be provided to simultaneously form a plurality of pieces of the second type of ice. A plurality of second ice making cells may be provided inside the second ice making tray 1410. For example, the water collector 1452 may be provided as a plurality of water collectors 1452 to correspond to the number of the plurality of second ice making cells and may supply collected water to each of the plurality of second ice making cells. For example, the water collector 1452 may supply the collected water to only some of the plurality of second ice making cells, and the plurality of second ice making cells may be formed to communicate with each other such that the collected water may be supplied into all of the second ice making cells.

The second ice making tray 1410 may include a fixed tray 1411 and a movable tray 1412. The fixed tray 1411 and the movable tray 1412 may be supported by the cover frame 1450.

The fixed tray 1411 may maintain a fixed position relative to the cover frame 1450. The movable tray 1412 may be provided to be movable relative to the cover frame 1450. More specifically, the movable tray 1412 may be provided to be movable between the fixed tray 1411 and a second ejector 1440.

One portion of a second ice making cell that correspond to substantially a half of the second ice making cell may be provided inside the fixed tray 1411. The other portion of the second ice making cell that correspond to substantially the other half of the second ice making cell may be provided inside the movable tray 1412. The one portion of the second ice making cell inside the fixed tray 1411 and the other portion of the second ice making cell inside the movable tray 1412 may each be formed to include a substantially semi-spherical shape.

The second ice making unit 1400 may include a second driving device 1420 configured to provide power such that the movable tray 1412 is movable relative to the cover frame 1450 and ejectors 1430 and 1440 configured to discharge ice formed in the second ice making tray 1410 from the second ice making tray 1410.

The second driving device 1420 may include a motor (not illustrated) configured to generate power, a motor case 1421 configured to accommodate the motor, and a power transmission member 1422 configured to transmit the power generated by the motor. For example, the motor of the second driving device 1420 may generate power for rotation about the axis of rotation in the horizontal direction of the refrigerator 1.

The motor case 1421 may be coupled to the cover frame 1450. The motor case 1421 may be coupled to a second driving coupling portion 1451 provided at the cover frame 1450. A hole passing through the cover frame 1450 may be formed in the second driving coupling portion 1451, and the hole of the second driving coupling portion 1451 may be disposed in a rotating shaft connected to the motor of the second driving device 1420.

The power transmission member 1422 may be connected to the motor of the second driving device 1420 and receive power generated by the motor. The power transmission member 1422 may transmit the power received from the motor to the movable tray 1412. For example, the power transmission member 1422 may include at least one gear.

The power transmission member 1422 may be provided to covert rotary motion by the motor of the second driving device 1420 into linear motion and transmit the linear motion to the movable tray 1412. For example, the power transmission member 1422 may include a pinion gear and a rack gear. The pinion gear of the power transmission member 1422 may be connected to the rotating shaft of the motor of the second driving device 1420. The pinion gear of the power transmission member 1422 may be engaged with the rack gear, and the rotary motion of the pinion gear may be converted into linear motion of the rack gear.

The rack gear of the power transmission member 1422 may be coupled to the movable tray 1412. The movable tray 1412 may be provided to move linearly relative to the cover frame 1450 due to the linear motion of the rack gear.

The power transmission member 1422 may further include an elastic member 1423. The elastic member 1423 may couple the rack gear of the power transmission member 1422 to the movable tray 1412. For example, the elastic member 1423 may be an elastic spring.

The ejectors 1430 and 1440 of the second ice making unit 1400 may include a first ejector 1430 and the second ejector 1440. The first ejector 1430 may be provided at a position adjacent to the fixed tray 1411. The second ejector 1440 may be provided at a position adjacent to the movable tray 1412. The second ice making tray 1410 may be disposed between the first ejector 1430 and the second ejector 1440.

The first ejector 1430 may be provided to be movable relative to the cover frame 1450. The first ejector 1430 may be provided to be movable based on the movement of the movable tray 1412.

The first ejector 1430 may include a first body 1431, a first pressing portion 1432, and a leg portion 1433.

The first body 1431 may be formed to extend in a direction parallel to the movable tray 1412. That is, the first body 1431 may extend in a direction perpendicular to a direction in which the first ejector 1430 moves.

The first pressing portion 1432 may be provided to extend from the first body 1431. The first body 1431 may be provided to support the first pressing portion 1432. The first pressing portion 1432 may be provided to pass through the fixed tray 1411 and press the second ice making cell inside the fixed tray 1411.

The leg portion 1433 may extend from both ends of the first body 1431 and be inserted into a side portion of the cover frame 1450. The leg portion 1433 may extend in a direction parallel to the direction in which the first ejector 1430 moves. The leg portion 1433 may be provided as a pair of leg portions 1433 symmetrical to each other.

When the movable tray 1412 moves in a direction moving away from the fixed tray 1411, the first ejector 1430 may move in the direction in which the movable tray 1412 moves. That is, since the fixed tray 1411 is disposed between the first ejector 1430 and the movable tray 1412, the first ejector 1430 may move in a direction approaching the fixed tray 1411.

Also, when the movable tray 1412 moves in a direction approaching the fixed tray 1411, the first ejector 1430 may also move in the direction in which the movable tray 1412 moves. That is, since the fixed tray 1411 is disposed between the first ejector 1430 and the movable tray 1412, the first ejector 1430 may move in a direction moving away from the fixed tray 1411.

For example, the movable tray 1412 may include an interference portion (not illustrated) provided to interfere with the leg portion 1433 of the first ejector 1430, and according to movement of the movable tray 1412, the interference portion of the movable tray 1412 and the leg portion 1433 may interfere with each other, and the first ejector 1430 may also move together.

The first pressing portion 1432 of the first ejector 1430 may be provided to, while the first ejector 1430 moves toward the fixed tray 1411, pass through the fixed tray 1411 and press the second ice making cell inside the fixed tray 1411.

The second ejector 1440 may be fixed to one side of the cover frame 1450.

The second ejector 1440 may include a second body 1441, a second pressing portion 1442, and a frame coupling portion 1443. The second body 1441 may extend in the direction parallel to the movable tray 1412. The second pressing portion 1442 may extend from the second body 1441 toward the movable tray 1412. The frame coupling portion 1443 may be formed at both ends of the second body 1441 and coupled to the cover frame 1450.

The second ejector 1440 may maintain in a fixed position relative to the cover frame 1450 and be provided to, while the movable tray 1412 moves toward the second ejector 1440, press the movable tray 1412. More specifically, the second ejector 1440 may be provided to, while the movable tray 1412 moves toward the second ejector 1440, press the second ice making cell inside the movable tray 1412.

While the second ice making tray 1410 forms ice using water received from the water supply pipe 210, the fixed tray 1411 and the movable tray 1412 may be positioned to be coupled to each other. At the position at which the fixed tray 1411 and the movable tray 1412 are coupled, the one portion of the second ice making cell inside the fixed tray 1411 and the other portion of the second ice making cell inside the movable tray 1412 may be coupled and constitute a single second ice making cell, and the second type of ice may be formed inside the second ice making cell.

After the formation of the second type of ice is completed, the control unit 2000 (see FIG. 16) may control driving of the second driving device 1420 such that the movable tray 1412 moves toward the second ejector 1440. When power is generated by the motor of the second driving device 1420, the generated power may be transmitted to the movable tray 1412 through the power transmission member 1422. The movable tray 1412 may be separated from the fixed tray 1411 and linearly move toward the second ejector 1440.

The second pressing portion 1442 of the second ejector 1440 may be provided to, when the movable tray 1412 approaches, pass through the movable tray 1412 and press the portion of the second ice making cell inside the movable tray 1412. The portion of the second ice making cell inside the movable tray 1412 may be elastically deformed when pressed by the second pressing portion 1442, and the second type of ice placed therein may be discharged from the movable tray 1412. The second type of ice discharged from the movable tray 1412 may move to the second accommodating portion 120 of the ice bucket 100.

When the movable tray 1412 moves further in the same direction in the state in which the portion of the second ice making cell inside the movable tray 1412 is pressed by the second pressing portion 1442, as the interference portion (not illustrated) of the movable tray 1412 and the leg portion 1433 interfere with each other, the first ejector 1430 may move toward the fixed tray 1411. Accordingly, the first pressing portion 1432 of the first ejector 1430 may be provided to pass through the fixed tray 1411 and press the other portion of the second ice making cell inside the fixed tray 1411. The other portion of the second ice making cell inside the fixed tray 1411 may be elastically deformed when pressed by the second pressing portion 1442, and the second type of ice placed therein may be discharged from the fixed tray 1411. The second type of ice discharged from the fixed tray 1411 may move to the second accommodating portion 120 of the ice bucket 100.

By the above configuration, ice formed in the second ice making tray 1410 may be discharged from the second ice making tray 1410 and move to the second accommodating portion 120 of the ice bucket 100.

As an example of an ice making device of a refrigerator according to a concept of the disclosure, a structure of an indirect-cooling type ice making device that guides cold air generated from the storage compartment 20 to a side of an ice making device 1000 to cool water supplied to the first and second ice making trays 1310 and 1410 has been described, but the concept of the disclosure is not limited thereto. For example, the concept of the disclosure may also be applicable to a direct-cooling type ice making device that directly supplies cold air by disposing a separate refrigerant pipe (not shown) in the first and second ice making trays 1310 and 1410 to cool water supplied to the first and second ice making trays 1310 and 1410.

Figure 14:
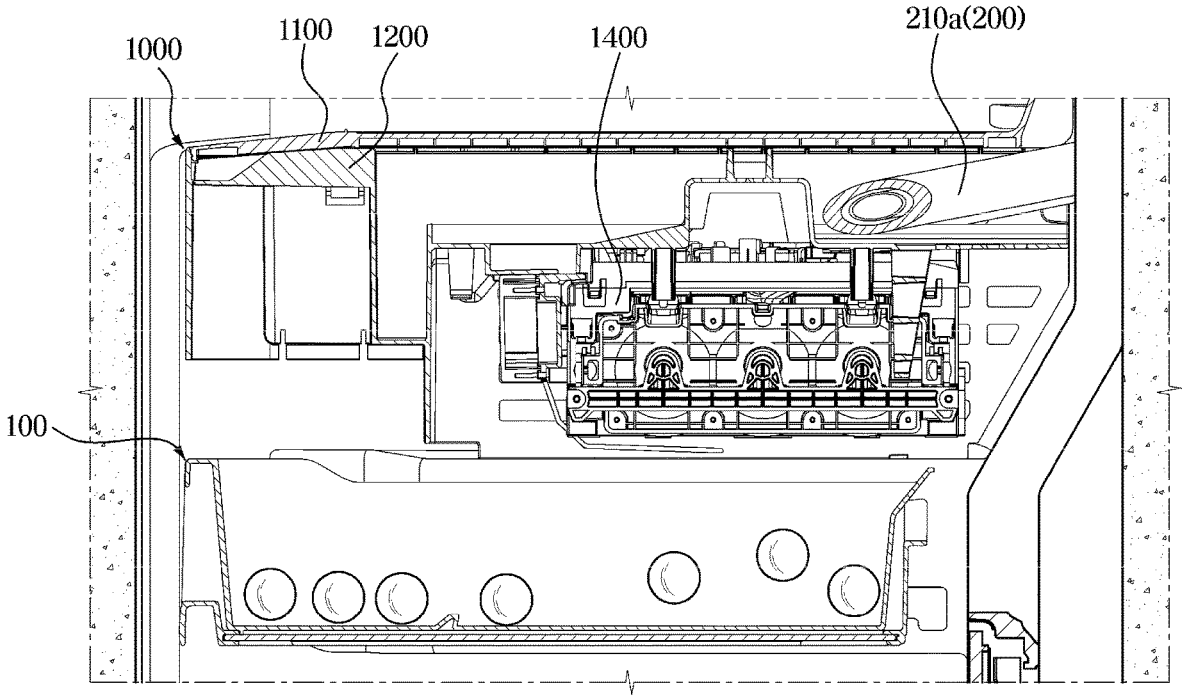
FIG. 14 is a cross-sectional view illustrating the ice making device shown in FIG. 2 and related parts thereof according to an embodiment of the disclosure.

FIG. 14 is a cross-sectional view illustrating the ice making device 1000 shown in FIG. 2 and related parts thereof.

Referring to FIG. 14, a positional relationship of the ice making device 1000 according to an embodiment of the disclosure will be described.

The ice making units 1300 and 1400 may be located inside the ice making case 1200. An upper portion of the ice-making case 1200 may be covered by the ice-making cover 1100 positioned on the upper side of the ice-making case 1200.

The water supply pipe 210 may be positioned between the ice making cover 1100 and the ice making case 1200. The water supply pipe 210 may guide discharge of water into the ice making units 1300 and 1400 through the water supply through-portion 1250 defined in the ice making cover 1100. More specifically, the water supply pipe 210 may guide water to the ice-making spaces 1300S and 1400S located inside the ice-making trays 1310 and 1410.

When the cold air supply device (see FIG. 2) of the refrigerator 1 (see FIG. 2) is driven, cold air may be supplied to the storage compartment 20. Water stored inside the ice making trays 1310 and 1410 may be converted into ice due to the cold air.

When the ice making trays 1310 and 1410 are switched to the second state, ice may be fallen toward the inside of the ice bucket 100 positioned below the ice making units 1300 and 1400. At least one piece of ice may be accommodated inside the ice bucket 100.

A user may retrieve ice by separating the ice bucket 100 from the body 10.

However, as described above, when the filter 2-100 (see FIG. 3) is replaced, ice containing foreign substances generated in the filter 2-100 may be produced. The foreign substances may be, for example, carbon dust.

Since the filter 2-100 may use the carbon filter 2-100, when the filter 2-100 is replaced, carbon powder may be fallen inside the filter 2-100. While water is passing through the filter 2-100, the carbon powder in the filter 2-100 may be mixed with the water and discharged toward the ice making units 1300 and 1400. In this case, the water positioned inside the ice making trays 1310 and 1410 may be water mixed with carbon powder. Users may desire ice formed of only water. Therefore, in order to make ice having no carbon powder, there is a need to discharge carbon powder to the outside.

Carbon powder in the filter 2-100 may be discharged to the outside of the filter 2-100 by discharging a predetermined amount of water. Since carbon powder of the filter 2-100 is present only in the initial stage after the filter 2-100 is replaced, water may be allowed to flow only until the carbon powder is discharged.

However, as illustrated in the embodiment of the disclosure, the refrigerator 1 having no dispenser (not shown) may not include a separate discharge flow path for discharging water mixed with carbon powder to the outside.

Accordingly, in this case, water mixed with carbon powder discharged through the water supply pipe 210 may be accommodated in the ice making trays 1310 and 1410 and converted into ice, and the ice may be stored in the ice bucket 100. However, such a process may take a long time due to the time of making ice.

In order to resolve the issue, a method of discharging foreign substances by directly discharging water without making ice may be used as will be described with reference to the following drawings.

Figure 15:
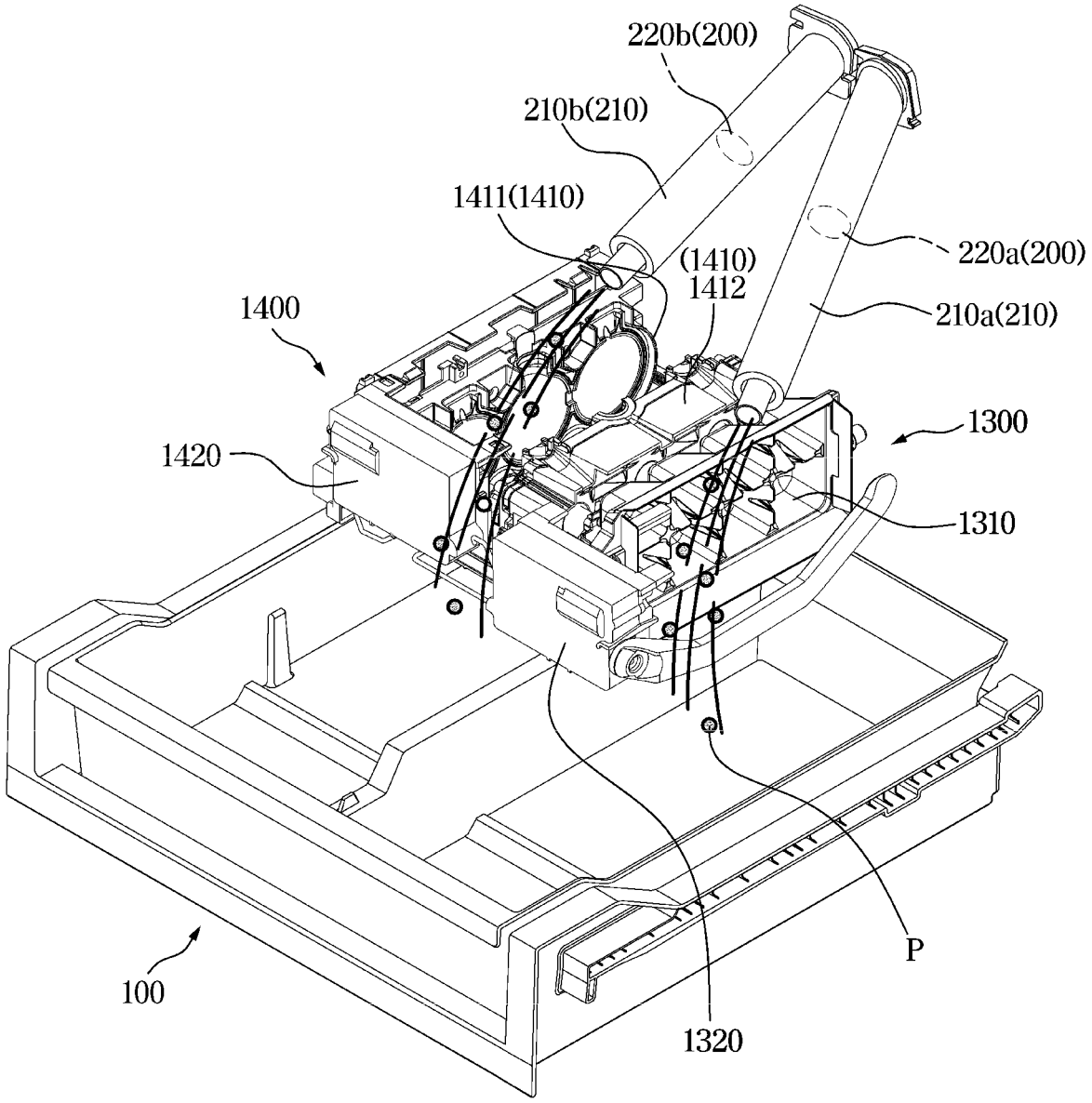
FIG. 15 is a perspective view illustrating a state in which water is supplied from the water supply device shown in FIG. 14 toward the ice making device.

FIG. 15 is a perspective view illustrating a state in which water is supplied from the water supply device 200 shown in FIG. 14 toward the ice making device 1000.

Referring to FIG. 15, a process of discharging foreign substances included in water discharged through the water supply device 200 according to an embodiment of the disclosure will be described.

As described above, the refrigerator 1 (FIG. 1) may be connected to the filter device 2-1 (FIG. 1). Therefore, foreign substances generated in the filter device 2-1 may flow into the refrigerator 1.

Since the filter device 2-1 may communicate with the water supply device 200, foreign substances generated in the filter device 2-1 may move into the water supply device 200. The foreign substances generated in the filter device 2-1 may move through the water supply pipe 210. When the water supply pipe 210 is opened by the water supply valve 220, foreign substances generated in the filter device 2-1 may be discharged to the outside of the water supply pipe 210. When water is discharged from the water supply pipe 210 together with foreign substances discharged from the filter device 2-1, the foreign substances may be accommodated in the ice making trays 1310 and 1410.

In this case, the ice making trays 1310 and 1410 may be in the second state. As described above, the ice making trays 1310 and 1410 may be switched between the first state in which water may be accommodated and the second state in which ice may be discharged.

When the first ice-making tray 1310 is in the second state, the first ice-making tray 1310 may be rotatable on a rotation axis. The ice-making space 1300S of the first ice-making tray 1310 may face leftward or rightward instead of upward. Alternatively, the ice-making space 1300S of the first ice-making tray 1310 may face downward.

When the first ice making tray 1310 is in the first state, the first water supply pipe 210*a* may be positioned at the upper side of the first ice making tray 1310. The first water supply pipe 210*a* may be positioned at the upper side of the ice-making space 1300S of the first ice-making tray 1310.

When the first ice-making tray 1310 is in the second state, the first water supply pipe 210*a* may be located at the lateral side of the first ice-making tray 1310. Accordingly, water discharged from the first water supply pipe 210*a* may be moved toward the ice bucket 100 along the lateral side of the first ice making tray 1310. Water discharged from the first water supply pipe 210*a* may move toward the ice bucket 100 while being prevented from being accommodated in the ice making space 1300S of the first ice making tray 1310. Accordingly, foreign substances included in the water discharged from the first water supply pipe 210*a* may be prevented from entering the ice-making space 1300S of the first ice-making tray 1310.

When the second ice making tray 1410 is in the second state, the second ice making tray 1410 may be positioned such that the fixed tray 1411 and the movable tray 1412 are separated from each other. The ice-making space 1400S of the second ice-making tray 1410 may not be allowed to accommodate water.

When the second ice making tray 1410 is in the first state, the second water supply pipe 210*b* may be positioned at the upper side of the second ice making tray 1410. The second water supply pipe 210*b* may be positioned at the upper side of the ice-making space 1400S of the second ice-making tray 1410.

When the second ice making tray 1410 is in the second state, the second water supply pipe 210*b* may be positioned between the fixed tray 1411 and the movable tray 1412. The second water supply pipe 210*b* may be located above a space between the fixed tray 1411 and the movable tray 1412.

Accordingly, water discharged from the second water supply pipe 210*b* may be directly headed to the ice bucket 100. Water discharged from the second water supply pipe 210*b* may pass through the space between the fixed tray 1411 and the movable tray 1412 and head toward the ice bucket 100. Water discharged from the second water supply pipe 210*b* may move toward the ice bucket 100 while being prevented from being accommodated in the ice making space 1400S of the second ice making tray 1410. Accordingly, foreign substances included in the water discharged from the second water supply pipe 210*b* may not enter the ice-making space 1400S of the second ice-making tray 1410.

Figure 16:
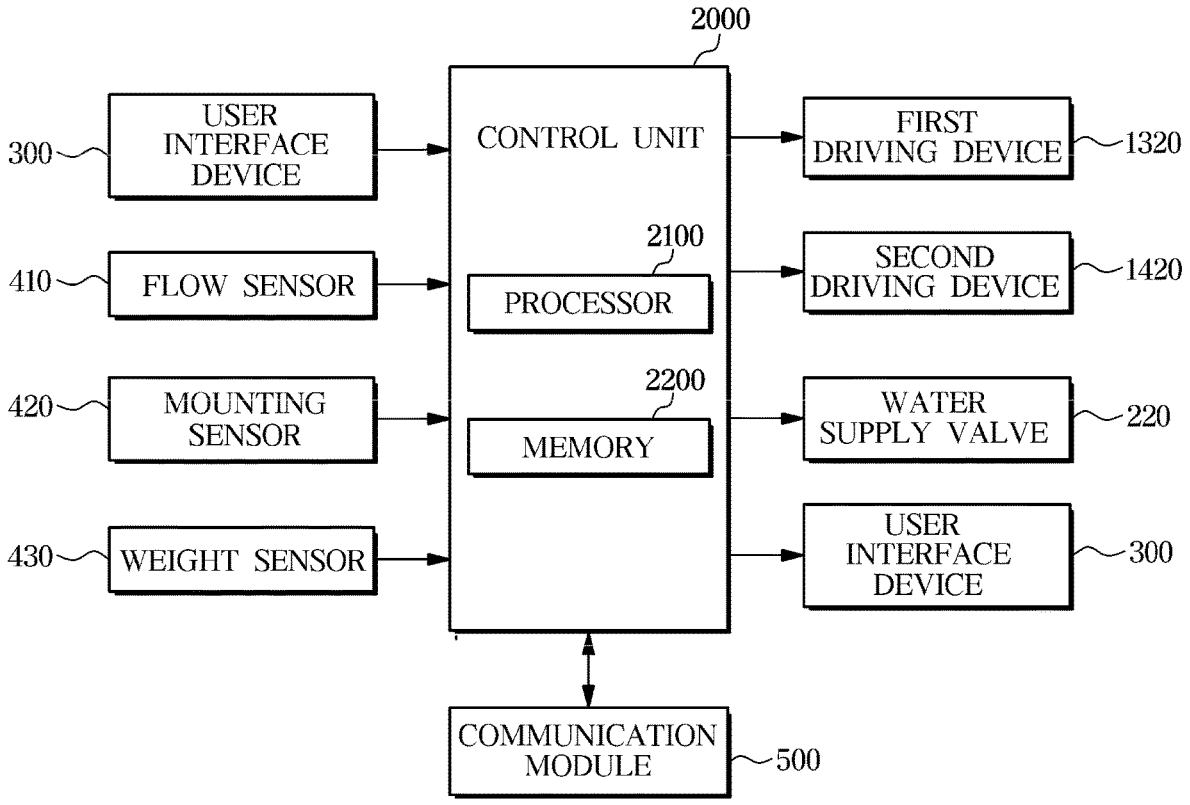
FIG. 16 is a control block diagram of a control unit that controls the ice making device and the water supply device shown in FIG. 2 according to an embodiment of the disclosure.

FIG. 16 is a control block diagram of the control unit 2000 that controls the ice making device 1000 and the water supply device 200 shown in FIG. 2.

Referring to FIG. 16, the control unit 2000 according to an embodiment of the disclosure and related components thereof will be described.

The refrigerator 1 may include the control unit 2000.

The ice making device 1000 may include the control unit 2000.

The control unit 2000 may include a processor 2100 that generates control signals related to the operation of the refrigerator 1.

The processor 2100 may generate a control signal related to the operation of the ice making device 1000. The processor 2100 may generate control signals related to operations of the ice making trays 1310 and 1410 of the ice making device 1000. The ice making device 1000 may generate a control signal to move the ice making trays 1310 and 1410 to the first state or the second state. The control unit 2000 may generate a control signal to move the first ice making tray 1310 to the first state or the second state. The control unit 2000 may generate a control signal to move the second ice making tray 1410 to the first state or the second state. The control unit 2000 may generate a control signal related to the operation of the first driving device 1320 connected to the first ice making tray 1310. The control unit 2000 may generate a control signal related to the operation of the second driving device 1420 connected to the second ice making tray 1410.

The processor 2100 may generate a control signal related to the operation of the water supply valve 220. The water supply valve 220 may open or close the water supply pipe 210 by an electrical signal. In this case, the water supply valve 220 may open or close the water supply pipe 210 according to the control signal generated by the processor 2100.

The processor 2100 and the memory 2200 may be implemented as separate semiconductor devices or as a single semiconductor device. Also, the control unit 2000 may include a plurality of processors 2100 or a plurality of memories 2200. The control unit 2000 may be provided in various positions inside the refrigerator 1. For example, the control unit 2000 may be included in a printed circuit board provided inside a control panel. Alternatively, the control unit 2000 may be included in a printed circuit board provided inside the ice making device 1000.

The processor 2100 may include an arithmetic circuit, a memory circuit, and a control circuit. The processor 2100 may include one chip or a plurality of chips. Also, the processor 2100 may include one core or a plurality of cores.

The memory 2200 may store programs for controlling the ice making device 1000 and the water supply device 200 and data required for controlling the ice making device 1000 and the water supply device 200.

The memory 2200 includes a volatile memory 2200, such as a static random access memory (S-RAM) and a dynamic random access memory (D-RAM), and a non-volatile memory 2200, such as a read only memory (ROM) and an erasable programmable ROM (EPROM). The memory 2200 may include one memory element or may include a plurality of memory elements.

The processor 2100 may process data and/or signals using a program provided from the memory 2200, and transmit a control signal to each component of the refrigerator 1 based on the processing result.

Alternatively, the processor 2100 may process data and/or signals using a program provided from the memory 2200, and transmit a control signal to the ice making device 1000 and the water supply device 200 based on the processing result.

The processor 2100 may transmit a control signal to each component of the refrigerator 1.

For example, the processor 2100 may process information (e.g., whether to perform a water supply operation, or a preliminary water dispensing) obtained from a user interface device 300 e.g., and/or operation information (e.g., operation information of the driving devices 1320 and 1420, information about whether the water supply pipe 210 is opened or closed by the water supply valve 220) of components included in the ice making device 1000 and the water supply device 200.

The ice making device 1000 and the water supply device 200 may be controlled by the control unit 2000.

The refrigerator 1 may include the user interface device 300.

The processor 2100 may receive a user's input signal from the user interface device 300. The user interface device 300 may include an input unit 320 (not shown) to which a user input is entered. A user may enter an input related to a desired function on the user interface device 300 through the input unit 320.

The user interface device 300 may output an input signal corresponding to the user's input based on the user's input. A signal output by the user interface device 300 may be transmitted to the processor 2100.

The refrigerator 1 may include a flow sensor 410.

The processor 2100 may receive a signal corresponding to information about water flowing through the water supply pipe 210 from the flow sensor 410. The flow sensor 410 may be located inside the water supply pipe 210 (FIG. 15). Accordingly, the flow sensor 410 may output a signal corresponding to information about the amount of water flowing per hour or the speed of water flowing in the water supply pipe 210.

The refrigerator 1 may include a mounting sensor 420.

The processor 2100 may receive a signal corresponding to information about whether the ice bucket 100 is mounted on the body 10 from the mounting sensor 420. The mounting sensor 420 may be located on the inside of the body 10 (FIG. 2). For example, the mounting sensor 420 may include a pressure sensor or an illuminance sensor.

The refrigerator 1 may include a weight sensor 430.

The processor 2100 may receive a signal corresponding to information about the weight of the ice bucket 100 and objects accommodated in the ice bucket 100 from the weight sensor 430. The weight sensor 430 may be mounted on the inside of the body 10.

The refrigerator 1 may include a communication module 500.

The communication module 500 may transmit data to an external device or receive data from an external device. For example, the communication module may transmit/receive various types of data by communicating with a server and/or a user terminal device and/or a home appliance.

To this end, the communication module 500 may establish a direct (e.g., wired) communication channel or a wireless communication channel with an external electronic device (e.g., a server, a user terminal device, and/or a home appliance), and support communication implementation through the established communication channel. According to one embodiment, the communication module 500 may include a wireless communication module 500 (e.g., a cellular communication module 500, a short-range wireless communication module 500, or a global navigation satellite system (GNSS) communication module 500, or a wired communication module 500 (e.g., a local area network (LAN) communication module 500 or a power line communication module 500). Among the communication modules 500, the corresponding communication module 500 may communicate with an external electronic device through a first network (e.g., a short-distance communication network, such as Bluetooth, wireless fidelity (WiFi) direct, or infrared data association (IrDA)) or a second network (e.g., a long distance communication network, such as a legacy cellular network, a 5G network, a next-generation communication network, the Internet, or a computer network (e.g., LAN or WAN). Such various types of communication modules 500 may be integrated as one component (e.g., a single chip) or implemented as a plurality of separate components (e.g., multiple chips).

The communication module 500 may include a Wi-Fi module, and perform communication with an external server and/or a user terminal device and/or a home appliance based on communication being established with an access point (AP) in the home.

The communication module 500 may communicate with home appliances in the home to receive outside temperature information and outside air humidity information from the home appliances.

For example, the communication module 500 may establish communication with a terminal device and receive information about a user input.

The first driving device 1320 may be controlled by a control signal generated by the processor 2100.

The second driving device 1420 may be controlled by a control signal generated by the processor 2100.

The driving devices 1320 and 1420 may include a motor (not shown). The first driving device 1320 may include a first motor (not shown).

The first motor may include a stator (not shown) and a rotor (not shown) coupled to the first ice making tray 1310.

The motor may include a brushless direct current (BLDC) motor or a permanent synchronous motor (PMSM) motor of which the rotation speed may be easily controlled.

The driving devices 1320 and 1420 may include a drive (not shown). The drive may receive a control signal for operating the motor from the processor 2100. The drive may supply a driving current for rotating a rotation shaft of the motor to the motor based on a control signal of the processor 2100. The motor may include a first motor and a second motor. For example, the drive may receive a control signal including a speed command of the motor, and supply a driving current to the motor such that the rotation speed of the motor follows the speed command.

The drive may provide the processor 2100 with a driving current value supplied to the motor and a rotational speed of the motor.

For example, when the motor is a BLDC motor, the drive may supply a pulse width modulated direct current to the motor. In addition, when the motor is a PMSM motor, the drive may supply an AC current to the motor using vector control.

The refrigerator 1 may include the user interface device 300.

The user interface device 300 may include a display unit 310 (not shown). The display unit 310 may include a display (not shown).

The display unit 310 may display information about supply of water according to a control signal generated by the processor 2100. The display unit 310 may display information about a water supply amount. The display unit 310 may display information about a water supply time. The display unit 310 may display information about a user input to the user.

The user interface device 300 may include an input unit 320. The input unit 320 may refer to a part to which a user input is entered. When the user performs an input through the input unit 320, the user interface device 300 may generate a corresponding signal.

Figure 17:
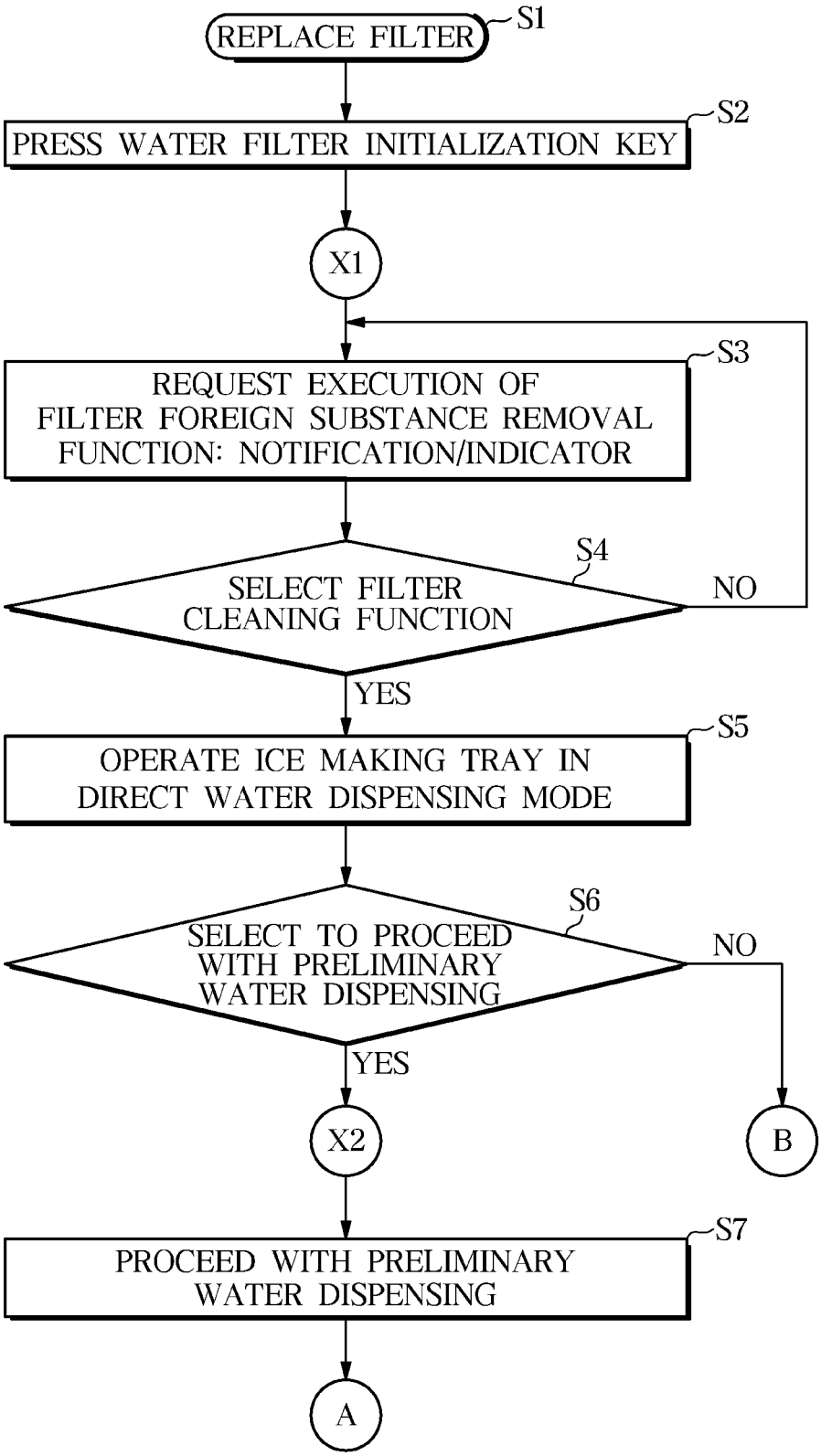
FIG. 17 is a flowchart showing a process in which the control unit shown in FIG. 16 controls the ice making device and the water supply device according to an embodiment of the disclosure.
Figure 18:
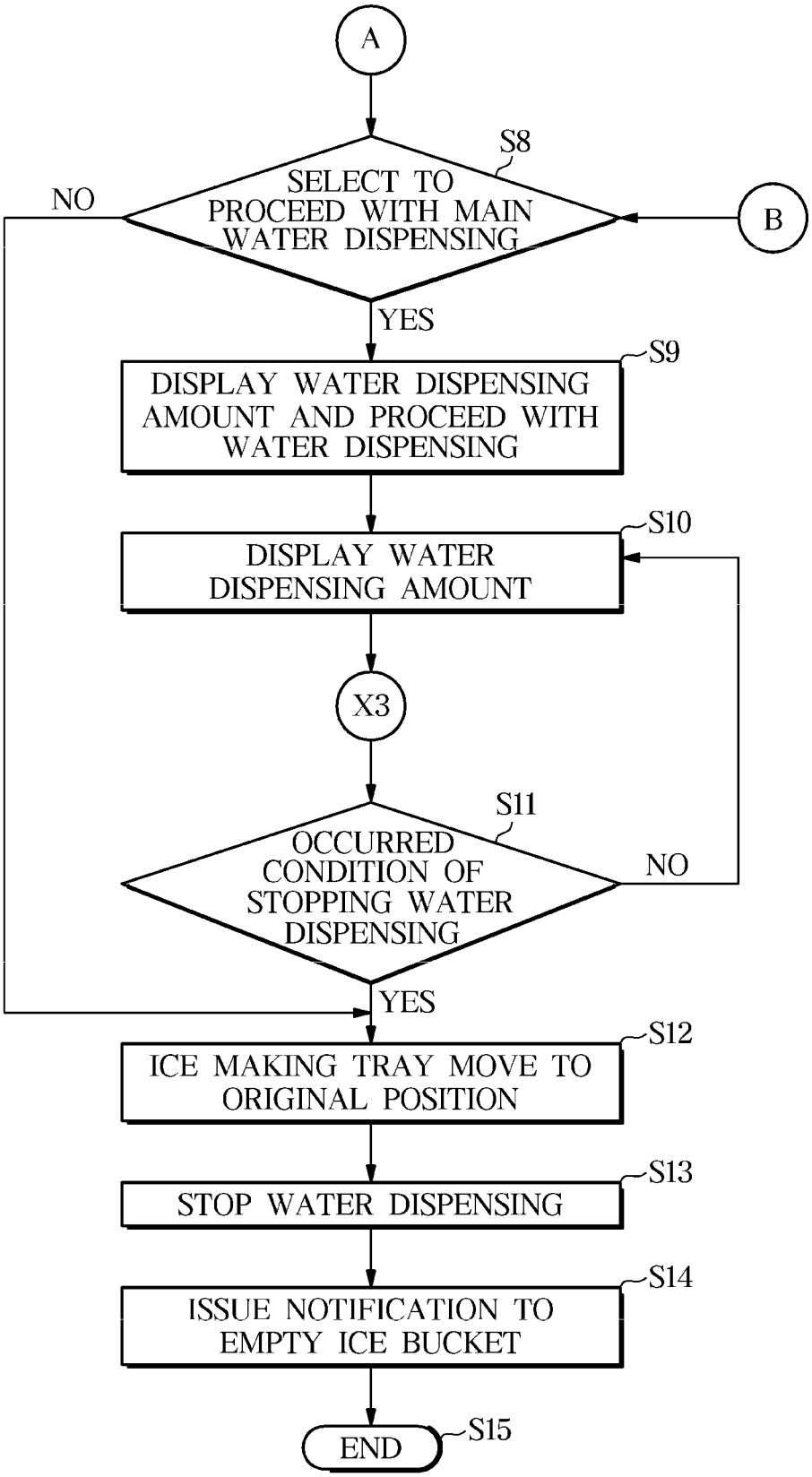
FIG. 18 is a flowchart showing a process in which the control unit shown in FIG. 16 controls the ice making device and the water supply device according to an embodiment of the disclosure.
Figure 19:
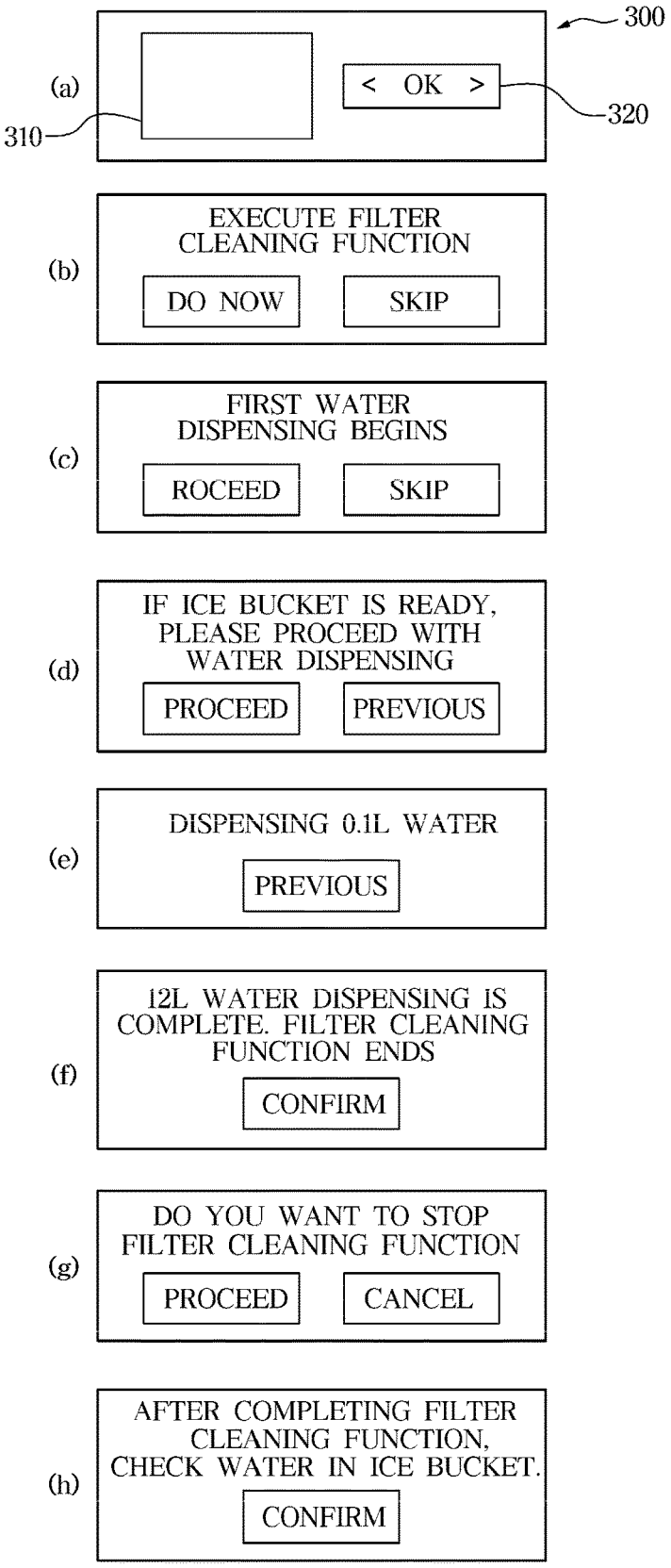
FIG. 19 is a conceptual diagram illustrating a screen displayed on a user interface device shown in FIG. 16 according to an embodiment of the disclosure.
Figure 20:
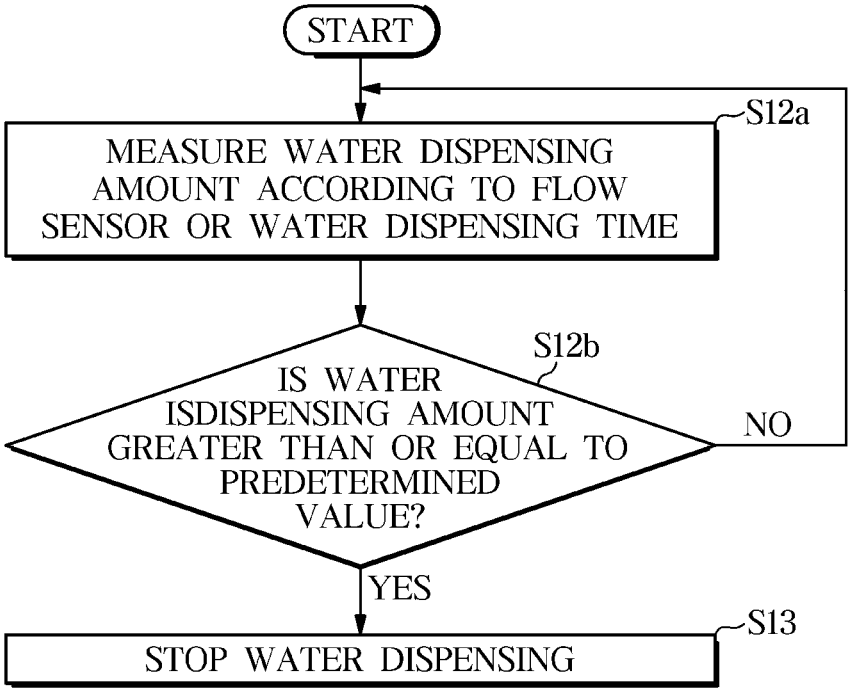
FIG. 20 is a flowchart showing a process in which the control unit shown in FIG. 16 controls the ice making device and the water supply device according to an embodiment of the disclosure.

FIG. 17 is a flowchart showing a process in which the control unit 2000 shown in FIG. 16 controls the ice making device 1000 and the water supply device 200. FIG. 18 is a flowchart showing a process in which the control unit 2000 shown in FIG. 16 controls the ice making device 1000 and the water supply device 200. FIG. 19 is a conceptual diagram illustrating a screen displayed on a user interface device 300 shown in FIG. 16. FIG. 20 is a flowchart showing a process in which the control unit 2000 shown in FIG. 16 controls the ice making device 1000 and the water supply device 200.

Referring to FIGS. 17 to 20, an operation of the control unit 2000 controlling the ice making device 1000 and the water supply device 200 according to an embodiment of the disclosure will be described.

A case in which the filter 2-100 of the filter device 2-1 is replaced will be described as an example (S1).

When the filter 2-100 is replaced, foreign substances in the form of fine particles including carbon may be generated from the filter 2-100. A method of discharging the foreign substances through water to remove the foreign substances will be described.

Additionally, an example of a screen displayed on the user interface device 300 in each operation described below will be described with reference to FIG. 19. Each screen shown in FIG. 19 may be displayed on a display corresponding to a portion D1 of the user interface device 300. A portion corresponding to a portion D2 of the user interface device 300 is a portion provided to allow a user to enter a user input. The portion D2 of the user interface device 300 may be operated by a touch or by a pressing of a button.

Information about a guide message and a selection window displayed on the user interface described below may be displayed based on information stored in the memory 2200.

After replacing the filter 2-100, the user may press a filter initialization key (S2).

The filter initialization key may be included in the user interface device 300.

In response to the filter initialization key being pressed, the user interface device 300 may generate an input signal that is to be transmitted to the processor 2100. Based on the input signal generated by the user interface device 300, the processor 2100 may store information about the usage amount of the filter 2-100 in the memory 2200 to measure the usage amount of the filter 2-100 from the beginning. In response to the filter initialization key being pressed, information about the usage amount of the filter 2-100 stored in the memory 2200 may be initialized.

The processor 2100 may, in response to the filter initialization key being pressed, control the user interface device 300 to display, on the user interface device 300, a notification regarding a filter cleaning function execution request based on the signal generated by the user interface device 300 (S3).

The user may check the notification displayed on the user interface device 300 and select whether to execute the filter cleaning function.

As shown in FIG. 19, the portion D1 of the user interface device 300 may display selection windows of "Do now" and "Skip" together with a guide message "Execute filter cleaning function". A key located in the portion D2 of the user interface device 300 may be manipulated to select one of the two selection windows (S4).

Depending on users, a user may not desire to dispense water containing foreign substances. In order to discharge foreign substances by dispensing water containing foreign substances, a considerable amount of time may be taken before the ice making function is used. When ice is immediately needed regardless of whether the ice is clean, the user may desire to immediately drive the ice making device 1000. In this case, the user may not execute the foreign substance removal function by selecting the selection window "Skip" of the user interface device 300.

The user interface device 300 may, upon no selection of a command related to the execution of the filter cleaning function displayed on the user interface device 300 for a preset period of time, remove the display of the filter cleaning function. This is the same result as the case of selecting the selection window "Skip" of the user interface device 300 described above.

A user may select the filter cleaning function. That is, a user may select the selection window "Do now" of the user interface device 300 to select the filter cleaning function. Upon selecting, by the user, the filter cleaning function, the user interface device 300 may generate an input signal corresponding to the selection. Based on the input signal generated by the user interface device 300, the processor 2100 may control the ice making device 1000 (S5).

The processor 2100 may switch the ice making trays 1310 and 1410 from the first state to the second state to execute the filter cleaning function. The processor 2100 may control the driving devices 1320 and 1420 based on the input signal generated by the user interface device 300. The driving devices 1320 and 1420 may move the ice making trays 1310 and 1410 from the first state to the second state.

While the first ice-making tray 1310 is moving from the first state to the second state, the ice-making space 1300S of the first ice-making tray 1310 may move to face leftward, rightward, or downward instead of upward. The first ice making tray 1310 may rotate and move with respect to the rotation axis.

When the first ice making tray 1310 is in the second state, water discharged from the water supply device 200 may move toward the ice bucket 100 after making friction with the outer surface of the first ice making tray 1310, or may move toward the ice bucket 100 without contacting the ice making tray 1310. The first ice making tray 1310 may be operated in a direct water dispensing mode. Here, direct water dispensing may refer to dispensing of water in which water discharged through the water supply device 200 is dispensed without interference with the ice making tray 1310 while moving toward the ice bucket 100.

While the second ice-making tray 1410 is moving from the first state to the second state, the ice-making space 1400S may be changed to open only toward the water supply device 200 and then open only toward the ice bucket 100. The movable tray 1412 of the second ice making tray 1410 may be moved in a direction away from the fixed tray 1411. Accordingly, the ice-making space 1400S formed by being surrounded by the movable tray 1412 and the fixed tray 1411 may be changed to be open in the vertical direction.

When the second ice making tray 1410 is in the second state, water discharged from the water supply device 200 may be moved between the movable tray 1412 and the fixed tray 1411, dropping toward the ice bucket 100. The second ice making tray 1410 may be operated in a direct water dispensing mode. Here, direct water dispensing may refer to dispensing of water in which water discharged through the water supply device 200 is dispensed without interference with the ice making tray 1410 while moving toward the ice bucket 100.

However, the following operations may be performed while the first ice making tray 1310 is in the first state. When a supply of water proceeds while the first ice-making tray 1310 is in the first state, the supplied water may be stored in the ice-making space 1300S and then overflow from the first ice-making tray 1310, to move toward the ice bucket 100.

Alternatively, the following operations may be performed while the first ice making tray 1310 and the second ice making tray 1410 alternate between the first state and the second state. Water discharged from the water supply device 200 may be received in the ice making spaces 1300S and 1400S, and then, when the first ice making tray 1310 and the second ice making tray 1410 are switched into the second state, move toward the ice bucket 100.

Water discharged from the water supply device 200 may be accommodated in a space formed inside the ice bucket 100.

The processor 2100 may, after the moving of the ice making trays 1310 and 1410, perform a preliminary water dispensing. The preliminary water dispensing may refer to water dispensing of checking whether a water dispensing is allowable before proceeding with the main water dispensing.

The processor 2100 may control the user interface device 300 to display, on the user interface device 300, whether to proceed with a preliminary water dispensing before proceeding with a preliminary water dispensing. The user may select whether to proceed with a preliminary water dispensing.

As shown in FIG. 19, the user interface device 300 may display, selection windows of "Proceed" and "Skip" together with a guide message "Start preliminary water dispensing". The user may manipulate the portion D2 of the user interface to select one of functions guided in the selection windows (S6).

When "Proceed" is selected among the selection windows, the user interface device 300 may output an input signal related thereto. In this case, operations for proceeding with a preliminary water dispensing may be performed. When "Skip" is selected among the selection windows, the user interface device 300 may output an input signal related thereto. In this case, operations for proceeding with the main water dispensing may be performed.

When the user selects "Proceed" in the selection window, the processor 2100 may control the water supply valve 220 to open the water supply pipe 210 to proceed with the preliminary water dispensing. The processor 2100 may control the water supply valve 220 such that a preset amount of water is dispensed (S7).

The preset amount of water may refer to an amount of water suitable for the user to identify that the ice bucket 100 is not mounted on the body 10 by water falling to a part of the body 10, in which the ice bucket 100 needs to be mounted, when the ice bucket 100 is not mounted on the body 10.

The preliminary water dispensing may be performed for two uses. One is to check whether water is dispensed from the water supply pipe 210 without clogging. When the water supply pipe 210 is clogged, the supply of water may not proceed, and therefore, it may be identified whether the refrigerator 1 has a failure by checking whether water is not dispensed. Another is to check whether the ice bucket 100 is mounted on the body 10. When the ice bucket 100 is not mounted on the body 10, water may be directly dispensed to the inside of the body 10. In this case, there is a hassle of wiping off the water on the body 10, which is a situation that should be prevented. When water is collected in the ice bucket 100, the water may be discarded by separating the ice bucket 10 from the body 10.

The refrigerator 1 may include a mounting sensor 420. The mounting sensor 420 may output a signal related to whether the ice bucket 100 is mounted on the body 10.

The processor 2100 may control the user interface device 300 to omit the preliminary water dispensing based on the signal output from the mounting sensor 420 in response to the ice bucket 100 being mounted on the body 10.

Since the preliminary water dispensing is a process of checking whether the ice bucket 100 is mounted on the body 10, upon confirming whether the ice bucket 100 is already mounted on the body 10, the preliminary water dispensing may not proceed.

In response to the ice bucket 100 not being mounted on the body 10, the mounting sensor 420 may output a signal related thereto. In this case, the processor 2100 may display, on the user interface device 300, a notification that the ice bucket 100 should be mounted on the body 10, which is a subsequent process.

However, even when the ice bucket 100 is not mounted on the body 10, water dispensing may proceed. This is because even when the ice bucket 100 is not mounted, a device for receiving dispensed water may be used.

The processor 2100 may control the user interface device 300 to display, on the user interface device 300, an indication selectable by the user regarding a main water dispensing to proceed with a water dispensing (S8).

As shown in FIG. 19, the user interface device 300 may display selection windows, such as "Proceed" and "Previous" together with a guide phrase "If the ice bucket is ready, please proceed with water dispensing."

The processor 2100 may allow the user interface device 300 to display selection windows for selecting "Proceed" or "Previous" together with a guide message saying "If the ice bucket is ready, please continue dispensing water".

The user may press "Previous" displayed on the user interface device 300 to select an operation of selecting a preliminary water dispensing. In this case, based on a signal generated by the user interface device 300 in response to "Previous" being selected by the user, the processor 2100 may control the user interface device 300 to output a screen that is displayed to select a preliminary water dispensing on the interface device 300.

The user may press "Proceed" displayed on the user interface device 300 to select an operation for the main water dispensing. In this case, based on a signal generated by the user interface device 300 in response to "Proceed" being selected by the user, the processor 2100 may control the water supply valve 220 for the water supply valve 220 to open the water supply pipe 210. When the water supply valve 220 opens the water supply pipe 210, water may be discharged through the water supply pipe 210 (S9).

For reference, water may be supplied from another water supply source and discharged through the water supply pipe 210. In this case, the water supply source may have a water pressure increased through a separate device for increasing the water pressure. In this case, when the water supply valve 220 is opened, since the water supply pipe 210 communicates with the outside, water having a pressure higher than the atmospheric pressure of the outside may be discharged to the outside of the water supply pipe 210. Alternatively, even when the water supply source does not have a high water pressure, the water supply device 200 may include a pump such that the water has a high pressure.

When the processor 2100 controls the water supply valve 220 to open the water supply valve 220, water may be discharged to the outside of the water supply pipe 210. The water discharged to the outside of the water supply pipe 210 may be discharged toward the ice bucket 100. That is, water dispensing may proceed.

While water is being discharged to the outside of the water supply pipe 210 through the water supply pipe 210, the flow sensor 410 installed in the water supply pipe 210 may generate a signal corresponding to a water supply amount.

The flow sensor 410 may include a flow sensor body (not shown) having a cylindrical shape and a rotating body (not shown) inserted into the flow sensor body.

The rotating body may be rotated by the flow of water supplied from the water supply source, and include a holder (not shown) fixing the rotating body inside the flow sensor body, an impeller (not shown) that rotates around a rotating shaft according to the flow of water, and a permanent magnet (not shown) rotating together with the impeller.

In addition, the flow sensor body may have a Hall sensor (not shown) formed on the outside of the flow sensor body and configured to detect a magnetic field generated by the permanent magnet of the rotating body.

According to rotation of the permanent magnet, a magnetic field may be detected by the Hall sensor at the same period as the rotation period of the rotating body, and an electric pulse may be output whenever the magnetic field is detected.

The processor 2100 may calculate the amount of water supplied from the external water supply source to a purified water supply module based on the total number of electrical pulses output by the flow sensor 410, and calculate a flow velocity at which water is supplied to the purified water supply module based on the number of electric pulses per unit time (e.g., 1 second).

The processor 2100 may control the user interface device 300 to display information about the water supply amount based on a signal generated by the flow sensor 410. In this case, the user interface device 300 may display information about the amount of water supplied so far or information about the amount of water to be supplied for water purification (S10).

In this case, the amount of water to be discharged to remove foreign substances generated in the filter 2-100 may be empirically or experimentally determined. For example, the amount of water to be discharged to remove foreign substances generated in the filter 2-100 may be 20 L.

Alternatively, the processor 2100 may control the user interface device 300 to display information about a water supply time based on a signal generated by the flow sensor 410.

The processor 2100 may, upon occurrence of a condition of stopping water dispensing, control the water supply valve 220 such that the water supply valve 220 closes the water supply pipe 210 (S11).

The condition of stopping water dispensing may include three conditions.

First, the condition of stopping water dispensing is when the user inputs a button related to stopping water dispensing through the user interface device 300.

As described above, the processor 2100 may control the user interface device 300 to display, on the user interface device 300, information about the water dispensing amount while water dispensing is in progress. At the same time as displaying the information about the water dispending amount, the user interface device 300 may display, on the user interface device 300, an input unit 320 for stopping water dispensing such that the user may stop dispensing water when the user does not desire to proceed with water dispensing.

For example, as shown in FIG. 19, the user interface device 300 may display, on the user interface device 300, information "dispensing 0.1 L water", which is information about the current water dispensing amount. At the same time as displaying the information, the user interface device 300 may display a selection window "Stop" to receive a user's input for stopping dispensing water.

When the user provides a stop input to the user interface device 300 through the selection window "Stop", the user interface device 300 may output a signal corresponding thereto. The processor 2100 may control the water supply valve 220 to close the water supply pipe 210 based on the signal generated by the user interface device 300.

Even with the signal "Stop" being input by the user, the user interface device 300 may display a notification to confirm the input once again for a case in which the user may incorrectly input the signal related to stopping a water supply.

For example, as shown in FIG. 19, the user interface device 300 may display selection windows "Proceed" and "Cancel" together with a guide message "Do you want to stop the filter cleaning function?".

When the user inputs a user input corresponding to the selection window "Proceed", the processor 2100 may control the water supply valve 220 to close the water supply pipe 210.

When the user inputs a user input corresponding to the selection window "Cancel", the processor 2100 may maintain the progress of water supply and control the user interface device 300 to display information about the water dispensing amount.

When a user inputs a user input related to stopping water supply, water dispensing may be stopped.

The processor 2100 may, based on the input signal generated by the user interface device 300 related to stopping a water dispensing, control the driving devices 1320 and 1420 such that the ice making trays 1310 and 1410 are positioned in the first state. Accordingly, when water is supplied to the ice making trays 1310 and 1410, the water may be accommodated in the ice making spaces 1300S and 1400S (S12).

The processor 2100 may, based on the input signal generated by the user interface device 300 related to stopping a water dispensing, control the user interface device 300 to display, on the user interface device 300, a notification to empty the ice bucket 100. Accordingly, the user may recognize that the water contained in the ice bucket 100 needs to be emptied (S13).

Second, the condition of stopping water dispensing is a case when the water dispensing amount exceeds a predetermined amount.

The predetermined water dispensing amount may be an amount sufficient to discharge foreign substances generated in the filter 2-100.

Upon the water dispensing amount exceeding the predetermined amount, there is no need for further water dispensing.

The processor 2100 may, based on a signal indicating that the water dispensing amount is greater than or equal to the predetermined amount, control the water supply valve 220 to close the water supply pipe 210.

The processor 2100 may, in order to check the water dispensing amount, use the signal from the flow sensor 410.

The processor 2100 may, in order to check the water dispensing amount, multiply the flow rate of water discharged per hour by the water dispensing time to identify the water dispensing amount. In this case, the flow rate of water discharged per hour may be calculated using the pressure of the water and the cross-sectional area of the water supply pipe 210.

As described above, the flow sensor 410 may generate a signal related to the water dispensing amount by allowing the impeller to rotate. However, when the water pressure is not great enough to rotate the impeller, it may be difficult for the flow sensor 410 to generate an accurate signal related to the water dispensing amount. In this case, accurate information about the water dispensing amount may be obtained using information about a predetermined water pressure that is determined in advance at the time of design and the cross-sectional area of the water dispensing pipe, together with the water dispensing time (S12*a*).

When the water dispensing amount is greater than or equal to the predetermined value, water dispensing may be stopped in the same process as in the first case of the condition of stopping water dispensing (S12*b*).

Third, the condition of stopping water dispensing may be a case when the ice bucket 100 is filled with water.

When the ice bucket 100 is filled with water, a further supply of water may cause water to overflow from the ice bucket 100. In this case, the user may experience inconvenience in wiping the spilled water. To prevent the inconvenience, when the ice bucket 100 is full of water, water dispensing may be stopped.

In order to identify whether the ice bucket 100 is full of water, the weight sensor 430 may be used. Alternatively, the weight sensor 430 may be used to identify whether the ice bucket 100 is filled with a preset amount of water.

The weight sensor 430 may include a piezoelectric element. The weight sensor 430 may output a different signal related to each weight according to the strength of the current generated by the pressure applied to the piezoelectric element.

However, the sensor used to identify whether the ice bucket 100 is full of water is not limited to the weight sensor 430. For example, electrodes open at both ends may be positioned above the ice bucket 100. In this case, when water touches the electrodes, current may flow through both electrodes because water conducting electricity may be positioned between the open electrodes. Accordingly, it may be identified whether the ice bucket 100 is full of water. However, for convenience of description, it is assumed that the weight sensor 430 is used as a sensor for identifying whether the ice bucket 100 is full of water.

The processor 2100 may, upon the weight of the ice bucket 100 and the water accommodated in the ice bucket 100 being exceeding a preset value based on the signal generated by the weight sensor 430 in response to the weight of the ice bucket 100 and water accommodated in the ice bucket 100, control the water supply valve 220 to close the water supply pipe 210.

Additionally, the processor 2100 may, when a sufficient amount of water is filled in the ice bucket 100, control the user interface device 300 to display, on the user interface device 300, a notification to empty the water contained in the ice bucket 100 (S14).

In the previous embodiment, the concept of the disclosure has been described assuming that water is not contained in the ice-making spaces 1300S and 1400S of the ice-making trays 1310 and 1410. However, the disclosure is not limited thereto, and the ice making trays 1310 and 1410 may repeatedly move from the first state to the second state and repeatedly discharge water contained in the ice making spaces 1300S and 1400S. In this case, the processor 2100 may control the driving devices 1320 and 1420 to move the ice making trays 1310 and 1410.

In the description above, the refrigerator 1 and the method of controlling the refrigerator 1 according to one embodiment of the disclosure have been described. Hereinafter, a refrigerator 1 and a method of controlling a refrigerator 1 according to another embodiment of the disclosure will be described. In describing other embodiments, the same reference numerals may be given to the components identical to those shown in FIGS. 1 to 20, and descriptions thereof may be omitted.

Figure 21:
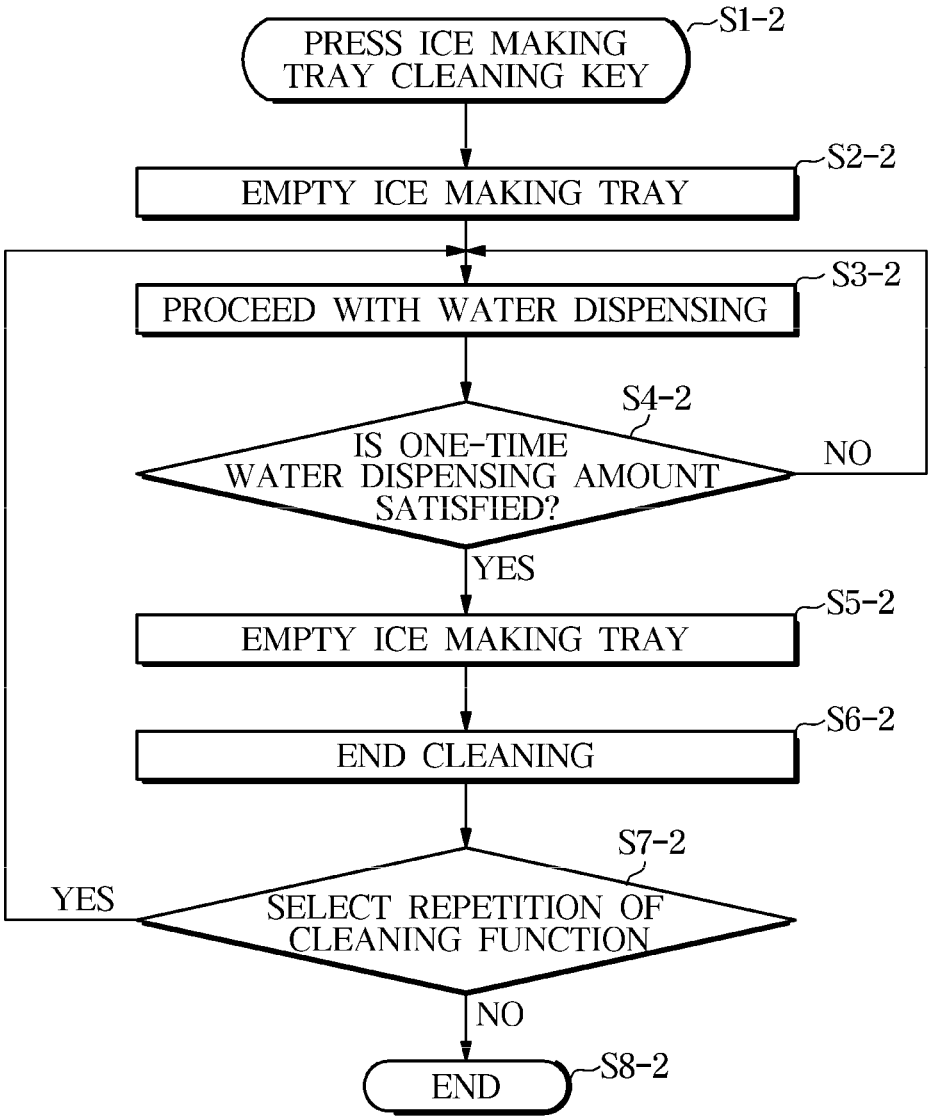
FIG. 21 is a flowchart showing a process in which a control unit of a refrigerator controls an ice making device and a water supply device according to an embodiment of the disclosure.

FIG. 21 is a flowchart showing a process in which a control unit 2000 of a refrigerator 1 controls an ice making device 1000 and a water supply device 200 according to an embodiment of the disclosure.

Referring to FIG. 21, a method of controlling a refrigerator 1 according to an embodiment of the disclosure will be described.

The description of the above embodiment has been made in relation that foreign substances are generated from a filter 2-100 during replacement of the filter 2-100, and thus water supply is required to remove the foreign substances.

In an embodiment of the disclosure, the description is made on the assumption that foreign substances are accommodated in the ice making trays 1310 and 1410, and thus water dispensing is required to remove the foreign substances.

The user may press "an ice making tray cleaning key" on an user interface device 300 to input a signal related to an input for cleaning the ice making trays 1310 and 1410 to the user interface device 300. In this case, the user interface device 300 may transmit a corresponding signal to the processor 2100 (S1-2).

The processor 2100 may, based on the signal generated by the user interface device 300, control the driving devices 1320 and 1420 to empty the ice making trays 1310 and 1410 of the ice making device. This is because the ice making trays 1310 and 1410 may be in a state of accommodating ice. Even when ice is not accommodated in the ice-making trays 1310 and 1410, only the movement of the ice-making trays 1310 and 1410 may allow foreign substances located in the ice-making spaces 1300S and 1400S to be discharged (S2-2).

The ice making trays 1310 and 1410 may be moved from the first state to the second state by the driving devices 1320 and 1420 so as to be emptied.

Thereafter, the processor 2100 may control the driving devices 1320 and 1420 to return to the first state such that water may be accommodated in the ice making trays 1310 and 1410.

The processor 2100 may, upon the ice making trays 1310 and 1410 being empty, control the water supply valve 220 to open the water supply pipe 210 to proceed with water dispensing (S3-2).

The processor 2100 may open or close the water supply valve 220 to discharge a predetermined amount of water. In other words, the processor 2100 may control the water supply valve 220 to close the water supply pipe 210 when a predetermined water dispensing amount is satisfied.

Here, the predetermined amount may refer to an amount sufficient to fill the ice-making spaces 1300S and 1400S with water. For example, the predetermined water dispensing amount may refer to an amount of dispensed water at which the ice-making spaces 1300S and 1400S are full of water. The predetermined water dispensing amount may be regarded as a one-time water dispensing amount (S4-2).

Since the ice making trays 1310 and 1410 are in the first state, water supplied after the water dispensing is performed to the extent that the ice making spaces 1300S and 1400S are filled with water may overflow from the ice making trays 1310 and 1410. To prevent the overflow, the water dispensing amount may be set to an amount corresponding to the ice-making spaces 1300S and 1400S.

When the predetermined amount of water is filled in the ice-making spaces 1300S and 1400S, the processor 2100 may control the driving devices 1320 and 1420 to move the water located in the ice-making trays 1310 and 1410 toward the ice bucket 100.

The ice making trays 1310 and 1410 may be moved from the first state to the second state by the processor 2100. That is, the ice making trays 1310 and 1410 may be emptied (S5-2).

That is, when the one-time water dispensing amount is satisfied, the ice making trays 1310 and 1410 may be emptied.

However, it is not limited thereto, and the ice making trays 1310 and 1410 may remain in the first state after the water dispensing. In this case, the dispensed water, filling the ice making trays 1310 and 1410, may overflow over the ice making trays 1310 and 1410. The overflowing water may move toward the ice bucket 100 located on a side in the gravity direction with respect to the ice making trays 1310 and 1410. As the water overflows, the water may move toward the ice bucket 100 together with foreign substances located inside the ice making trays 1310 and 1410.

After the water is moved from the ice making trays 1310 and 1410 toward the ice bucket 100, the processor 2100 may end the cleaning process of the ice making trays 1310 and 1410 (S6-2).

However, when it is identified that foreign substances in the ice making trays 1310 and 1410 are not sufficiently emptied by a one-time water dispensing, the above process may be repeated (S7-2).

Figure 22:
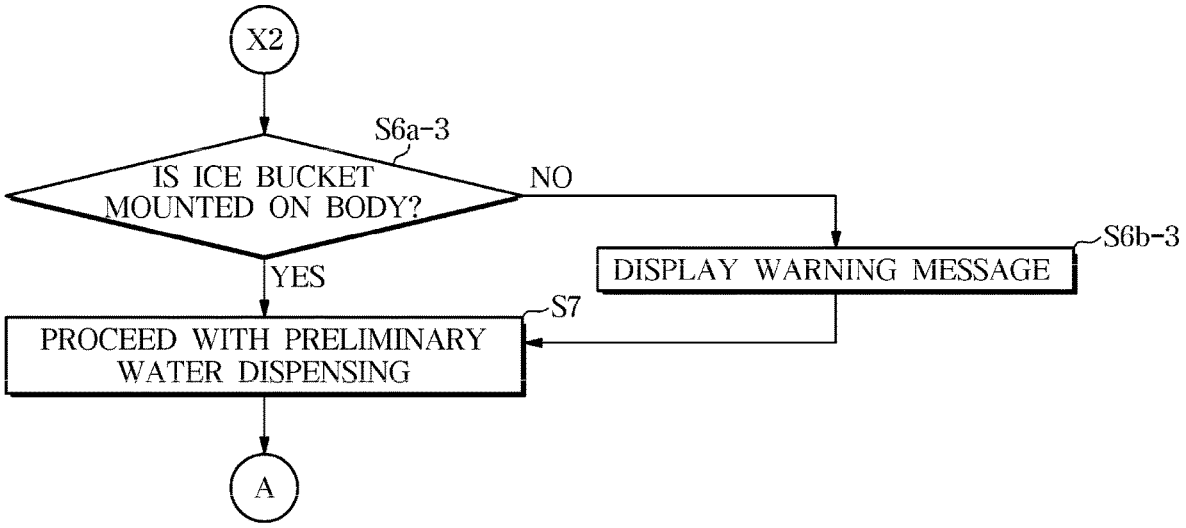
FIG. 22 is a flowchart showing a process in which a control unit of a refrigerator controls an ice making device and a water supply device according to an embodiment of the disclosure.

FIG. 22 is a flowchart showing a process in which a control unit 2000 of a refrigerator 1 controls an ice making device 1000 and a water supply device 20 according to an embodiment of the disclosure.

Referring to FIG. 22, a process of identifying whether the ice bucket 100 is mounted on the body 10 according to an embodiment of the disclosure will be described.

In response to a selection desired to proceed with a preliminary water dispensing in a process of selecting whether to proceed with a preliminary water dispensing, it may be checked whether the ice bucket is mounted on the body 10. More specifically, whether the ice bucket is mounted on the body 10 may be checked before a preliminary water dispensing proceeds upon a selection of preliminary water dispensing (S6*a*-3).

The processor 2100 may, based on a signal generated by the mounting sensor 420 in response to a mounting state of the ice bucket on the body 10, control the user interface device 300 to display, on the interface device 300, an indication that water may leak during the preliminary water dispensing (S6*b*-3).

Then, as described above, the processor 2100 may control the water supply valve 220 to proceed with the preliminary water dispensing.

Figure 23:
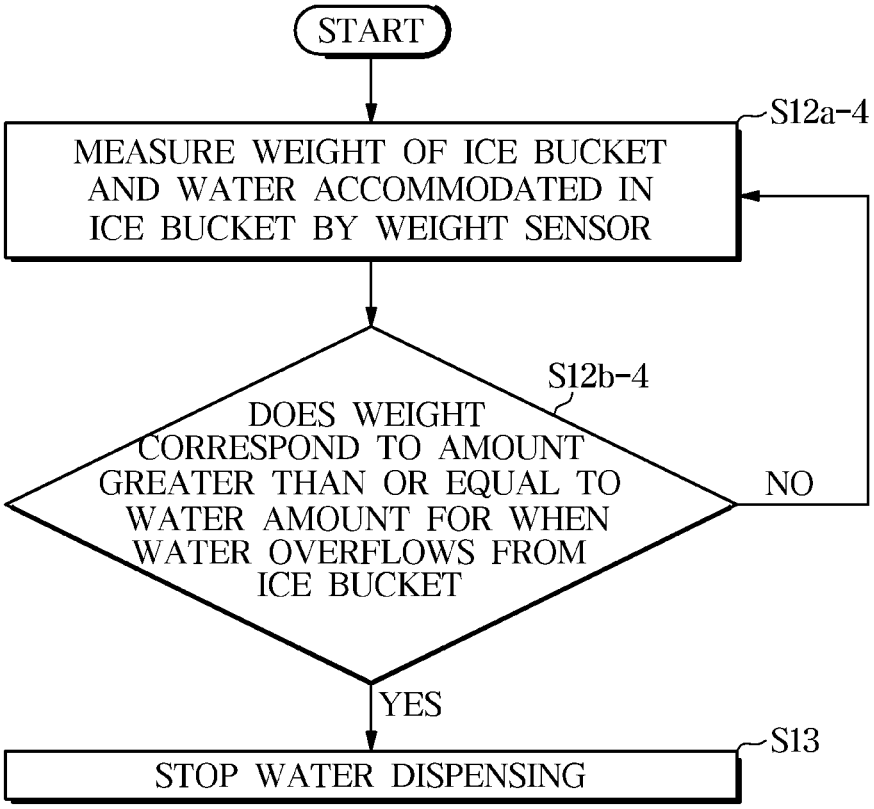
FIG. 23 is a flowchart showing a process in which a control unit of a refrigerator controls an ice making device and a water supply device according to an embodiment of the disclosure.

FIG. 23 is a flowchart showing a process in which a control unit of a refrigerator 1 controls an ice making device 1000 and a water supply device 200 according to an embodiment of the disclosure.

Referring to FIG. 23, a process of stopping water dispensing based on the degree to which water is filled in the ice bucket 100 according to an embodiment of the disclosure will be described (S12-4).

As described above, the condition of stopping water dispensing includes a case in which the ice bucket 100 is filled with more water than a predetermined amount.

The weight of the ice bucket 100 and water accommodated inside the ice bucket 100 may be measured by the weight sensor 430 (S12*a*-4).

The processor 2100 may identify whether the weight measured by the weight sensor 430 corresponds to an amount greater than or equal to a water amount for when water overflows from the ice bucket 100. The processor 2100 may control the water supply valve 220 to stop water dispensing based on the identified information (S12*b*-4).

Figure 24:
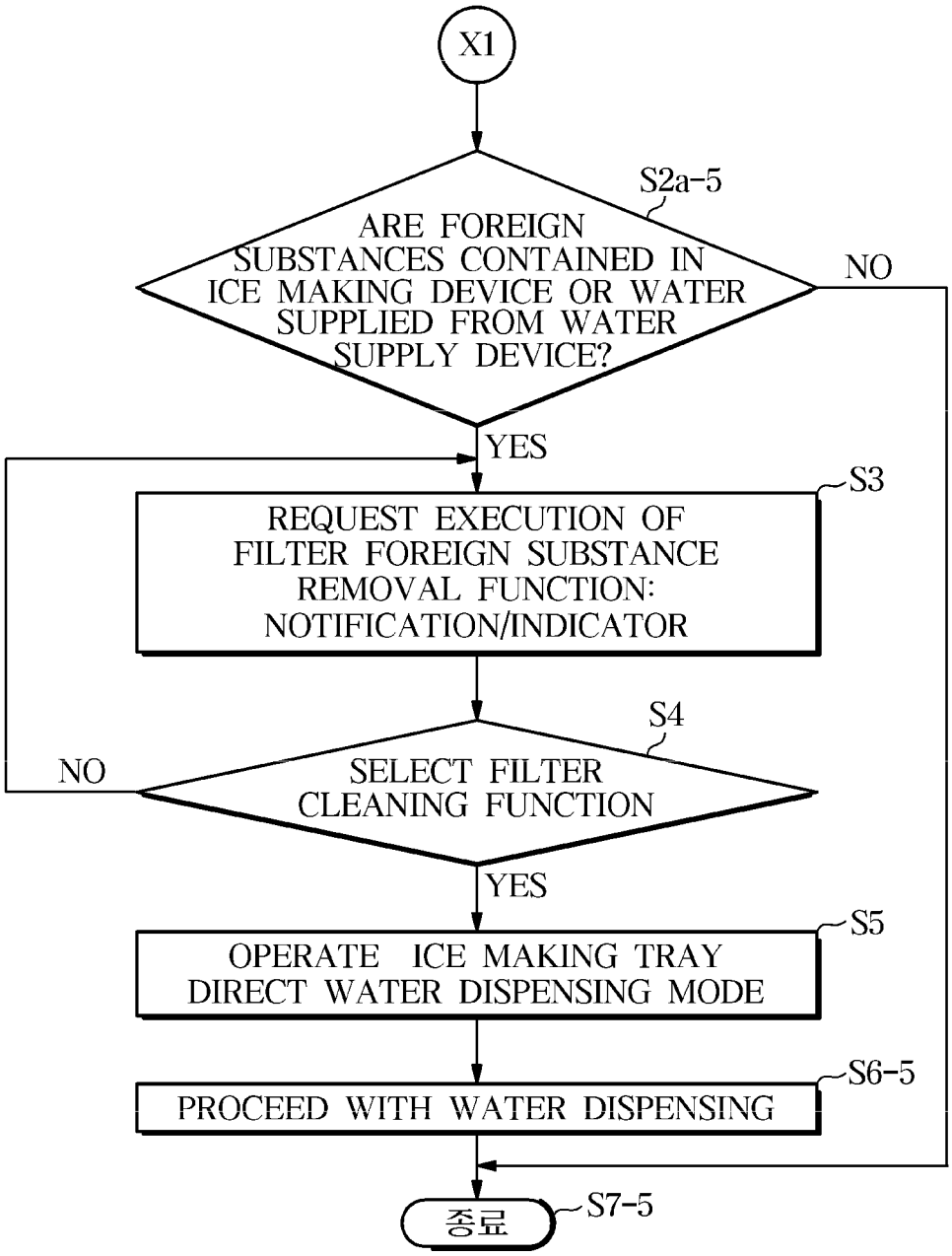
FIG. 24 is a flowchart showing a process in which a control unit of a refrigerator controls an ice making device and a water supply device according to an embodiment of the disclosure.

FIG. 24 is a flowchart showing a process in which a control unit 2000 of a refrigerator 1 controls an ice making device 1000 and a water supply device 200 according to an embodiment of the disclosure.

Referring to FIG. 24, a water dispensing operation according to an embodiment of the disclosure will be described.

Prior to proceeding with water dispensing, an operation of identifying whether foreign substances are present may be additionally performed.

The refrigerator 1 may further include a foreign substance detection sensor (not shown).

The foreign substance detection sensor may output a signal in response to whether foreign substances are contained in the ice making spaces 1300S and 1400S of the ice making device 1000 or foreign substances are contained in water supplied to the water supply device 200 by passing through the filter 2-100 (S2*a*-5).

The processor 2100 may determine whether to select the filter cleaning function based on the signal output by the foreign substance detection sensor. In other words, the processor 2100 may, based on a signal generated by the foreign substances detection sensor in response to the absence of foreign substances in the ice-making spaces 1300S and 1400S or in the water supplied from the water supply device 200, may not perform the filter cleaning function. In this case, there are no foreign substances to be removed, and thus the ice making device 1000 may be used in the same manner as in the conventional technology. However, the processor 2100 may, based on a signal generated by the foreign substances detection sensor in response to the presence of foreign substances in the ice-making spaces 1300S and 1400S or in the water supplied from the water supply device 200, may perform the filter cleaning function (S6-5).

Here, the filter cleaning function may include a procedure related to the filter cleaning function described above.

Figure 25:
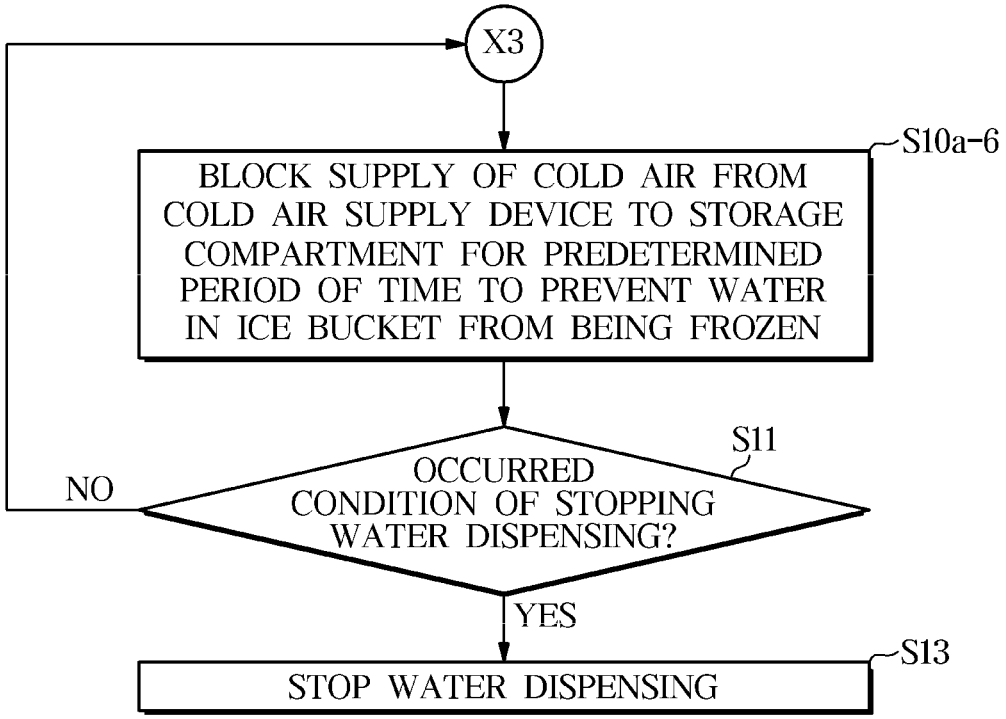
FIG. 25 is a flowchart showing a process in which a control unit of a refrigerator controls an ice making device and a water supply device according to an embodiment of the disclosure.

FIG. 25 is a flowchart showing a process in which a control unit 2000 of a refrigerator 1 controls an ice making device 1000 and a water supply device 200 according to an embodiment of the disclosure.

Referring to FIG. 25, a method of preventing freezing of water contained in the ice bucket 100 according to an embodiment of the disclosure will be described.

Since the ice bucket 100 is located in the storage compartment 20 when water dispensing proceeds, water accommodated in the ice bucket 100 may be frozen. When the water contained in the ice bucket 100 freezes, the user may need to remove the ice inside the ice bucket 100 to use the ice bucket 100, which is not preferable. Therefore, it is required to prevent water contained in the ice bucket 100 from freezing.

In order to prevent water contained in the ice bucket 100 from freezing, the processor 2100 may control the cold air supply device to prevent cold air from being supplied to the ice bucket 100 for a predetermined period of time based on a signal generated from the user interface device 300 related to progress of water dispensing (S10*a*-6).

The processor 2100 may control the cold air supply device to stop the operation of the cold air supply device for the entire duration of the water dispensing.

Alternatively, the processor 2100 may control the cold air supply device to stop the operation of the cold air supply device intermittently during the water dispensing.

Figure 26:
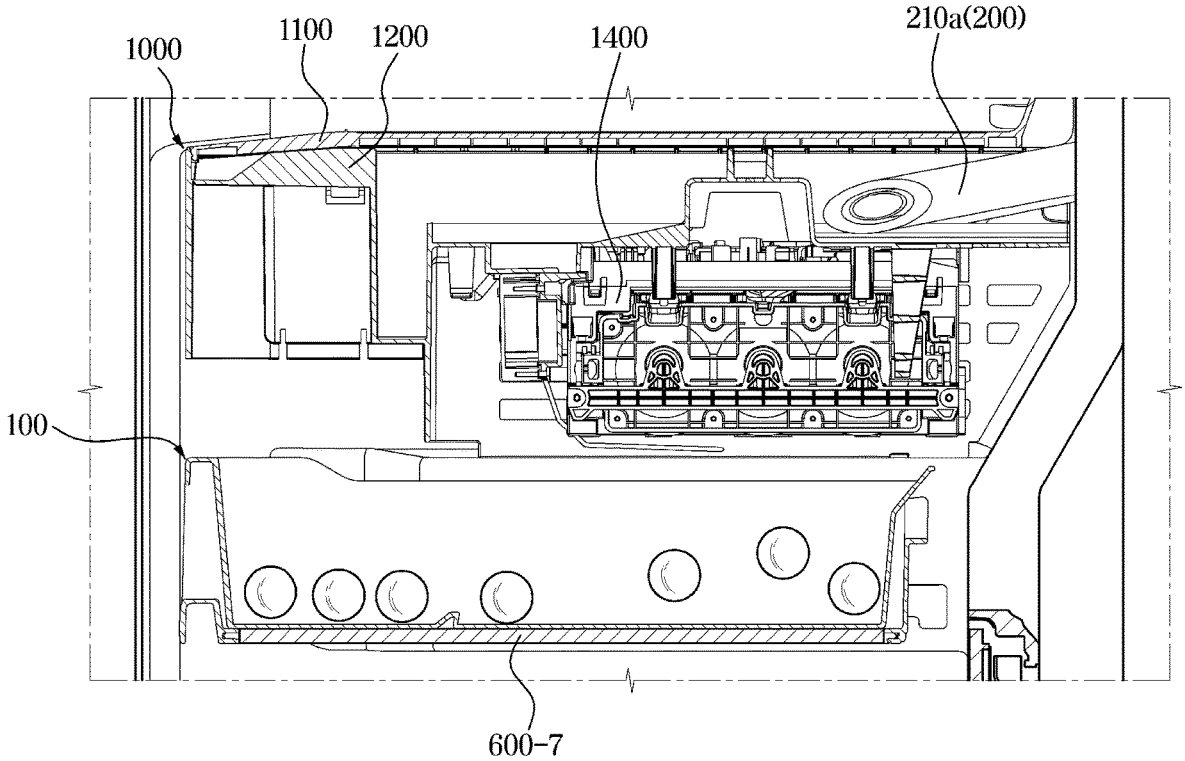
FIG. 26 is a cross-sectional view illustrating an ice making device of a refrigerator and related parts thereof according to an embodiment of the disclosure.

FIG. 26 is a cross-sectional view illustrating an ice making device 1000 of a refrigerator 1 and related parts thereof according to an embodiment of the disclosure.

Referring to FIG. 26, a configuration for achieving the same purpose as that of the embodiment of the disclosure described with reference to FIG. 14 will be described.

The ice making device 1000 may include a heater 600-7.

The heater 600-7 may be in contact with the ice bucket 100.

The processor 2100 may control the heater 600-7 to operate the heater 600-7 based on a signal generated by the user interface device 300 related to water dispensing. Accordingly, freezing of water in the ice bucket 100 may be prevented.

Figure 27:
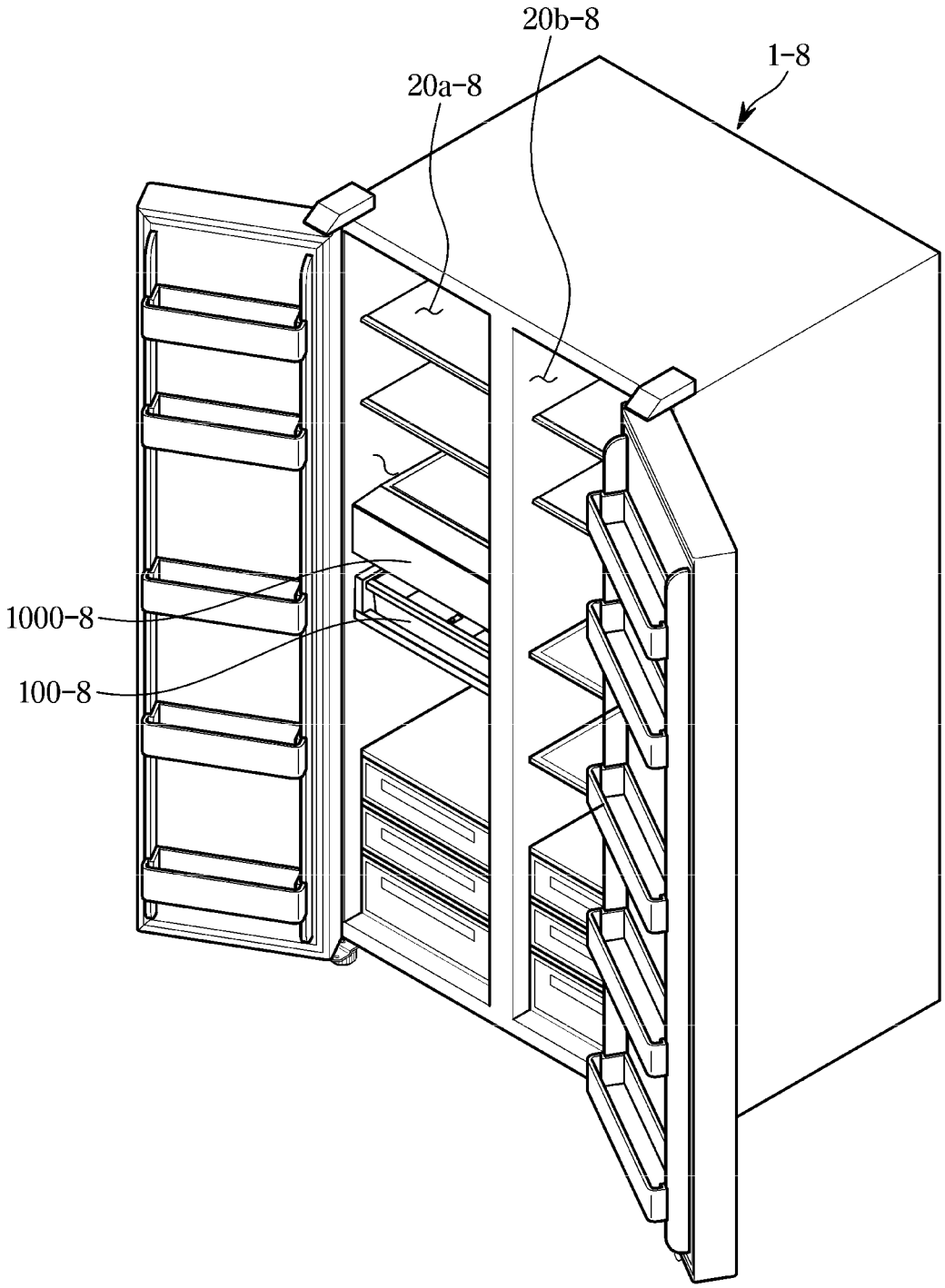
FIG. 27 is a perspective view illustrating a refrigerator according to an embodiment of the disclosure.

FIG. 27 is a perspective view illustrating a refrigerator 1-8 according to an embodiment of the disclosure.

Referring to FIG. 27, a refrigerator 1-8 according to an embodiment of the disclosure will be described.

The ice making device 1000 according to the disclosure may be applied to a refrigerator 1-8 that is equipped with not only a freezer compartment 20*a*-8 but also a refrigerator compartment 20*b*-8.

The refrigerator 1-8 may include a dispenser (not shown) for supplying water. Even in this case, the concept of an ice making device 1000-8, and control of an ice making device 1000-8 and a water supply device (not shown) according to the disclosure may be applied in the same manner as the above.

As is apparent from the above, according to the concept of the disclosure, the refrigerator includes a control unit configured to control a water supply device and an ice making device such that water containing foreign substances is allowed to flow outward from an ice making tray, thereby, when water supplied from the water supply device contains foreign substances, preventing the water from being accommodated in the ice making tray.

According to the concept of the disclosure, the refrigerator is implemented to discharge water containing foreign substances of a filter to the outside of an ice making device such that upon replacement of a filter, which is connected to a water supply device, foreign substances initially formed in the filter can be rapidly discharged to the outside of the ice making device without being produced as ice.

According to the aspect concept of the disclosure, the refrigerator is implemented to, when an ice making tray is positioned in a state capable of discharging ice, allow a water supply device to discharge water containing foreign substances, and thus water discharged from the water supply device can be smoothly discharged.

According to the concept of the disclosure, the refrigerator includes a control unit capable of transmitting a notification when an ice bucket is not mounted in a body such that water discharged from a water supply device can be prevented from flowing into a storage compartment other than the ice bucket.

According to the concept of the disclosure, the refrigerator is implemented to measure the flow rate of water passing through a water supply device by a flow sensor, or calculate the flow rate of water based on the duration of water flow, with which a water dispensing amount can be checked and thus whether water containing foreign substances has been discharged from the water supply device can be checked.

The effects of the disclosure are not limited to the effects described above, and other effects that are not described will be clearly understood by those skilled in the art from the above detailed description.

Unless otherwise specified, the illustrated illustrative embodiments may be combined with other embodiments. Alternatively, unless clearly limited, when one embodiment is combined with another embodiment, it should be understood that combinations are possible between the embodiments. The combination of one embodiment and another embodiment is considered to be disclosed in this document.

While the disclosure has been shown and described with reference to various embodiments thereof, it will be understood by those skilled in the art that various changes in form and details may be made therein without departing from the concept and scope of the disclosure as defined by the appended claims and their equivalents.

What is claimed is:

1. A refrigerator comprising:

a body;

a water supply device including:

a water supply pipe at least partially inserted into the body, and a water supply valve configured to open and close the water supply pipe;

an ice making device including:

an ice making tray defining an ice making space, the ice making tray being movable so that water discharged from the water supply pipe is accommodatable in the ice making space when the ice making tray is positioned to make ice, and a driving device configured to move the ice making tray;

a user interface device configured to receive a user input; and a control unit configured to, based on a received user input to execute a function of removing foreign substances contained in water discharged from the water supply pipe:

control the driving device to move the ice making tray to a position in which water discharged from the water supply pipe is prevented from being accommodated in the ice making space, and control the water supply valve to open the water supply pipe so that water is discharged from the water supply pipe.

2. The refrigerator of claim 1, further comprising:

an ice bucket below the ice making tray, wherein the control unit is configured to control the driving device to move the ice making tray such that the water discharged from the water supply pipe is moved directly toward the ice bucket.

3. The refrigerator of claim 1, wherein the ice making tray is movable between a first state in which the water discharged from the water supply pipe is accommodated in the ice making space, and a second state in which the water discharged from the water supply pipe is prevented from being accommodated in the ice making space, and the control unit is configured to control the driving device such that the ice making tray is positioned in the second state based on the received user input.

4. The refrigerator of claim 1, wherein the ice making tray includes:

a fixed tray, and a movable tray configured to be moved toward the fixed tray and away from the fixed tray by the driving device, and the control unit is configured to control the driving device to move the movable tray such that the water discharged from the water supply pipe is discharged between the fixed tray and the movable tray.

5. The refrigerator of claim 1, wherein the ice making tray is rotatable about a rotation axis by the driving device, and the control unit is configured to control the driving device to rotate the ice making tray to prevent the water discharged from the water supply pipe from being accommodated in the ice making space of the ice making tray.

6. The refrigerator of claim 5, wherein the control unit is configured, in order to prevent the water discharged from the water supply pipe from being accommodated in the ice making space of the ice making tray, to control the driving device such that the ice making tray is rotated to a position in which the water discharged from the water supply pipe is prevented from being accommodated in the ice making space, and control the water supply valve to open the water supply pipe so that the water is discharged from the water supply pipe.

7. The refrigerator of claim 5, wherein the control unit is configured, in order to allow water to overflow out of the ice making tray based on the user input being received, to control the water supply valve such that water is discharged from the water supply pipe while the ice making tray is prevented from rotating.

8. The refrigerator of claim 2, wherein the ice bucket is detachably mounted on the body, and the control unit is configured to control the water supply valve to close the water supply pipe after opening the water supply pipe for a predetermined time to perform a preliminary water dispensing process to check whether the ice bucket is mounted on the body.

9. The refrigerator of claim 2, further comprising:

a mounting sensor configured to output a signal in response to the ice bucket being mounted on the body, wherein the control unit is configured to, based on the signal output from the mounting sensor in response to the ice bucket being mounted on the body, control the water supply valve to skip a preliminary water dispensing process and proceed with a main water dispensing process.

10. The refrigerator of claim 3, further comprising:

a flow sensor configured to output a signal related to an amount of water flowing inside the water supply pipe, wherein the control unit is configured to control the user interface device to display a water dispensing amount based on the signal output from the flow sensor.

11. The refrigerator of claim 1, wherein the control unit is configured to control the user interface device to display a water dispensing amount on the user interface device based on a time during which water has flowed in the water supply pipe.

12. The refrigerator of claim 10, wherein the control unit is configured to control the water supply valve to close the water supply pipe when the water dispensing amount based on the signal output from the flow sensor is greater than a predetermined water dispensing amount for discharging the foreign substances.

13. The refrigerator of claim 1, wherein the user interface device is configured to receive a user input to stop supply of water, and the control unit is configured to control the water supply valve to close the water supply pipe based on the user input to stop the supply of water being received by the user interface device.

14. The refrigerator of claim 2, further comprising:

a weight sensor configured to output a signal related to an amount of water accommodated in the ice bucket, wherein the control unit is configured to, in order to prevent water from overflowing out of the ice bucket, identify whether an amount of water supplied to the ice bucket is more than a preset amount based on the signal output from the weight sensor, and control the water supply valve to close the water supply pipe based on the amount of water supplied to the ice bucket being more than the preset amount.

15. The refrigerator of claim 3, wherein the control unit is configured to, based on an amount of water discharged from the water supply pipe exceeding a preset value, control the driving device to move the ice making tray such that the ice making tray is positioned in the first state in which the water discharged from the water supply pipe is accommodated in the ice making space to make ice.

16. A method of controlling a refrigerator including a body, a water supply device including a water supply pipe at least partially inserted into the body and a water supply valve configured to open and close the water supply pipe, an ice making device including an ice making tray defining an ice making space, the ice making tray being movable so that water discharged from the water supply pipe is accommodatable in the ice making space when the ice making tray is positioned to make ice, and a driving device configured to move the ice making tray, and a user interface device configured to receive a user input, the method comprising:

receiving a user input to execute a function of removing foreign substances contained in water discharged from the water supply pipe, and, based on the received user input:

controlling the driving device to move the ice making tray to a position in which water discharged from the water supply pipe is prevented from being accommodated in the ice making space, and controlling the water supply valve to open the water supply pipe to that water is discharged from the water supply pipe.

17. The method of claim 16, further comprising:

displaying a notification window on the user interface device that inquires whether to execute the function of removing foreign substances contained in water discharged from the water supply pipe before controlling the driving device to move the ice making tray and controlling the water supply valve to open the water supply pipe.

18. The method of claim 16, further comprising:

controlling the water supply valve to close the water supply pipe after opening the water supply pipe for a predetermined time, to perform a preliminary water dispensing process to check whether a detachable ice bucket is mounted on the body.

19. The method of claim 16, further comprising:

controlling the user interface device to display a water dispensing amount based on a signal output from a flow sensor.

20. A refrigerator comprising:

a body;

a water supply device including:

a water supply pipe at least partially inserted into the body, and a water supply valve configured to open and close the water supply pipe;

an ice making device including:

an ice making tray defining an ice making space, the ice making tray configured to be movable between a first state in which water discharged from the water supply pipe is accommodatable in the ice making space, and a second state in which water discharged from the water supply pipe is prevented from being accommodated in the ice making space, and a driving device configured to move the ice making tray;

a user interface device configured to receive a user input; and a control unit configured to, based on a received user input to execute a function of removing foreign substances contained in water discharged from the water supply pipe:

control the driving device to position the ice making tray in the first state, and control the water supply valve to open the water supply pipe so that water is discharged from the water supply pipe so as to flow into the ice making space and overflow out of the ice making space.

* * * * *